United States Patent [19]

Sasaki et al.

[11] Patent Number: 5,006,454

[45] Date of Patent: Apr. 9, 1991

[54] LIGHT SENSITIVE SILVER HALIDE PHOTOGRAPHIC MATERIAL

[75] Inventors: Masao Sasaki, Hadano; Toyoki Nishijima; Shun Takada, both of Odawara; Kaoru Onodera, Sagamihara, all of Japan

[73] Assignee: Konishiroku Photo Industry Co., Ltd., Tokyo, Japan

[21] Appl. No.: 275,647

[22] Filed: Nov. 23, 1988

Related U.S. Application Data

[63] Continuation of Ser. No. 5,654, Jan. 21, 1987, abandoned.

[30] Foreign Application Priority Data

Jan. 25, 1986 [JP] Japan ..... 61-14595

[51] Int. Cl.[5] ..... G03C 7/38

[52] U.S. Cl. ..... 430/546; 430/551; 430/558

[58] Field of Search ..... 430/551, 558, 386, 387, 430/546

[56] References Cited

U.S. PATENT DOCUMENTS

| | | | |
|---|---|---|---|
| 3,930,866 | 1/1976 | Oishi et al. | 430/551 |
| 4,587,210 | 5/1986 | Ono et al. | 430/551 |
| 4,588,679 | 5/1986 | Furutachi | 430/558 |
| 4,632,617 | 11/1986 | Kaneko et al. | 430/551 |
| 4,639,415 | 1/1987 | Kaneko et al. | 430/551 |
| 4,675,275 | 6/1987 | Nishijima et al. | 430/372 |

FOREIGN PATENT DOCUMENTS 0182486 5/1986 European Pat. Off. .

*Primary Examiner*—Paul R. Michl
*Assistant Examiner*—Mark R. Buscher
*Attorney, Agent, or Firm*—Finnegan, Henderson, Farabow, Garrett, and Dunner

[57] ABSTRACT

A silver halide photographic material comprising a silver halide emulsion layer containing (1) a pyrazoloazole magenta coupler, (2) an anti-color-fading agent having an oxidation potential (Eox) of $0.95(V) < Eox < 1.50(V)$ and (3) a hydroquinone derivative.

13 Claims, No Drawings

LIGHT SENSITIVE SILVER HALIDE PHOTOGRAPHIC MATERIAL

This application is a continuation of application Ser. No. 07/005,654, filed Jan. 21, 1987, now abandoned.

FIELD OF THE INVENTION

This invention relates to a light-sensitive silver halide photographic material. More particularly, it relates to a light-sensitive silver halide photographic material having excellent color reproducibility and also remarkably improved in fastness to light of magenta dye images.

BACKGROUND OF THE INVENTION

It has been well known that dye images are produced by subjecting a light-sensitive silver halide color photographic material (hereinafter "color photographic material") to imagewise exposure to effect color development, whereby an oxidized product of an aromatic primary amine type color developing agent couples with a coupler to form dyes including, for example, indophenol, indoaniline, indamine, azomethine, phenoxadine, phenadine and other dyes similar to these. In such a photographic system, generally employed is a color reproduction system utilizing the subtractive color process, in which used is a color photographic material comprising blue-sensitive, green-sensitive and red-sensitive silver halide emulsion layers containing couplers each having the relationship of complementary color, namely, couplers which color-develop in yellow, magenta and cyan, respectively.

The coupler used for formation of yellow color images includes, for example, acetoanilide type couplers, and, as the coupler for formation of magenta color images, for example, pyrazolone, pyrazolobenzimidazole, pyrazolotriazole or indazolone type couplers are known, and further, as the coupler for formation of cyan color images, for example, phenol or naphthol type couplers are generally used.

The dye images thus obtained are desired not to undergo any color change or color-fading even when exposed to light for a long period of time or preserved under the conditions of high temperature and high humidity. Also desired are those in which non-image portions of a color photographic material may not yellow by light, moisture or heat.

However, in the case of magenta couplers, yellow stain (or Y-stain) by light, at an non-image portion and color-fading by light, at a dye image portion are very largely caused as compared with those in the case of yellow couplers or cyan couplers, to often raise problems.

The coupler widely used for formation of magenta dye includes, for example, 1,2-pyrazol-5-on type couplers. It has been a serious problem that the magenta couplers of 1,2-pyrazol-5-on type have a secondary absorption at the vicinity of 430 nm in addition to a primary absorption at the vicinity of 550 nm, and therefore various studies have been made to solve such a problem.

A magenta coupler having an anilino group at the 3-position of the 1,2-pyrazol-5-on type coupler, which is small in the above-mentioned secondary absorption, is useful for obtaining, in particular, a color image for printing. This art is disclosed, for example, in U.S. Pat. No. 2,343,703, British Patent No. 1,059,994, etc.

However, the above magenta couplers have a disadvantage that they are extremely poor in the image stability, in particular, the fastness to light of dye images, to suffer from Y-stain at a non-image portion.

As a means for decreasing the secondary absorption at the vicinity of 430 nm of the above magenta coupler, there have been proposed magenta couplers including, for example, pyrazolobenzimidazoles disclosed in British Patent No. 1,047,612, indazolones disclosed in U.S. Pat. No. 3,770,447, and pyrazolotriazoles disclosed in U.S. Pat. No. 3,725,067, British Patent Nos. 1,252,418 and 1,334,515, Japanese Unexamined Patent Publications No. 162548/1984 and No. 171956/1984, etc. The dyes formed through these couplers shows extremely smaller secondary absorption at the vicinity of 430 nm than the dyes formed through the 1,2-pyrazol-5-on type coupler do, and thus, they are desirable from the viewpoint of the color reproducibility, and also they are advantageous in that they are desirably very little liable to generation of Y-stain at a non-image portion against light, heat and humidity.

However, in general, the azomethine dye to be formed through the magenta couplers of pyrazolotriazole type have very low fastness to light to seriously damage the performances of a color photographic material, in particular, a color photographic material for print, and therefore have not put into practical use in color photographic materials for print.

Japanese Unexamined Patent Publication also proposes a technique for improving the fastness to light of a magenta dye image obtained from 1H-pyrazolo-[3,2-C]-s-triazole type magenta coupler by using 1H-pyrazolo-[3,2-C]-s-triazole type magenta coupler in combination with a phenol type compound or a phenol ether type compound. However, even in the above technique, some are not only insufficient for preventing the color-fading of the above magenta dye image against light, but also accelerate the color-fading by light on the contrary.

In short, there has not been found any means for sufficiently improving the fastness to light when the above pyrazolotriazole type magenta couplers are used, and an improvement has been earnestly sought after.

SUMMARY OF THE INVENTION

This invention has been made taking account of the above problems, and an object of this invention is to provide a light-sensitive silver halide photographic material having excellent color reproducibility, improved magenta dye image-fastness against light, and improved resistance against generation of color fog.

A second object of this invention is to provide a method of achieving great fastness to light in a magenta dye image excellent in the color reproducibility.

As a result of intensive studies, the present inventors have found that the above objects can be achieved by a light-sensitive silver halide photographic material having at least one silver halide emulsion layer on a support, wherein at least one layer of said silver halide emulsion layer contains a magenta coupler represented by General Formula (I) shown below and an anti-color-fading agent having an oxidation potential Eox being 0.95 (V) $\leqq$ Eox $\leqq$ 1.50 (V), and said layer further contains a hydroquinone derivative in an amount ranging between $1\times10^{-3}$ and $1\times10^{-1}$ per 1 mole of said magenta coupler.

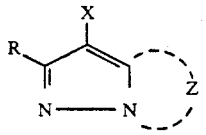

General Formula (I)

wherein Z represents a group of nonmetal atoms necessary for formation of a nitrogen-containing heterocyclic ring; said ring formed by Z may have a substituent; X represents a hydrogen atom or a substituent eliminable through the reaction with an oxidized product of a color developing agent; and R represents a hydrogen atom or a substituent.

DETAILED DESCRIPTION OF THE INVENTION

This invention will be described below in detail.

In the magenta coupler according to this invention, represented by General Formula (I);

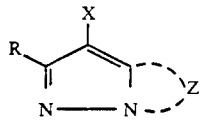

General Formula (I)

Z represents a group of nonmetal atoms necessary for formation of a nitrogen-containing heterocyclic ring; said ring formed by Z may have a substituent.

X represents a hydrogen atom or a substituent eliminable through the reaction with an oxidized product of a color developing agent.

And, R represents a hydrogen atom or a substituent.

The substituent represented by the above R may include, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The halogen atom may include, for example, a chlorine atom and a bromine atom. Particularly preferred is a chlorine atom.

The alkyl group represented by R may preferably be those having 1 to 32 carbon atoms; the alkenyl group and the alkynyl group, each having 2 to 32 carbon atoms; the cycloalkyl group and the cycloalkenyl group, each having 3 to 12 carbon atoms, particularly 5 to 7 carbon atoms. The alkyl group, the alkenyl group and the alkynyl group each may be of straight chain structure or branched structure.

Also, these alkyl group, alkenyl group, alkynyl group, cycloalkyl group and cycloalkenyl group each may have a substituent including, for example, an aryl, a cyano, a halogen atom, a heterocyclic ring, a cycloalkyl, a cycloalkenyl, a spiro compound residual group, a bridged hydrocarbon compound residual group, and besides these, those which are substituted through a carbonyl group such as an acyl, a carboxyl, a carbamoyl, an alkoxycarbonyl and an aryloxycarbonyl, and those which are substituted through a hetero atom {specifically, those which are substituted through an oxygen atom such as a hydroxyl, an alkoxy, an aryloxy, a heterocyclic oxy, a siloxy, an acyloxy and a carbamoyloxy, those which are substituted through a nitrogen atom such as a nitro, an amino (including a dialkylamino, etc.), a sulfamoylamino, an alkoxycarbonylamino, an aryloxycarbonylamino, an acylamino, a sulfonamide, an imide and a ureido, those which are substituted through a sulfur atom such as an alkylthio, an arylthio, a heterocyclic thio, a sulfonyl, a sulfinyl and a sulfamoyl and those which are substituted through a phosphorus atom such as a phosphonyl, etc}.

More specifically, they include, for example, a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a tri-fluoromethyl group, a 1-ethoxytridecyl group, a 1-methoxyisopropyl group, an ethyl methanesulfonyl group, a methyl 2,4-di-t-amylfenoxy group, an anilino group, a 1-phenylisopropyl group, a 3-m-butanesulfonaminophenoxypropyl group, a 3-4'-{α-[4''(p-hydroxybenzenesulfonyl)phenoxy]-dodecanoylamino}phenylpropyl group, a 3-{4'-[α-(2'',4''-di-t-amylphenoxy)butanamide]phenyl}propyl group, a 4-[α-(o-chlorophenoxy)tetradecanamidophnoxy]propyl group, an allyl group, a cyclopentyl group, a cyclohexyl group, etc.

The aryl group represented by R is preferably a phenyl group, and may have a substituent (for example, an alkyl group, an alkoxy group, an acylamino group, etc.).

More specifically, it may include a phenyl group, a 4-t-butylphenyl group, a 2,4-di-t-amylphenyl group, a 4-tetradecanamidophenyl group, a hexadicyloxyphenyl group, a 4'-[α-(4''-t-butylphenoxy)tetradecanamido)-phenyl group, etc.

The heterocyclic group represented by R is preferably one having 5- to 7-members, which may be substituted or condensated. More specifically, it may include a 2-furyl group, a 2-thienyl group, a 2-pyrimidinyl group, a 2-benzothiazolyl group, etc.

The acyl group represented by R may include, for example, alkylcarbonyl groups such as an acetyl group, a phenyl acetyl group, a dodecanoyl group and an α-2,4-di-t-amylphenoxybutanoyl group; arylcarbonyl groups such as a benzoyl group, a 3-pentadecyloxybenzoyl group and a p-chlorobenzoyl group; etc.

The sulfonyl group represented by R may include alkylsulfonyl groups such as a methylsulfonyl group and a dodecylsulfonyl group; arylsufonyl groups such as a benzenesulfonyl group and a p-toluenesulfonyl group; etc.

The sulfinyl group represented by R may include alkylsulfinyl groups such as an ethylsulfinyl group, an octylsulfinyl group and a 3-phenoxybutylsulfinyl group; arylsulfinyl groups such as a phenylsulfinyl group, a m-pentadecylphenylsulfinyl group; etc.

The phosphonyl group represented by R may include alkylsulfonyl groups such as a butyloctylphosphonyl group, alkoxyphosphonyl groups such as an octyloxyphosphonyl group, aryloxyphosphonyl groups such as a phenoxyphosphonyl group, arylphosphonyl groups such as a phenylphosphonyl group, etc.

The carbamoyl group represented by R may be substituted with an alkyl group, an aryl group (preferably, a phenyl group), etc., and may include, for example, an N-methylcarbamoyl group, an N,N-dibutylcarbamoyl group, an N-(ethyl 2-pentadecyloctyl)carbamoyl group, an N-ethyl-N-dodecylcarbamoyl group, an N-{3-(2,4-di-t-amylphenoxy)propyl}carbamoyl group, etc.

The sulfamoyl group represented by R may be substituted with an alkyl group, an aryl group (preferably a phenyl group), etc., and may include, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group, etc.

The spiro compound residual group represented by R may include, for example, spiro[3.3]heptan-1-yl, etc.

The bridged hydrocarbon compound residual group may include, for example, bicyclo[2.2.1]heptan-1-yl, tricyclo[3.3.1.1$^{3,7}$]decan-1-yl, 7,7-dimethyl-dibicyclo[2.2.1]heptan-1-yl, etc.

The alkoxy group represented by R may be further substituted with those mentioned as the substituents for the above alkyl group, and may include, for example, a methoxy group, a propoxy group, a 2-ethoxyethoxy group, a pentadecyloxy group, a 2-dodecyloxyethoxy group, a phenethyloxyethoxy group, etc.

The aryloxy group represented by R is preferably a phenyloxy, wherein the aryl nucleus may be further substituted with those mentioned as the substituents for the above aryl group, and may include, for example, a phenoxy group, a p-t-butylpohenoxy group, a m-pentadecylphenoxy group, etc.

The heterocyclic oxy group represented by R is preferably one having 5- to 7-members, wherein the heterocyclic ring may further have a substituent, and may include, for example, a 3,4,5,6-tetrahydropyranyl-2-oxy group, a 1-phenyltetrazole-5-oxy group, etc.

The siloxy group represented by R may further be substituted with an alkyl group, etc., and may include, for example, a trimethylsiloxy group, a triethylsiloxy group, a dimethylbutylsiloxy group, etc.

The acyloxy group represented by R may include, for example, an alkylcarbonyloxy group, an arylcarbonyloxy group, etc., and may further have a substituent to include, specifically, an acetyloxy group, an α-chloroacetyloxy group, a benzoyloxy group, etc.

The carbamoyloxy group represented by R may be substituted with an alkyl group, an aryl group, etc., and may include, for example, an N-ethylcarbamoyloxy group, an N,N-diethylcarbamoyloxy group, an N-phenylcarbamoyloxy group, etc.

The amino group represented by R may be substituted with an alkyl group, an aryl group (preferably, a phenyl group), and may include, for example, an ethylamino group, an anilino group, a m-chloroanilino group, a 3-pentadecyloxycarbonylanilino group, a 2-chloro-5-hexadecanamidoanilino group, etc.

The acylamino group represented by R may include an alkylcarbonylamino group, an arylcarbonylamino group (preferably, a phenylcarbonylamino group), etc., and may further have a substituent to include, specifically, an acetoamide group, an α-ethylpropaneamide group, an N-phenylacetoamide group, a dodecanamide group, a 2,4-di-t-amylphenoxyacetoamide group, an α-3-t-butyl-4-hydroxyphenoxybutaneamide group, etc.

The sulfonamide group represented by R may include an alkylsulfonylamino group, an arylsulfonylamino group, and may further have a substituent. It specifically may include, a methylsulfonylamino group, a pentadecylsulfonylamino group, a benzenesulfonamide group, a p-toluensulfonamide, a 2-methoxy-5-t-amylbenzensulfonamide group, etc.

The imide group represented by R may be of open chain structure or cyclic structure, or may have a substituent to include, for example, a succinimide group, a 3-heptadecylsuccinimide, a phthalimide group, a glutalimide group, etc.

The ureido group represented by R may be substituted with an alkyl group, an aryl group (preferably, a phenyl group), etc., and may include, for example, an N-ethylureido group, an N-ethyl-N-decylureido group, an N-phenylureido group, an N-p-tolylureido group, etc.

The sulfamoylamino group represented by R may be substituted with an alkyl group or an aryl group (preferably, a phenyl group), etc., and may include, for example, an N,N-dibutylsulfamoylamino group, an N-methylsulfamoylamino group, an N-phenylsulfamoylamino group, etc.

The alkoxycarbonylamino group represented by R may further have a substituent, and may include, for example, a methoxycarbonylamino group, a methoxyethoxycarbonylamino group, an octadecyloxycarbonylamino group, etc.

The aryloxycarbonylamino group represented by R may have a substituent, and may include, for example, a phenoxycarbonylamino group, a 4-methylphenoxycarbonylamino group, etc.

The alkoxycarbonyl group represented by R may further have a substituent, and may include, for example, a methoxycarbonyl group, a butyloxycarbonyl group, a dodecyloxycarbonyl group, an octadecyloxycarbonyl group, an ethoxymethoxycarbonyloxy group, a benzyloxycarbonyl group, etc.

The aryloxycarbonyl group represented by R may further have a substituent, and may include, for example, a phenoxycarbonyl group, a p-chlorophenoxycarbonyl group, an m-pentadecyloxyphenoxycarbonyl group, etc.

The alkylthio group represented by R may further have a substituent, and may include, for example, an ethylthio group, a dodecylthio group, an octadecylthio group, a phenethylthio group, a 3-phenoxypropylthio group, etc.

The arylthio group represented by R is preferably a phenylthio group which may further have a substituent, and may include, for example, a phenylthio group, a p-methoxyphenylthio group, a 2-t-octylphenylthio group, a 3-octadecylphenylthio group, a 2-carboxyphenylthio group, a p-acetoaminophenylthio group, etc.

The heterocyclic thio group represented by R is preferably a heterocyclic thio group of 5 to 7 members, and may further have a condensed ring or may have a substituent. It may include, for example, a 2-pyridylthio group, a 2-benzothiazolythio group, a 2,4-diphenoxy-1,3,5-triazole-6-thio group, etc.

The substituent represented by X, which is eliminable through the reaction with an oxidized product of a color developing agent, may include, for example, a halogen atom (such as a chlorine atom, a bromine atom and a fluorine atom), and also groups which are substituted through a carbon atom, an oxygen atom, a sulfur atom or a nitrogen atom.

The groups which are substituted through a carbon atom may include a carboxyl group, and also, for example, a group represented by the general formula:

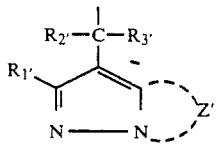

wherein R' is same as defined for the above R, Z' is same as defined for the above Z; and $R^{2'}$ and $R^{3'}$ each represent a hydrogen atom, an aryl group, an alkyl group or a heterocyclic group, a hydroxymethyl group and a triphenylmethyl group.

The groups which are substituted through an oxygen atom may include, for example, an alkoxy group, aryloxy group, heterocyclic oxy group, an acyloxy group, a sulfonyloxy group, an alkoxycarbonyloxy group, an aryloxycarbonyloxy group, an alkyloxaryloxy group, an alkoxyoxaryloxy group, etc.

The above alkoxy group may further have a substituent including, for example, an ethoxy group, a 2-phenoxyethoxy group, 2-cyanoethoxy group, a phenethyloxy group, a p-chlorobenzyloxy group, etc.

The above aryloxy group is preferably a phenoxy group, and the aryl group may further have a substituent. More specifically, it may include a phenoxy group, a 3-methylphenoxy group, a 3-dodecylphenoxy group, a 4-methanesulfonamidephenoxy group, a 4-[α-(3'-pentadecylphenoxy)butanamido]phenoxy group, a hexadecylcarbamoylmethoxy group, a 4-cyanophenoxy group, a 4-methanesulfonylphenoxy group, a 1-naphthyloxy group, a p-methoxyphenoxy group, etc.

The above heterocyclic oxy group is preferably a heterocyclic oxy group of 5 to 7 members, or may be of condensed ring, or may have a substituent. Specifically, it may include a 1-phenyltetrazolyloxy group, a 2-benzothiazolyloxy group, etc.

The above acyloxy group may include, for example, alkylcarbonyloxy groups such as an acetoxy group and butanoloxy group, and alkenylcarbonyloxy groups such as a cinnamoyloxy group, and arylcarbonyloxy groups such as a benzoyloxy group.

The above sulfonyloxy group may include, for example, a butanesulfonyloxy group and methanesulfonyloxy group.

The above alkoxycarbonyloxy group may include, for example, an ethoxycarbonyloxy group and a benzyloxycarbonyoxy group.

The above aryloxycarbonyloxy group may include a phenoxycarbonyloxy group, etc.

The above alkyloxalyloxy group may include, for example, a methyloxalyloxy group.

The above alkoxyoxalyloxy group may include an ethoxyoxalyloxy group, etc.

The group which is substituted through a sulfur atom may include, for example, an alkylthio group, an arylthio group, a heterocyclic thio group and an alkyloxythiocarbonylthio group.

The above alkylthio group may include a butylthio group, a 2-cyanoethylthio group, a phenethylthio group, a benzylthio group, etc.

The above arylthio group may include a phenylthio group, a 4-methanesulfonamidephenylthio group, a 4-dodecylphenethylthio group, a 4-nonafluoropentanamidephenythylthio group, a 4-carboxyphenylthio group, a 2-ethoxy-5-t-butylphenylthio group, etc.

The above heterocyclic thio group may include, for example, a 1-phenyl-1,2,3,4-tetrazolyl-5-thio group, a 2-benzothiazolylthio group, etc.

The above alkyloxythiocarbonylthio group may include a dodecyloxythiocarbonylthio group, etc.

The group which is substituted through a nitrogen atom may include, for example, a group represented by the general formula:

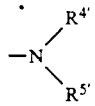

In this formula, $R^{4'}$ and $R^{5'}$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group, and $R^{4'}$ and $R^{5'}$ may be bonded to each other to form a heterocyclic ring, provided that $R^{4'}$ and $R^{5'}$ each are not a hydrogen atom at the same time.

The above alkyl group may be of straight chain or branched one, and is preferably one having 1 to 22 carbon atoms. Also, this alkyl group may have a substituent which may include, for example, an aryl group, an alkoxy group, an aryloxy group, an alkylthio group, an arylthio group, an alkylamino group, arylamino group, an acylamino group, a sulfonamide group, an imino group, an acyl group, an alkylsulfonyl group, an arylsulfonyl group, a carbamoyl group, a sulfamoyl group, an alkoxycarbonyl group, an alkyloxycarbonylamino group, an aryoxycarbonylamino group, a hydroxyl group, a carboxyl group, a cyano group and a halogen atom. The alkyl group may specifically include, for example, an ethyl group, an octyl group, a 2-ethylhexyl group and 2-chloroethyl group.

The aryl group represented by $R^{4'}$ or $R^{5'}$ is preferably one having 6 to 32 carbon atoms, in particular, a phenyl group and a naphthyl group, wherein the aryl group may have a substituent which may include those mentioned as the substituents for the alkyl group represented by the above $R^{4'}$ or $R^{5'}$. This aryl group may specifically include, for example, a phenyl group, a 1-naphthyl group and a 4-methylsulfonylphenyl group.

The heterocyclic group represented by $R^{4'}$ or $R^{5'}$ is preferably of 5 to 6 members, or may be of condensed ring, or may have a substituent. Specifically, it may include a 2-furyl group, a 2-quinolyl group, a 2-pyrimidyl group, a 2-benzothiazolyl group, a 2-pyridyl group, etc.

The sulfamoyl group represented by $R^{4'}$ or $R^{5'}$ may include an N-alkylsulfamoyl group, an N,N-dialkylsulfamoyl group, N-arylsulfamoyl group, an N,N-diarylsufamoyl group, etc., and the alkyl group and the aryl group of these may have the substituent mentioned for the above alkyl group and aryl group. The sulfamoyl group may specifically include, for example, an N,N-diehtylsulfamoyl group, an N-methylsulfamoyl group, N-dodecylsulfamoyl group and an N-p-tolylsulfamoyl group.

The carbamoyl group represented by $R^{4'}$ or $R^{5'}$ may include an N-alkylcarbamoyl group, an N,N-dialkylcarbamoyl group, an N-arylcarbamoyl group, an N,N-diarylcarbamoyl group, etc., and the alkyl group and the aryl group of these may have the substituent mentioned for the above alkyl group and aryl group. The carbamoyl group may specifically include, for example, an N,N-diethylcarbamoyl group, an N-methylcarbamoyl group, an N-dodecylcarbamoyl group, N-p-cyanophenylcarbamoyl group and N-p-tolylcarbamoyl group.

The acyl group represented by $R^{4'}$ or $R^{5'}$ may include, for example, an alkylcarbonyl group, an arylcarbonyl group and a heterocyclic carbonyl group, and the alkyl group, the aryl group and the heterocyclic group each may have a substituent. The acyl group may specifically include, for example, a hexafluorobutanoyl group, 2,3,4,5,6-pentafluorobenzoyl group, an acety group, a benzoyl group, a naphthoel group, a 2-furylcarbonyl group, etc.

The sulfonyl group represented by $R^{4'}$ or $R^{5'}$ may include an alkylsulfonyl group, an arylsulfonyl group and a heterocyclic sulfonyl group, and may have a substituent. Specifically, it may include, for example, an ethanesulfonyl group, a benzenesulfonyl group, an octanesulfonyl group, a naphthalenesulfonyl group, a p-chlorobenzenesulfonyl group, etc.

The aryloxycarbonyl group represented by $R^{4'}$ or $R^{5'}$ may have as a substituent those mentioned for the above aryl group. Specifically, it may include a phenoxycarbonyl group, etc.

The alkoxycarbonyl group represented by $R^{4'}$ or $R^{5'}$ may have the substituent mentioned for the above alkyl group, and specifically may include a methoxycarbonyl group, a dodecyloxycarbonyl group, a benzyloxycarbonyl group, etc.

The heterocyclic ring to be formed by bonding of $R^{4'}$ and $R^{5'}$ is preferably of 5 to 6 members, and may be saturated or unsaturated, may be aromatic or non-aromatic, or may be of a condensed ring. This heterocyclic ring may include, for example, an N-phthalimide group, an N-succinimide group, a 4-N-urazolyl group, a 1-N-hydantoinyl group, 3-N-2,4-dioxooxazolydinyl group, a 2-N-1,1-dioxo-3-(2H)-oxo-1,2-benzthiazolyl group, a 1-pyrolyl group, a 1-pyrolidinyl group, a 1-pyrazolyl group, a 1-pyrazolydinyl group, a 1-pipelidinyl group, a 1-pyrolinyl group, a 1-imidazolyl group, a 1-imidazolinyl group, a 1-indolyl group, 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrrolidone group, a phthaladione group, a 2-oxo-1-piperidinyl group, etc., and these heterocyclic groups each may be substituted with an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, a ureido group, an alkoxycarbonyl group, an aryloxycarbonyl group, an imide group, a nitro group, a cyano group, a carboxyl group, a halogen atom, etc.

The nitrogen-containing heterocyclic ring to be formed by Z or Z' may include a pyrazole ring, an imidazole ring, a triazole ring, a tetrazole ring, etc., and the substituent which the above rings each may have include those mentioned for the above R.

When the substituents (for example, R, $R^1$ to $R^6$) on the heterocyclic rings in General Formula (I) and General Formulas (II) to (VIII) shown hereinbelow have a moiety of:

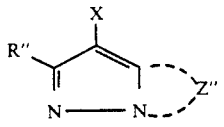

wherein R'', X and Z'' each have the same meaning as R, X, and Z in General Formula (I), a so-called bis-body type coupler is formed, which may be included in this invention as a matter of course. Also, on the rings formed by Z, Z', Z'' and the later-mentioned $Z^1$, other rings (for example, a cycloalkene of 5 to 7 members) may be further condensed. For instance, in General Formula (V), $R^5$ and $R^6$ may be, and, in General Formula (VI), $R^7$ and $R^8$ may be bonded to each other to form a ring (for example, a 5- to 7- membered cycloalkene, benzene).

The coupler represented by General Formula (I) may, more specifically, be represented, for example, by General Formulas (II) to (VII) shown below:

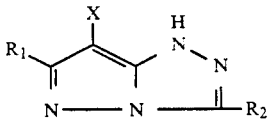

General Formula (II)

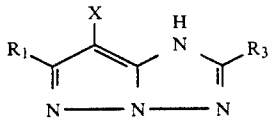

General Formula (III)

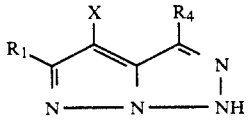

General Formula (IV)

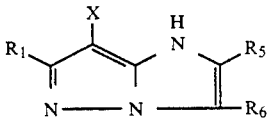

General Formula (V)

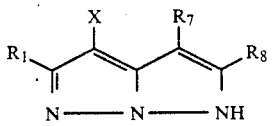

General Formula (VI)

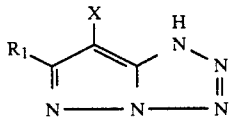

General Formula (VII)

In the above General Formulas (II) to (VII), $R^1$ to $R^8$ and X each have the same meaning as R and X mentioned before.

Also, what is most preferable in General Formula (I) is one represented by General Formula (VIII) shown below:

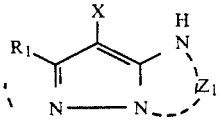

General Formula (VIII)

wherein $R^1$, X and $Z^1$ each have the same meaning as R, X and Z in General Formula (I).

Of the magenta couplers represented by the above General Formulas (II) to (VII), particularly preferred is the magenta coupler represented by General Formula (II).

As for the substituents on the heterocyclic rings in General Formula (I) to (VIII), it is preferable for R, in the case of General Formula (I), and for $R^1$, in the cases of General Formulas (II) to (VIII), to each satisfy the condition 1 shown below, and it is further preferable to satisfy the conditions 1 and 2 shown below, and it is particularly preferable to satisfy the conditions 1, 2 and 3 shown below:

Condition 1: A root atom directly bonded to the heterocyclic ring is a carbon atom.

Condition 2: Only one hydrogen atom is bonded to the above carbon atom, or not bonded thereto at all.

Condition 3: All of the bonds between the carbon atom and atoms adjoining thereto are in single bonding.

Substituents most preferable as the substituents R and $R^1$ in the above heterocyclic rings include those represented by General Formula (IX) shown below:

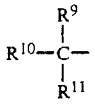

General Formula (IX)

In the above formula, $R^9$, $R^{10}$ and $R^{11}$ each represent a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclic thio group; and at least two of $R^9$, $R^{10}$ and $R^{11}$ are not hydrogen atoms.

Two substituents in the above $R^9$, $R^{10}$ and $R^{11}$, for example, $R^9$ and $R^{10}$, may be bonded to form a saturated or unsaturated ring (for example, a cycloalkane, a cycloalkene, a heterocyclic ring), or $R^{11}$ may be further bonded to this ring to form a residue of a bridged hydrocarbon compound.

The groups represented by $R^9$ to $R^{11}$ may have a substituent, and examples of the groups represented by $R^9$ to $R^{11}$ and the substituents these groups may have, may include the specific examples and the substituents mentioned for the group represented by R in General Formula (I).

Also, examples of the ring to be formed by bonding, for instance, of $R^9$ and $R^{10}$ and the residue of bridged hydrocarbon compound to be formed by $R^9$ to $R^{11}$, and also the substituents which this ring may have, may include the specific examples and the substituents mentioned for the cycloalkyl, the cycloalkenyl and the residue of heterocyclic bridged hydrocarbon compound which are represented by R in the above General Formula (I).

In General Formula (X), preferable are;

(i) the case where two of $R^9$ to $R^{11}$ are each an alkyl group; and (ii) the case where one of $R^9$ to $R^{11}$, for example, $R^{11}$ is a hydrogen atom, and the other two, $R^9$ and $R^{10}$ are bonded to form a cycloalkyl together with the carbon atoms at the root.

Further preferable in the case (i) is the case where two of $R^9$ to $R^{11}$ are each an alkyl group, and the other one is a hydrogen atom or an alkyl group.

Here, the alkyl and the cycloalkyl each may further have a substituent, and examples of the alkyl, the cycloalkyl and the substituents of these may include those for the alkyl, the cycloalkyl and the substituents of these which are represented by R in the above General Formula (I).

The substituents which the ring to be formed by Z in General Formula (I) and the ring to be formed by $Z^1$ in General Formula (VIII) may have, and the substituents $R^2$ to $R^8$ in General Formulas (II) to (VI), are preferably those represented by General Formula (X) shown below:

$$-R^1-SO_2-R^2$$

General Formula (X)

wherein $R^1$ represents an alkylene group, $R^2$ represents an alkyl group, a cycloalkyl group or an aryl group.

The alkylene represented by $R^1$ preferably has 2 or more, and more preferably 3 to 6 carbon atoms at the straight chain portion, and may be of straight chain or branched structure. Also, this alkylene may have a substituent.

Examples of such substituent may include those shown as the substituents which the alkyl group when R in General Formula (I) may have.

Preferable substituents may include a phenyl.

Preferable examples for the alkylene represented by $R^1$ are shown below:

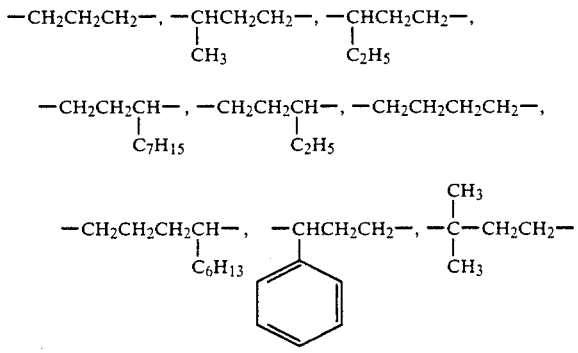

The alkyl group represented by $R^2$ may be of straight chain or branched structure. Specifically, it may include methyl, ethyl, propyl, iso-propyl, butyl, 2-ethylhexyl, octyl, dodecyl, tetradecyl, hexadecyl, octadecyl, 2-hexyldecyl, etc.

The cycloalkyl group represented by $R^2$ is preferably of 5 to 6 members, and may include, for example, a cyclohexyl group.

The alkyl group and the cycloalkyl group represented by $R^2$ may each have a substituent including, for example, those exemplified as the substituents for the above $R^1$.

The aryl group represented by $R^2$ may specifically include a phenyl group and a naphthyl group. The aryl group may have a substituent. Such a substituent may include, for example, a straight chain or branched alkyl group, and besides, those exemplified as the substituents for the above $R^1$.

Also, when there are two or more substituents, they may be the same or different substituents.

Particularly preferable in the compounds represented by General Formula (I) are those represented by General Formula (XI) shown below:

General Formula (XI)

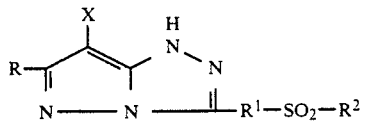

wherein R and X each have the same meaning as R and X in General Formula (I), and $R^1$ and $R^2$ each have the same meaning as $R^1$ and $R^2$ in General Formula (X).

Specifica examples of the compounds used in this invention are shown below:

1

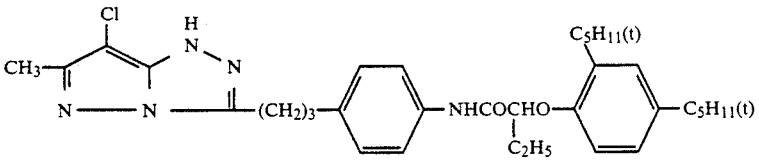

2

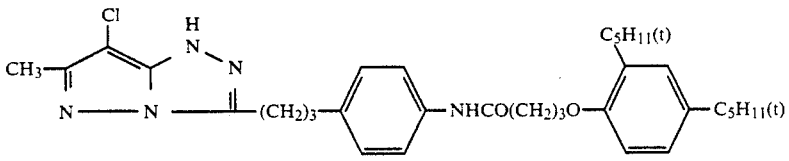

3

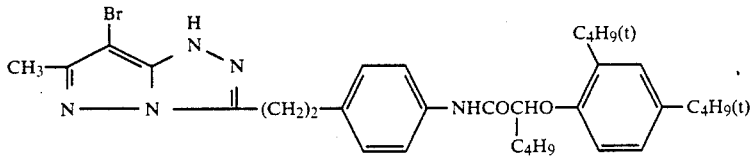

4

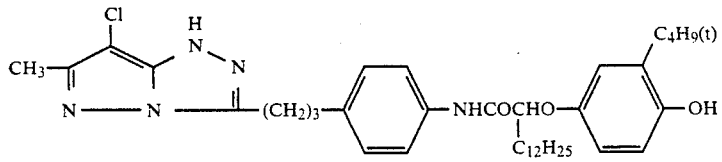

5

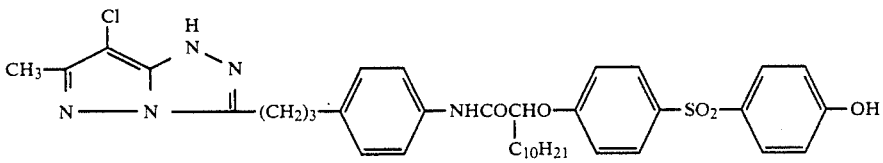

6

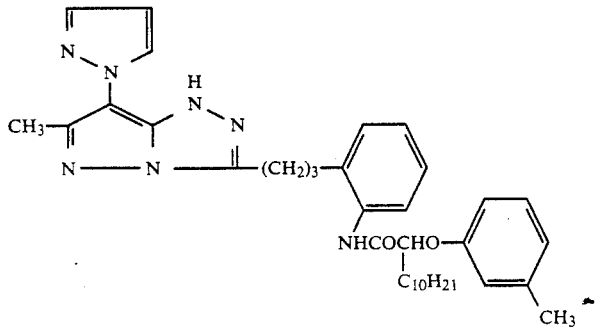

7

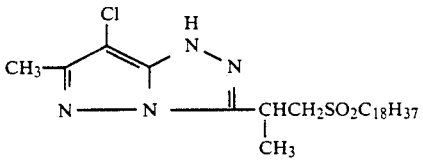

-continued
8
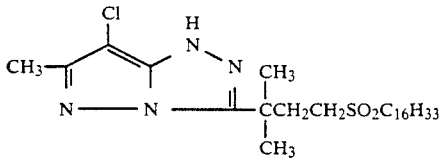
9
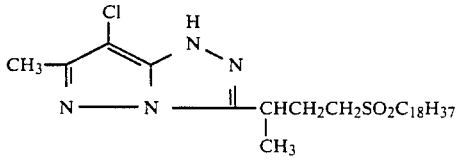
10
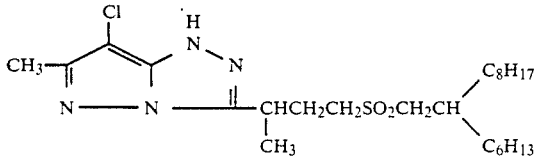
11
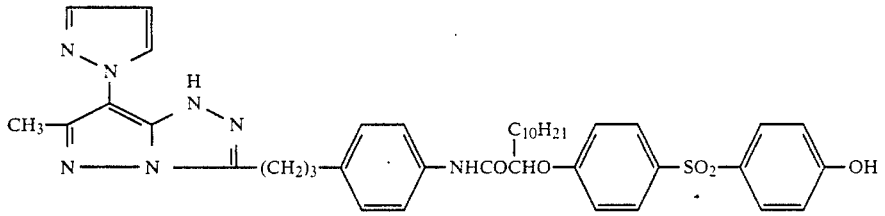
12
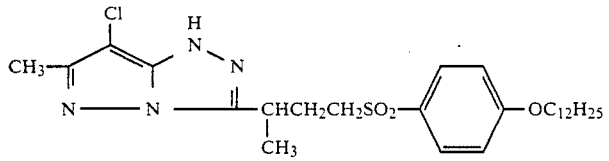
13
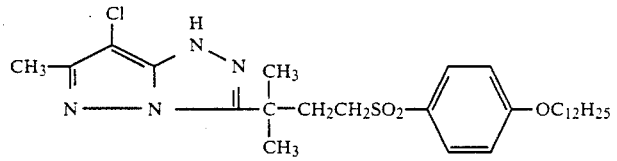
14
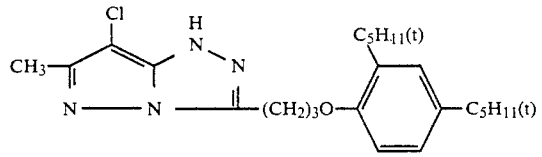
15
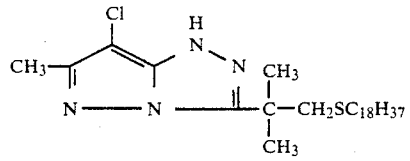
16
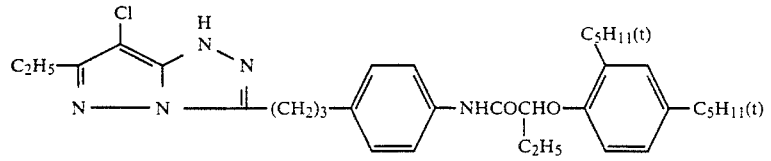

-continued
17
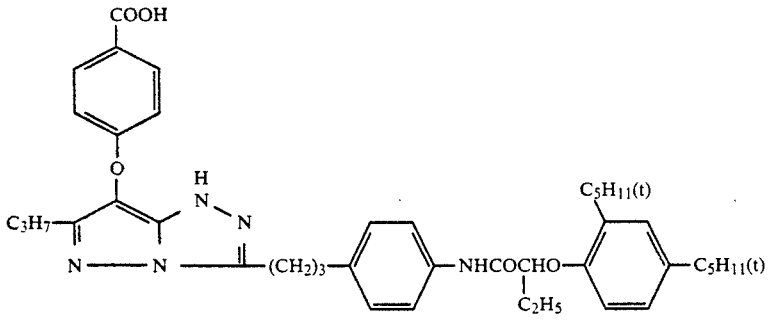
18
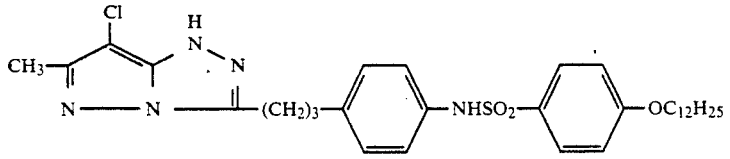
19
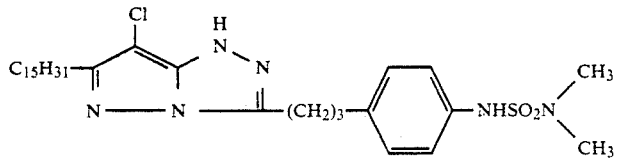
20
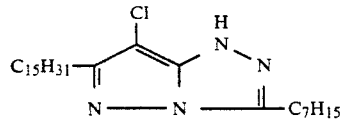
21
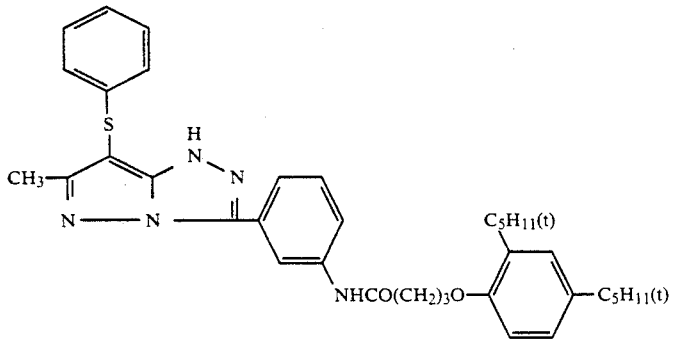
22
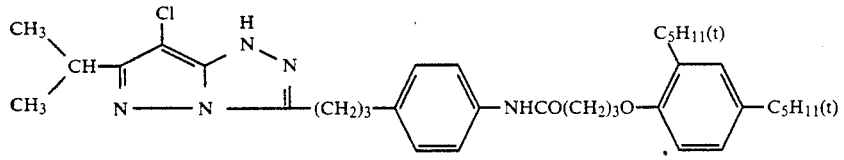
23
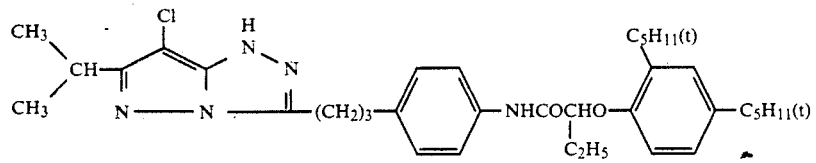
24
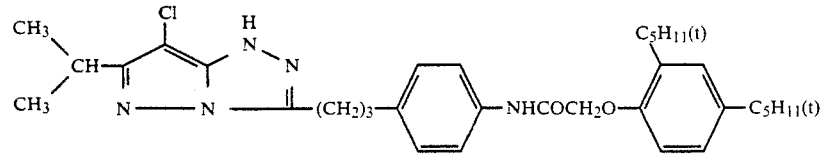

-continued
25
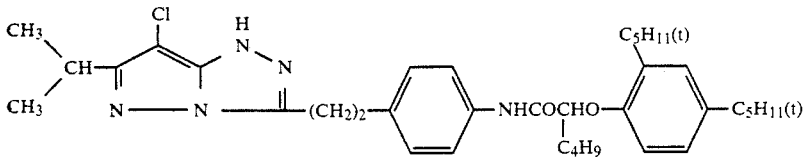
26
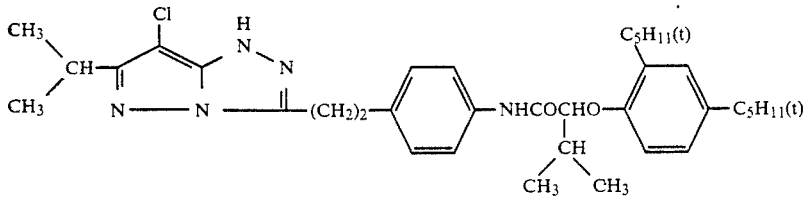
27
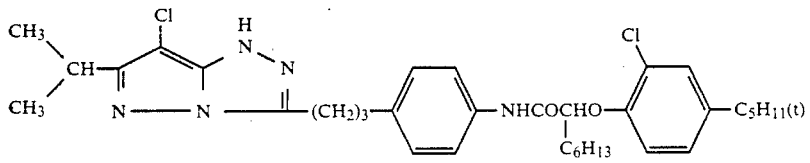
28
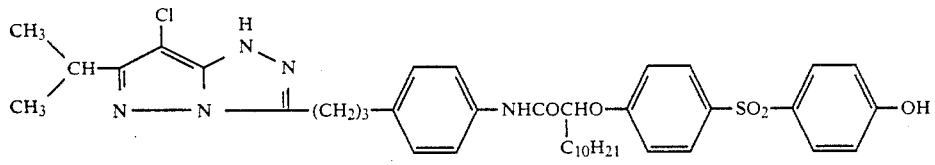
29
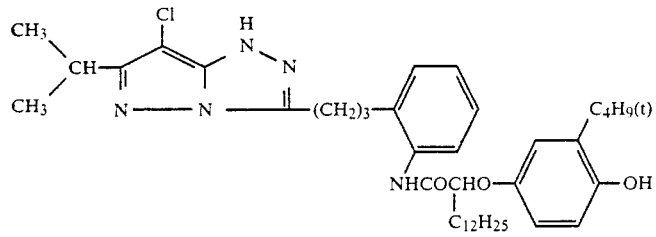
30
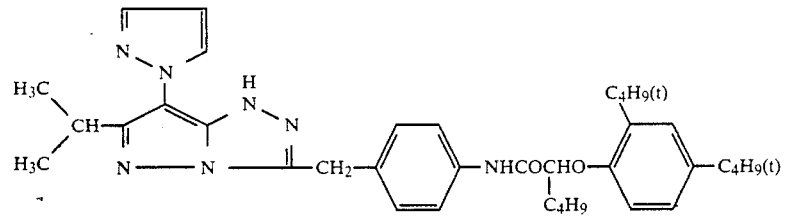
31
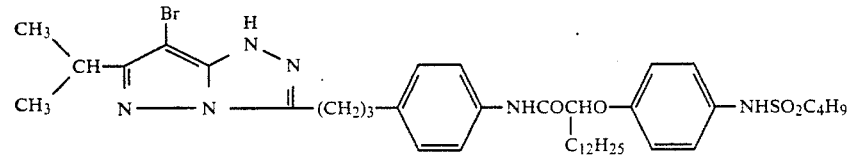
32
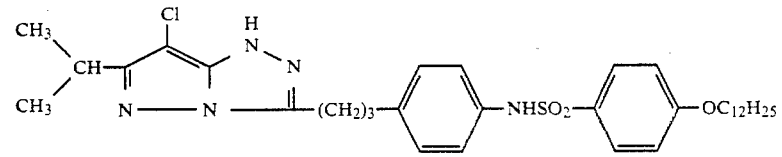
33
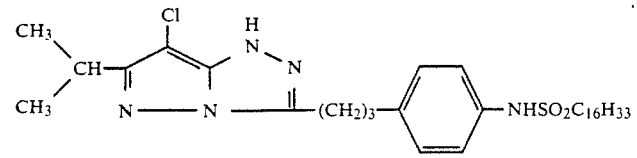

-continued
34
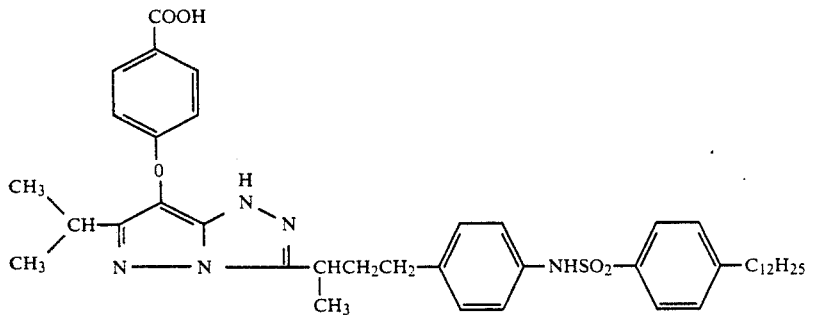
35
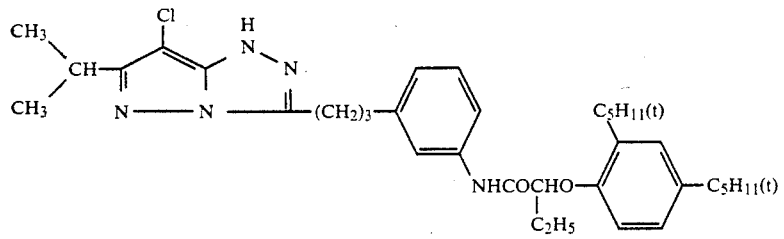
36
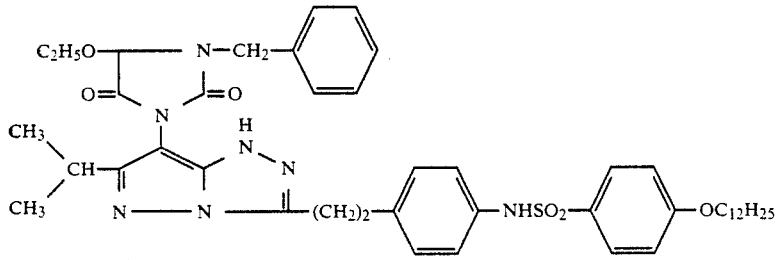
37
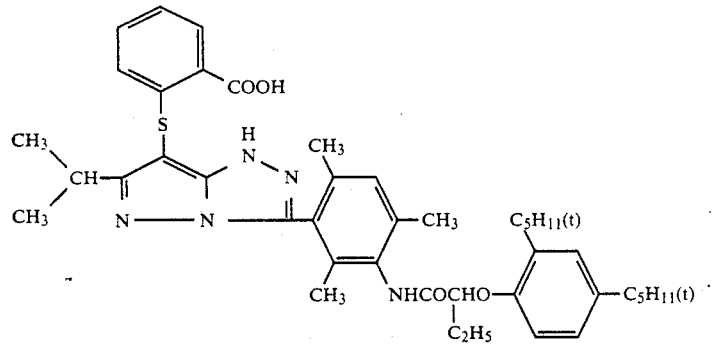
38
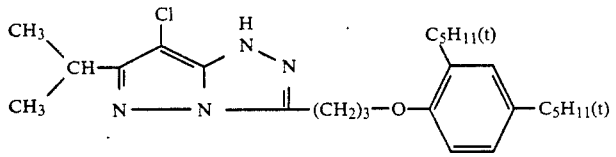
39
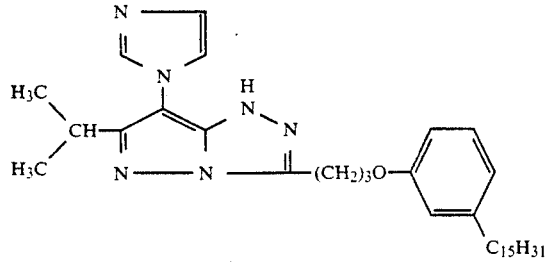

-continued
40
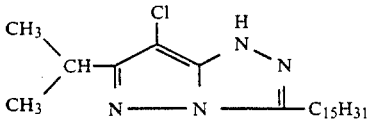
41
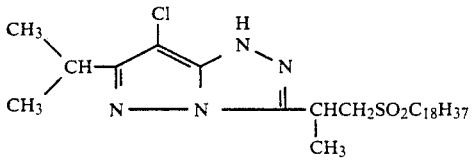
42
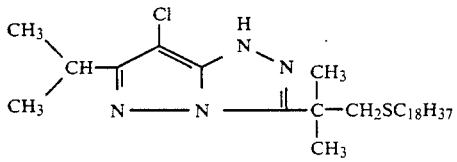
43
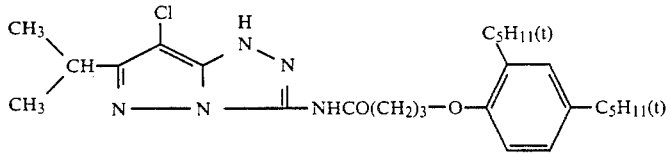
44
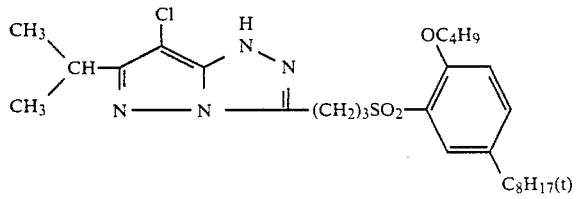
45
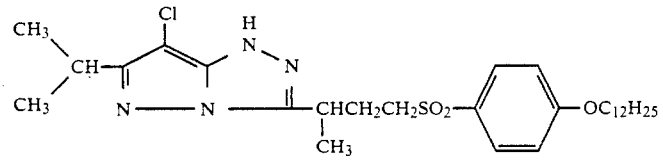
46
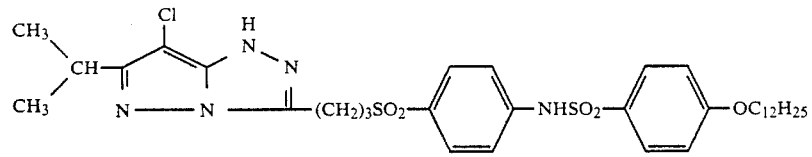
47
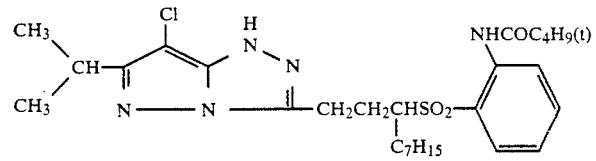
48
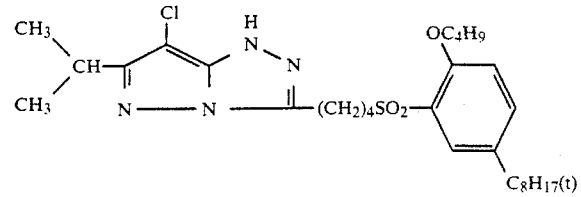

-continued
49
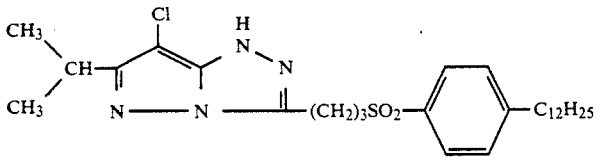
50
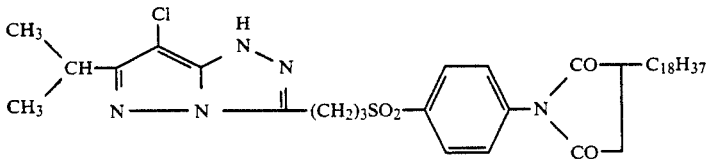
51
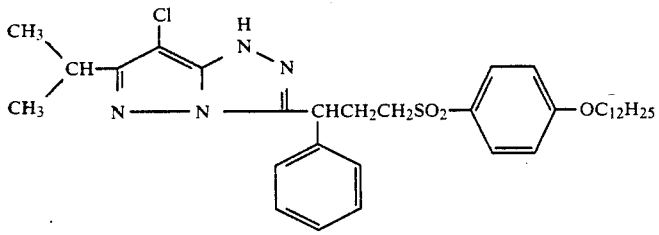
52
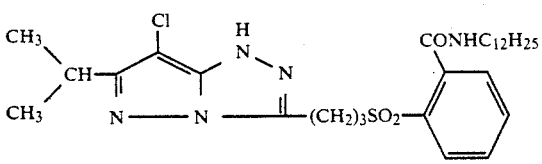
53
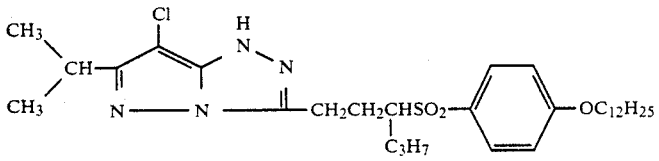
54
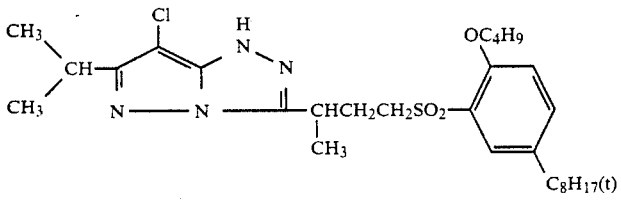
55
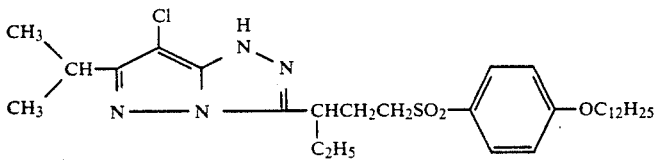
56
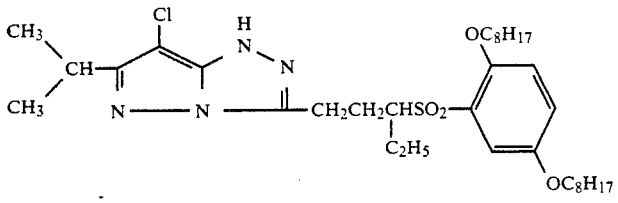
57
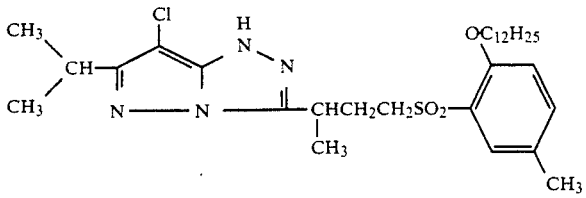

-continued
58
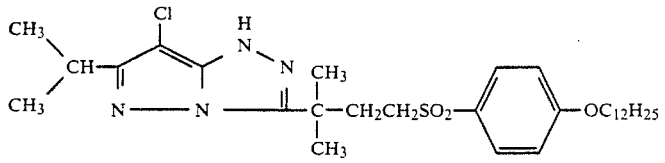
59
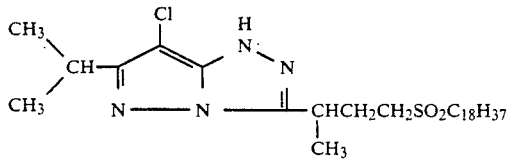
60
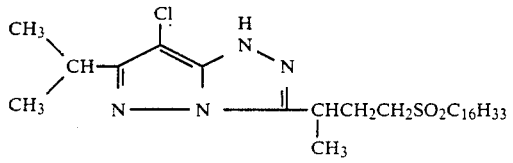
61
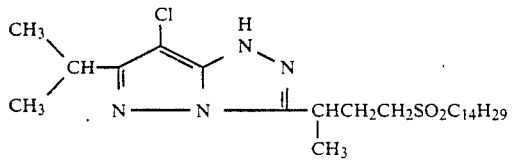
62
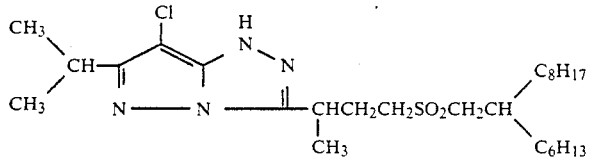
63
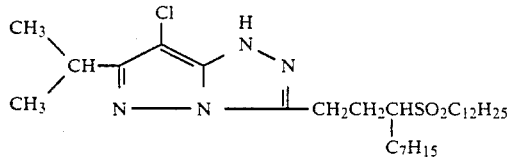
64
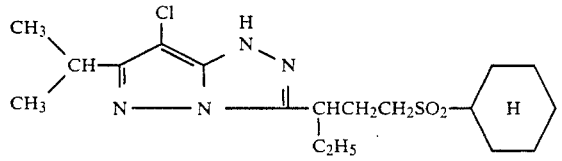
65
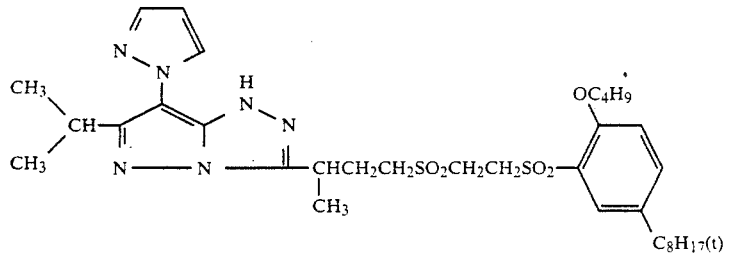
66
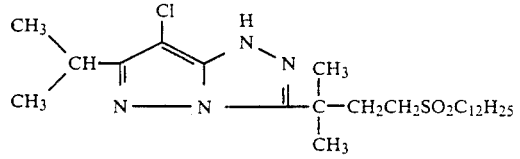

-continued
67
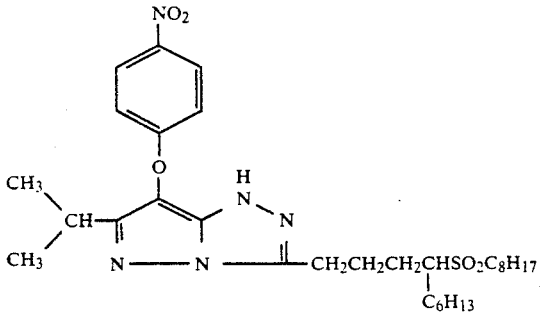
68
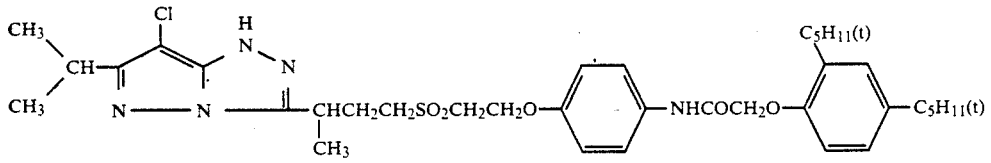
69
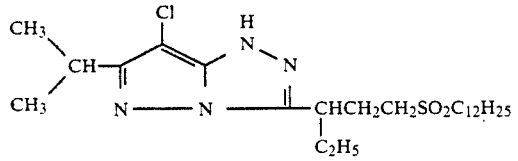
70
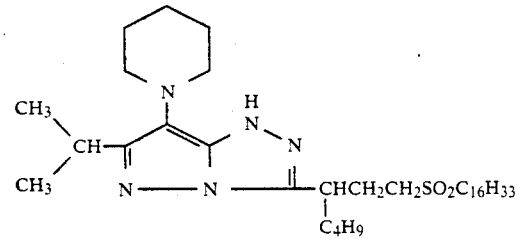
71
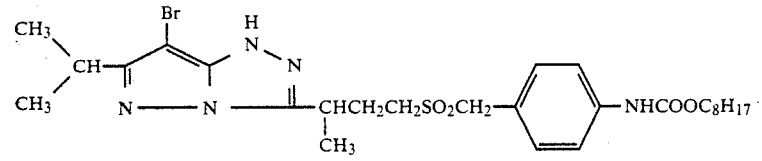
72
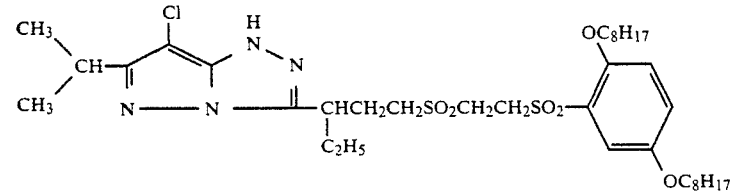
73
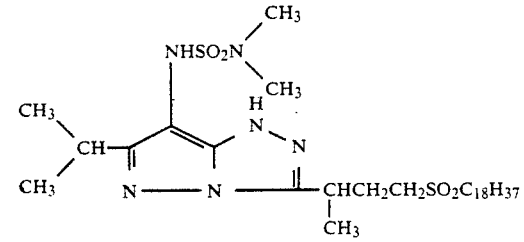
74
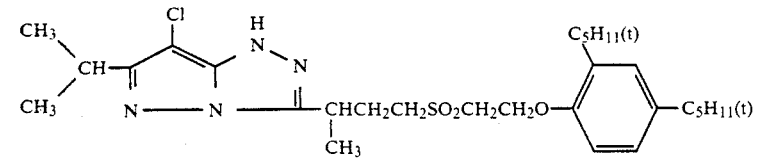

-continued
75
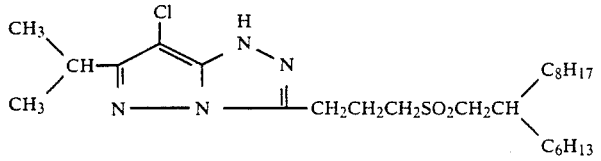
76
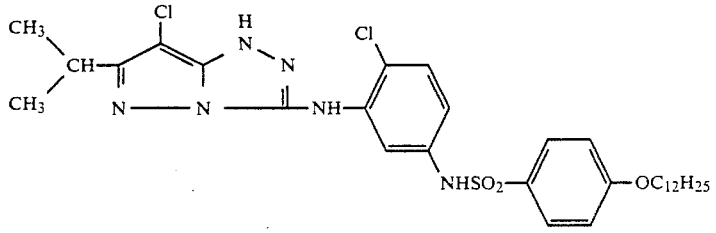
77
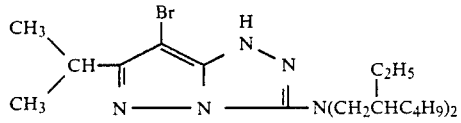
78
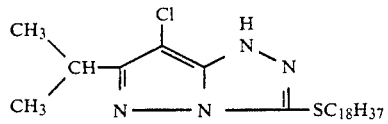
79
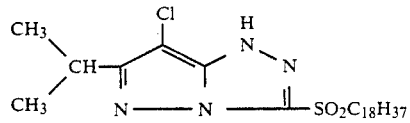
80
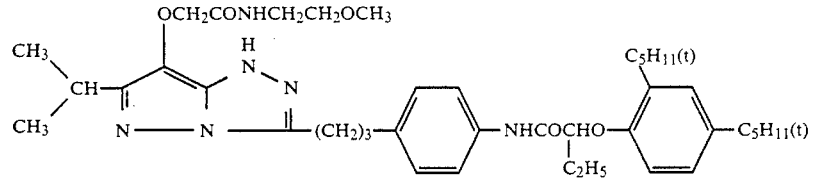
81
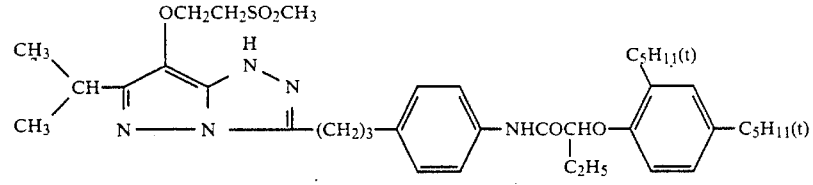
82
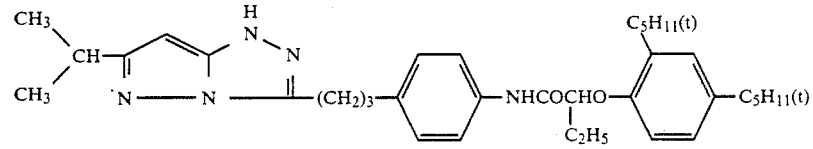
83
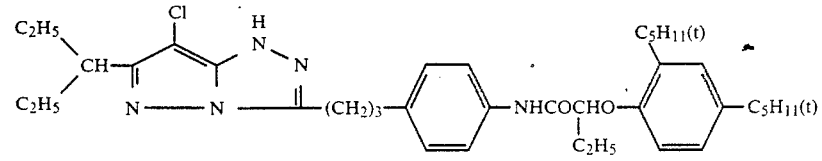

-continued
84
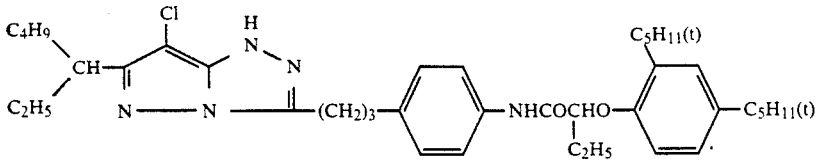
85
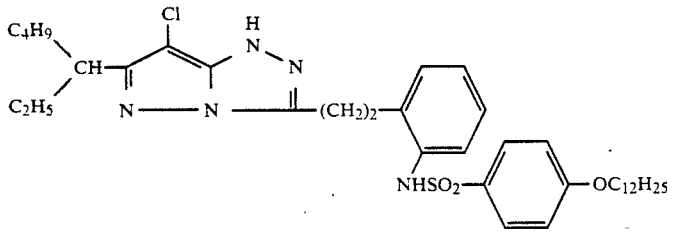
86
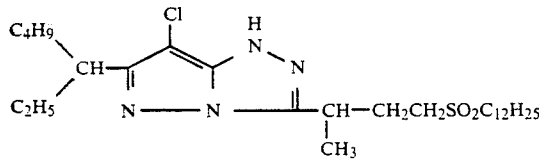
87
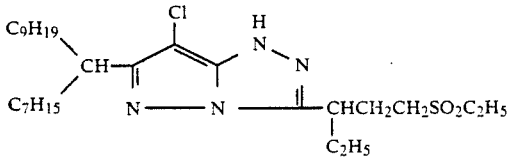
88
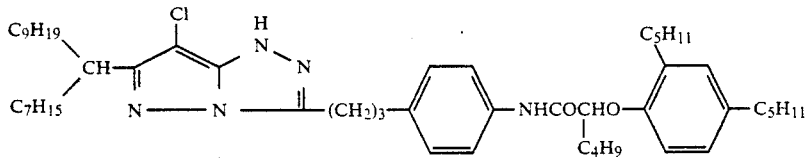
89
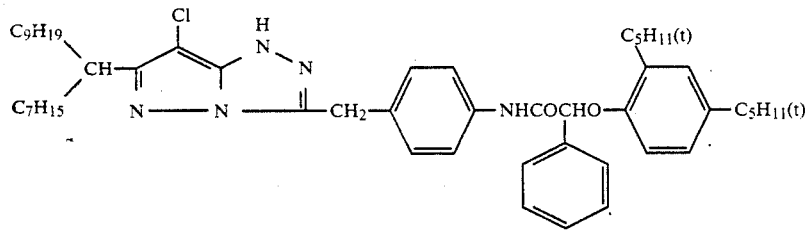
90
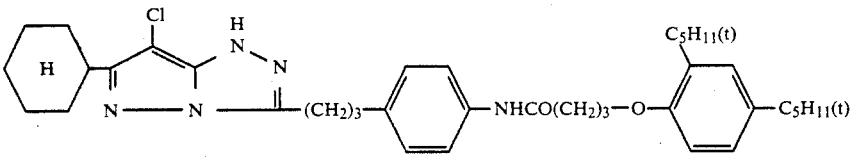
91
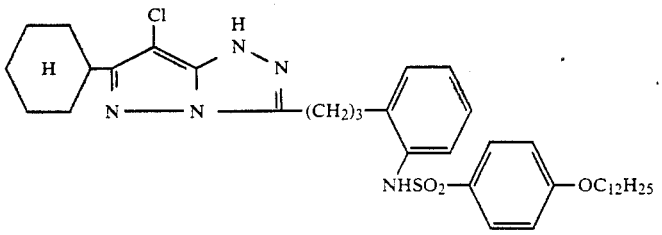

-continued
92
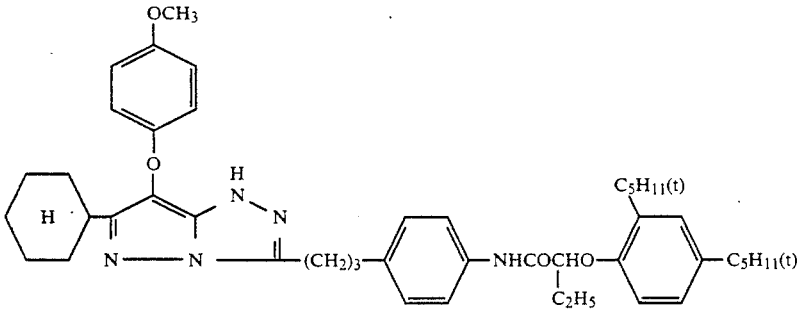
93
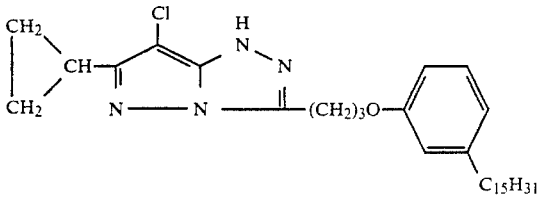
94
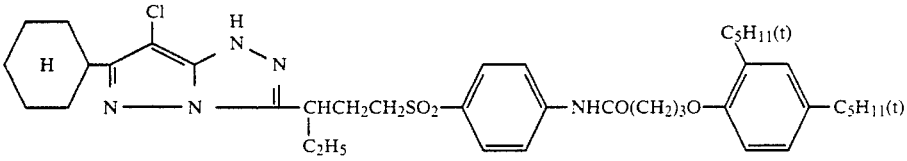
95
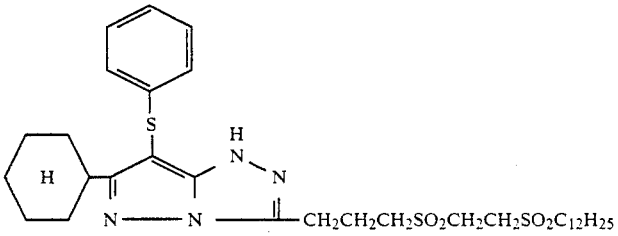
96
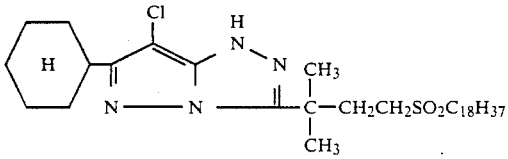
97
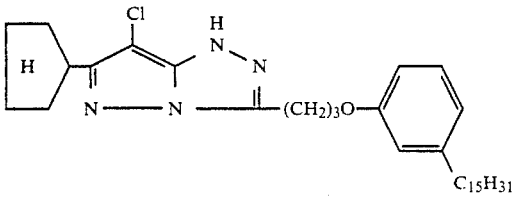
98
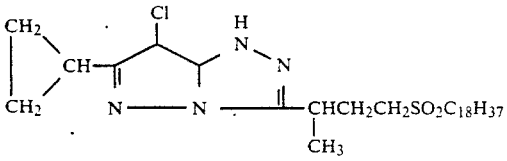
99
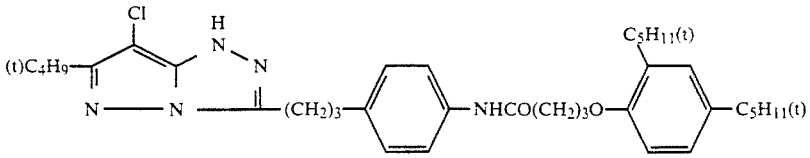

-continued
100
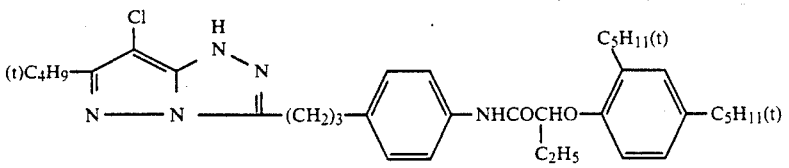
101
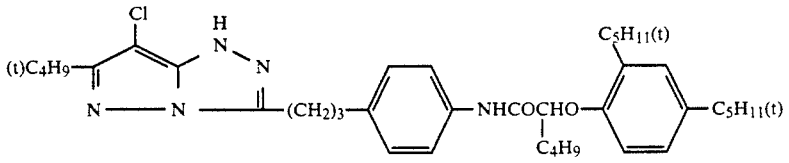
102
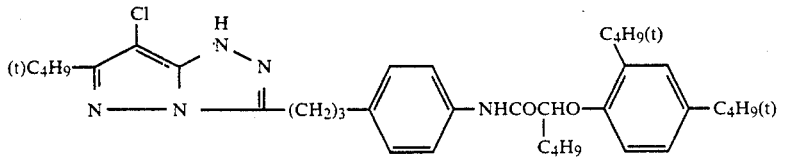
103
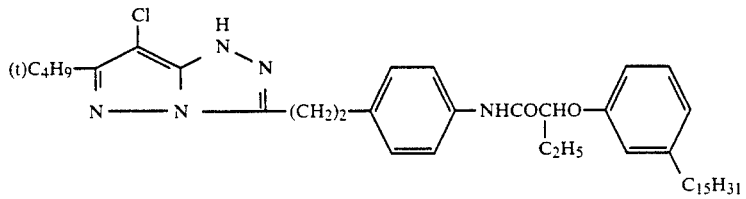
104
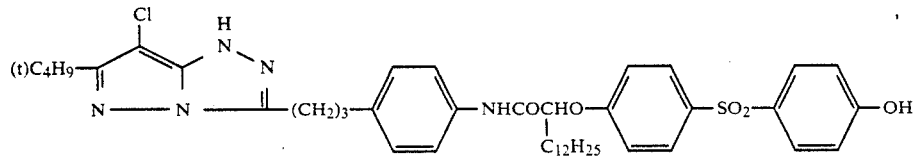
105
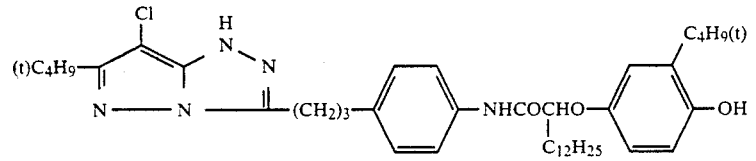
106
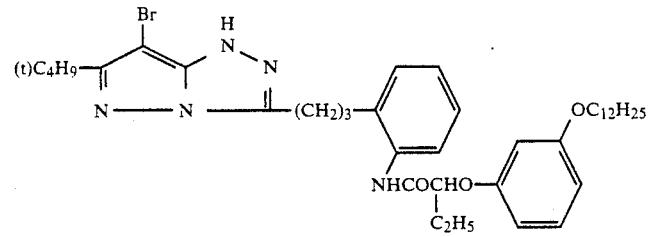
107
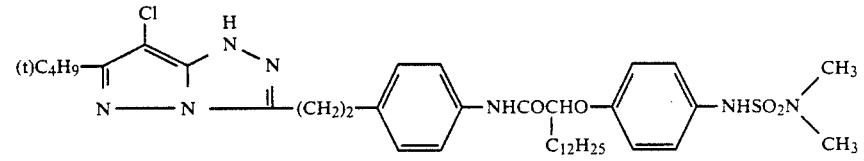
108
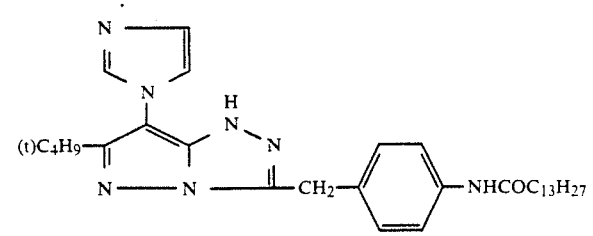

-continued
109
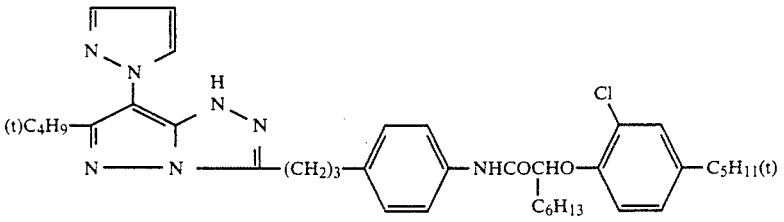
110
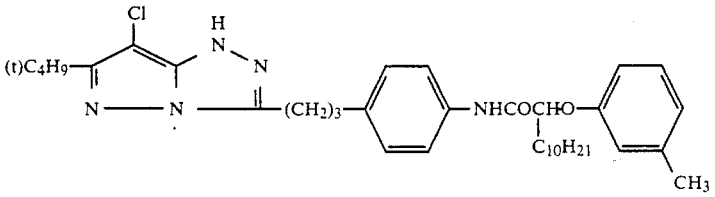
111
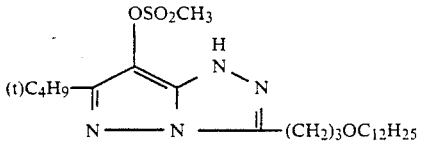
112
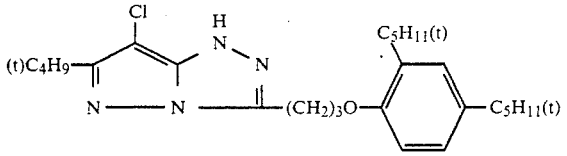
113
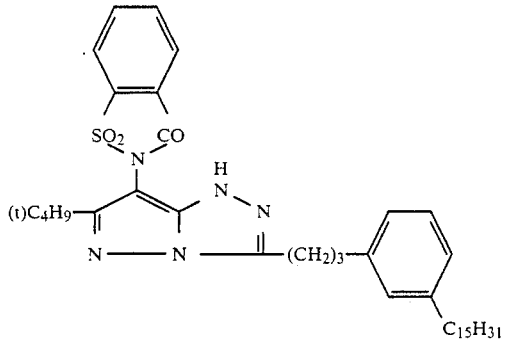
114
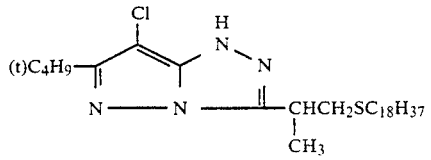
115
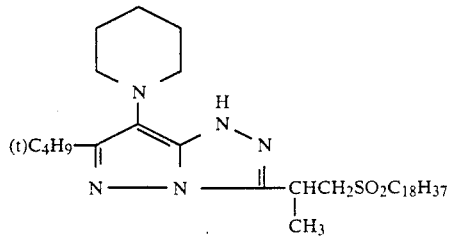

-continued
116
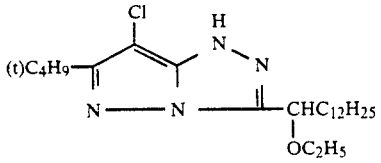
117
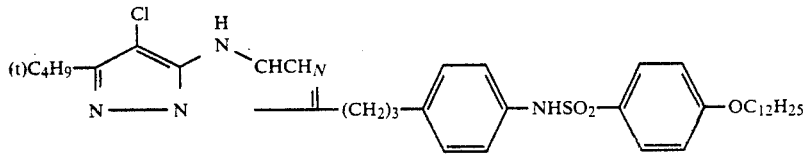
118
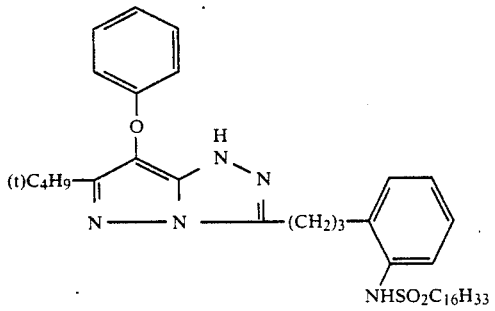
119
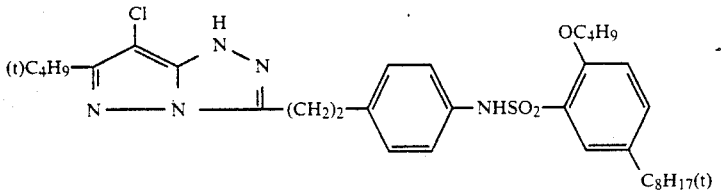
120
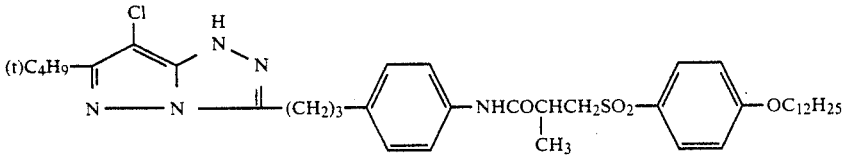
121
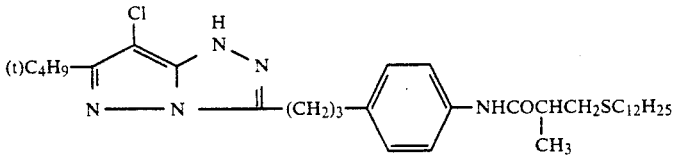
122
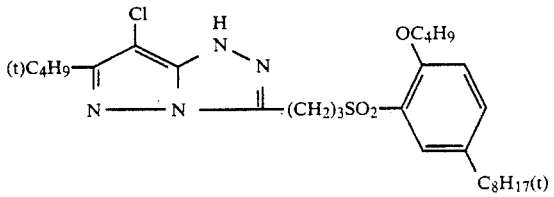
123
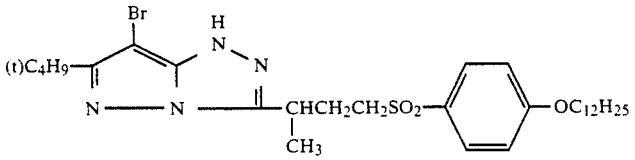

-continued
124
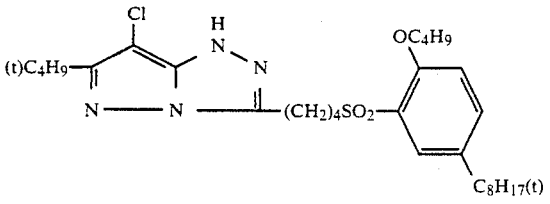
125
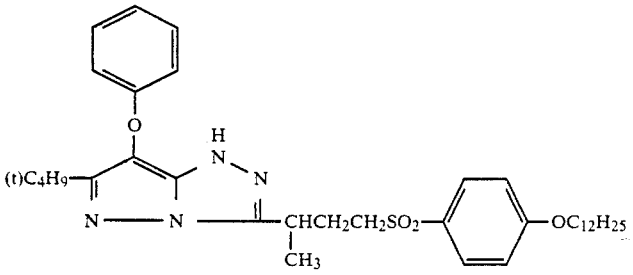
126
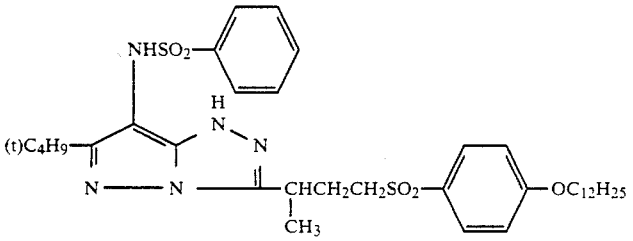
127
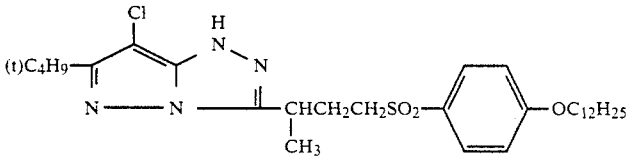
128
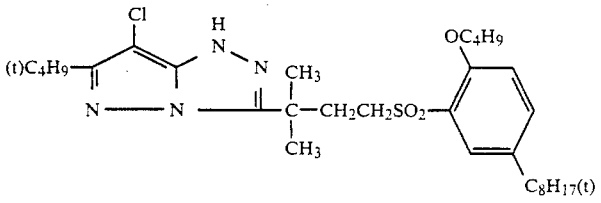
129
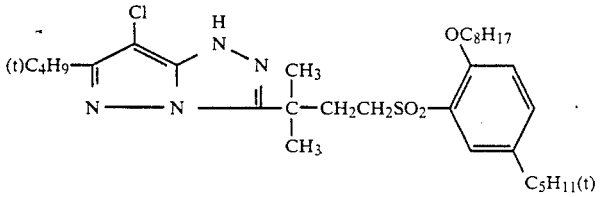
130
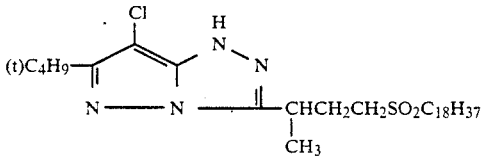
131
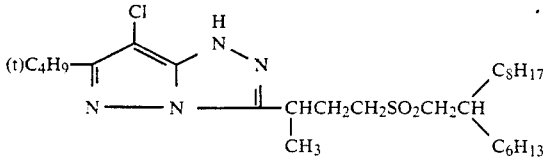

-continued
132
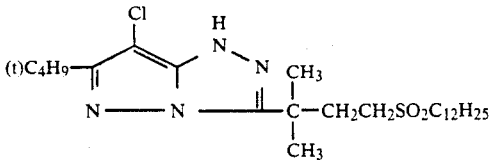
133
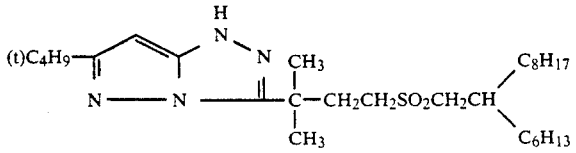
134
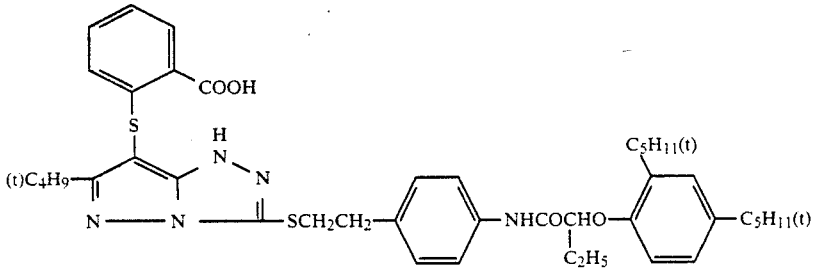
135
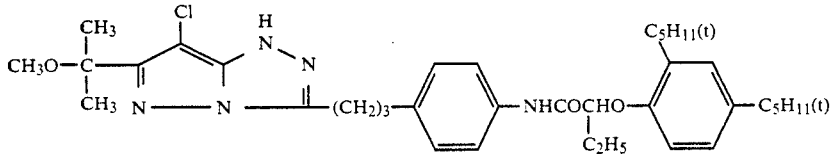
136
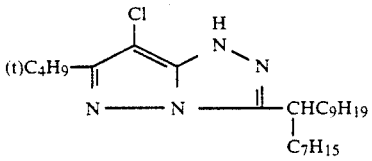
137
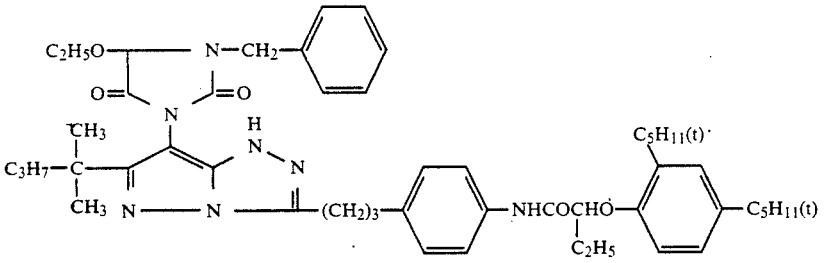
138
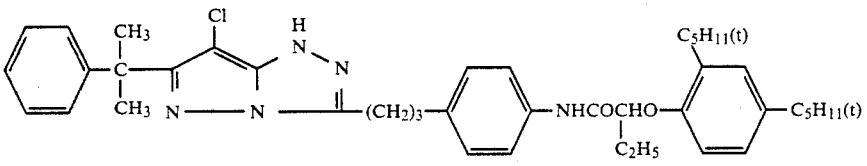
139
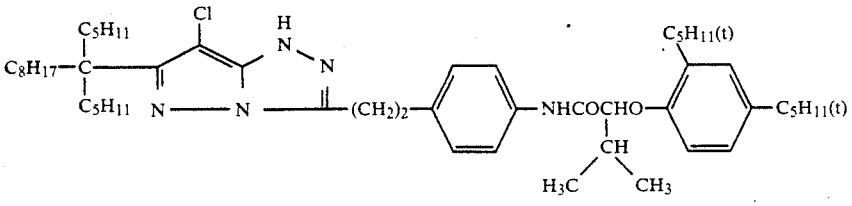

-continued
140
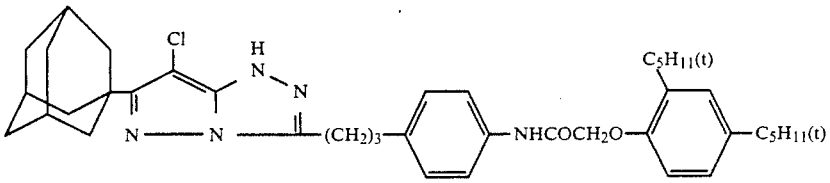
141
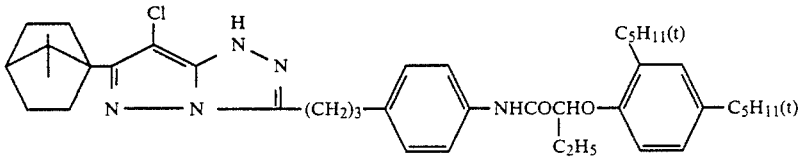
142
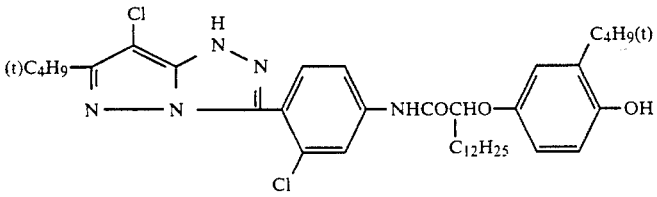
143
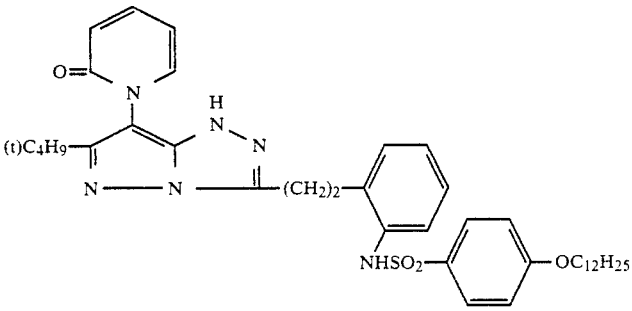
144
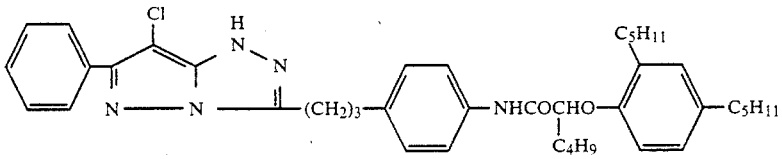
145
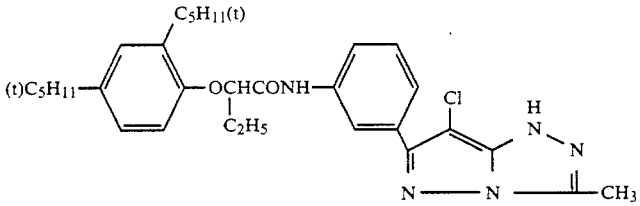
146
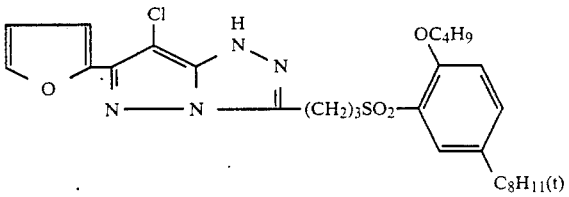
147
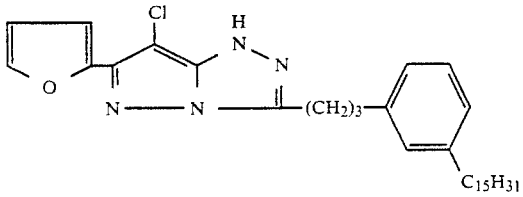

-continued
148
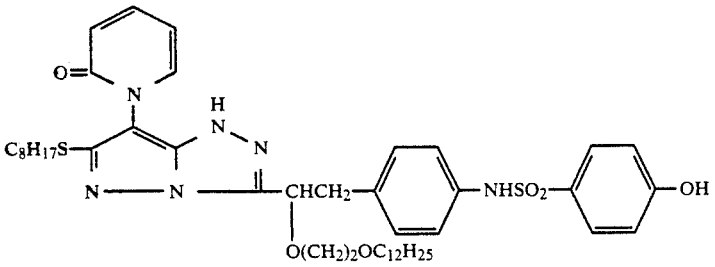
149
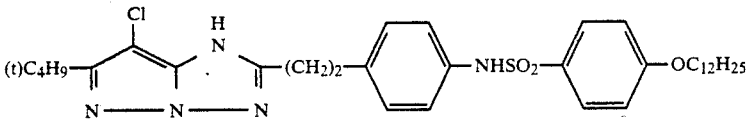
150
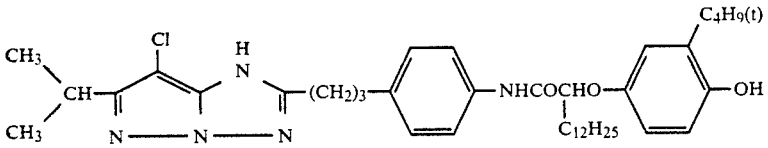
151
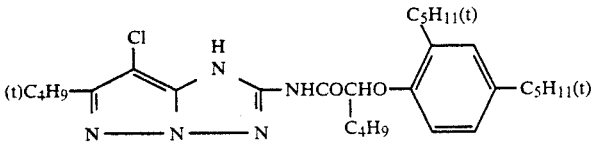
152
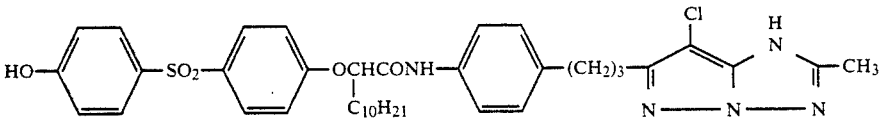
153
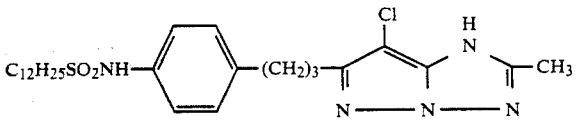
154
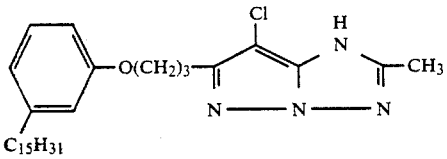
155
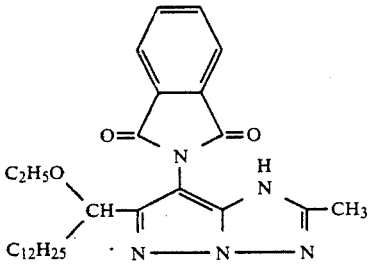
156
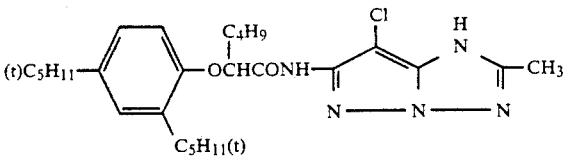

-continued
157
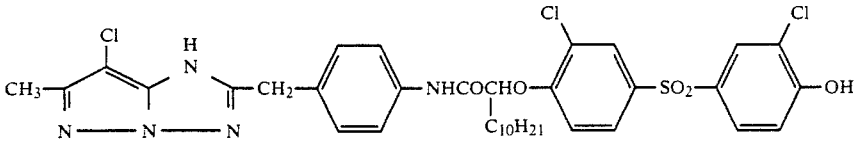
158
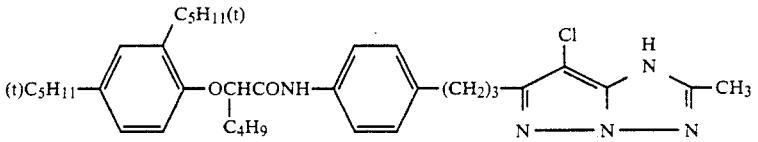
159
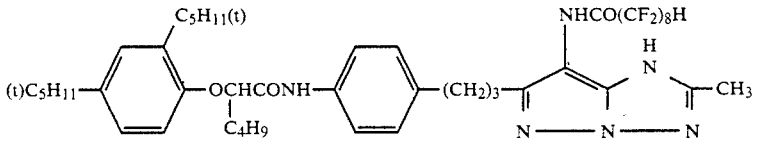
160
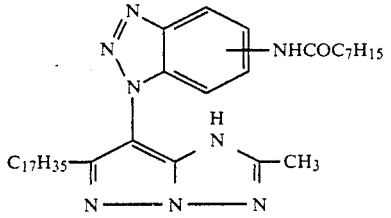
161
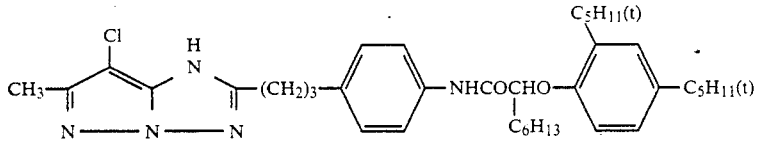
162
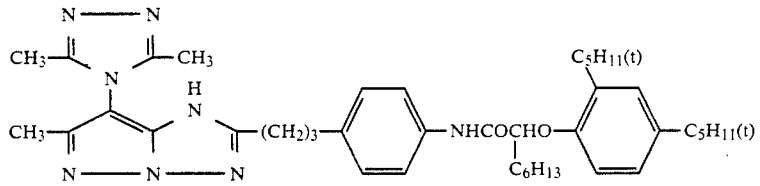
163
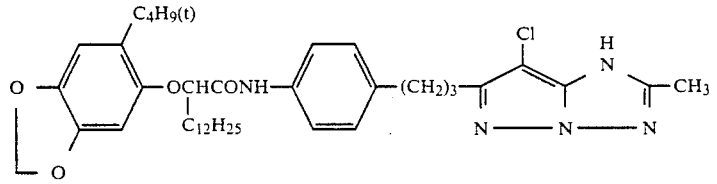
164
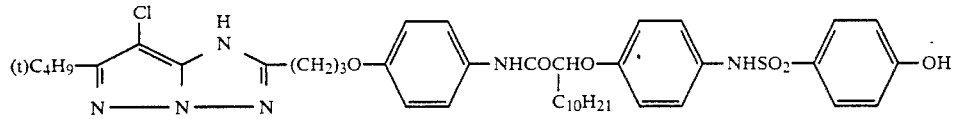
165
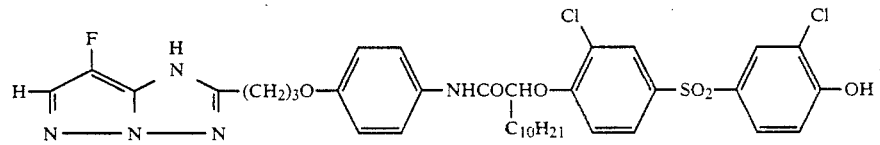
166
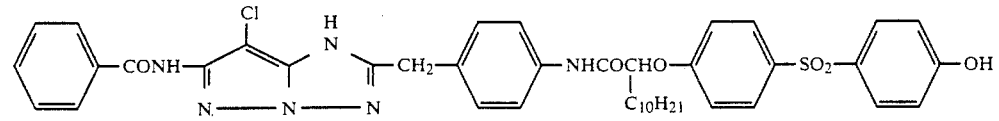

-continued
167
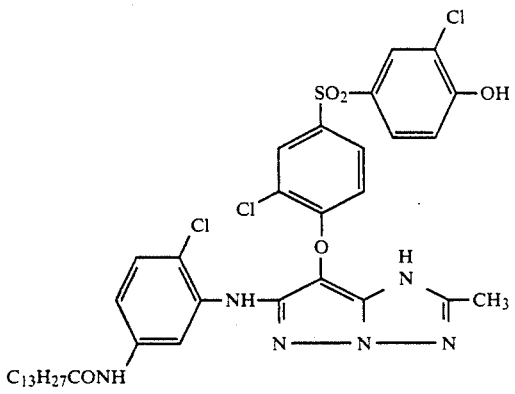
168
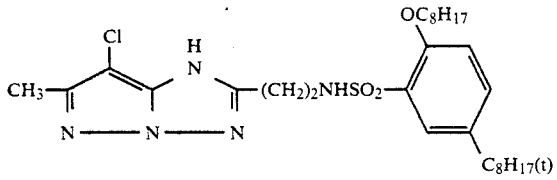
169
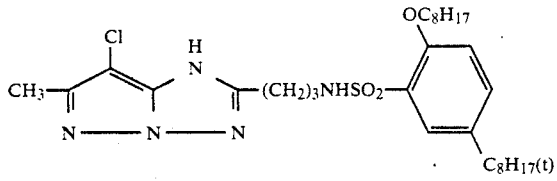
170
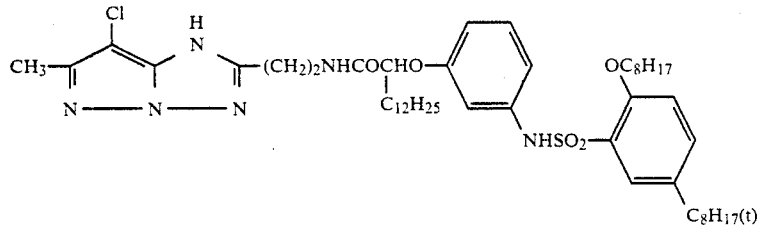
171
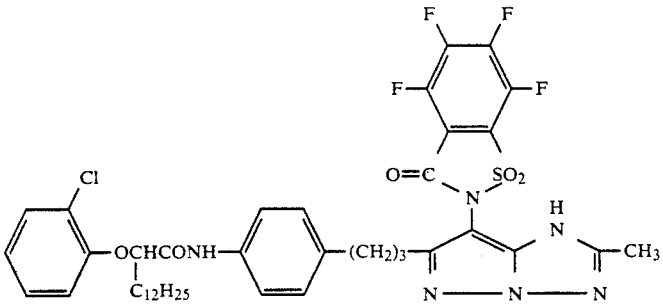
172
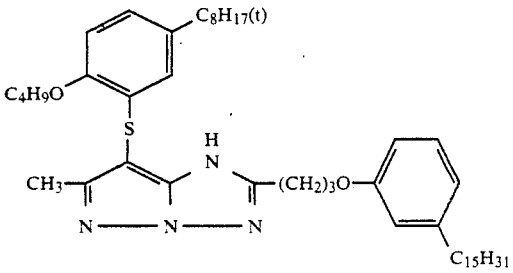

-continued
173
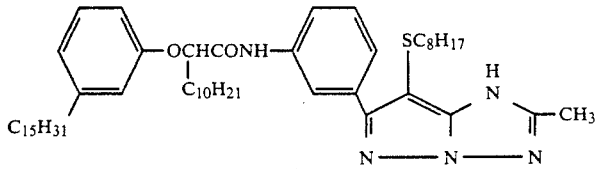
174
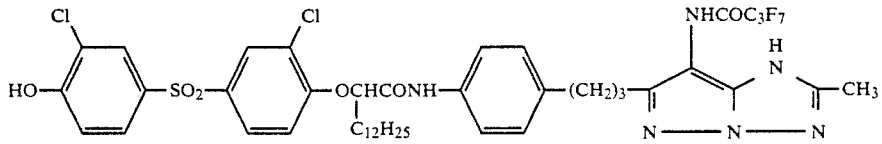
175
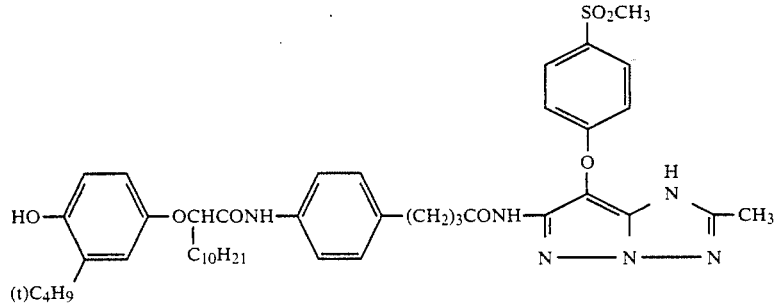
176
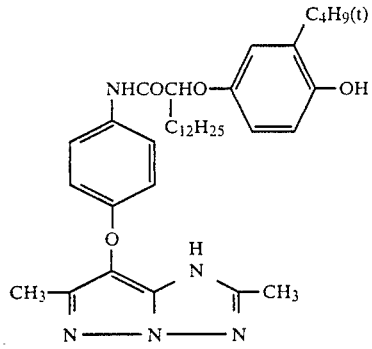
177
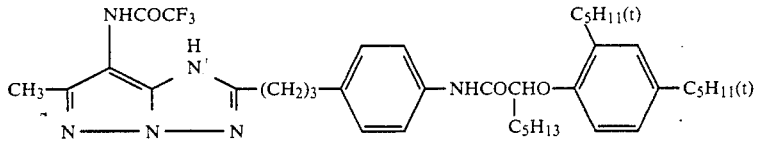
178
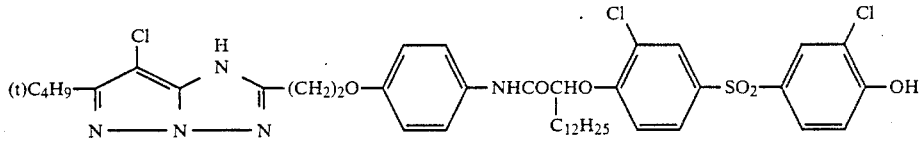
179
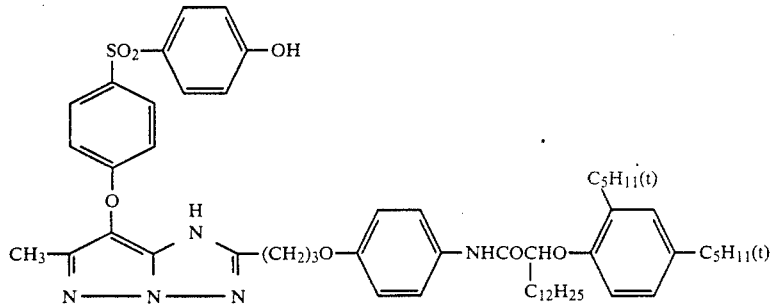

-continued
180
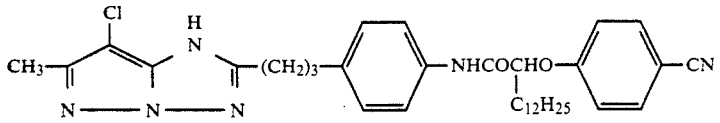
181
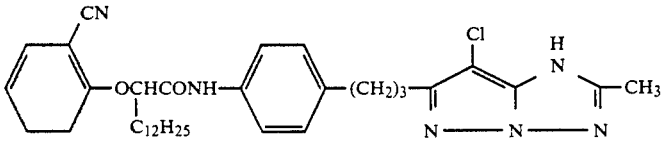
182
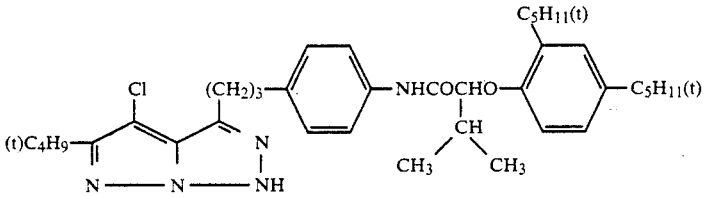
183
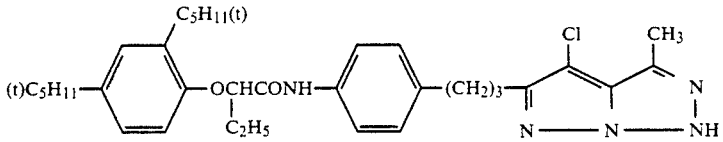
184
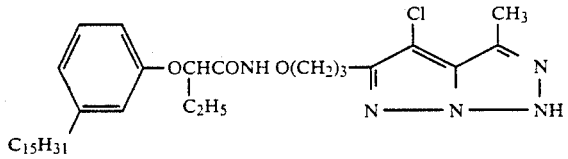
185
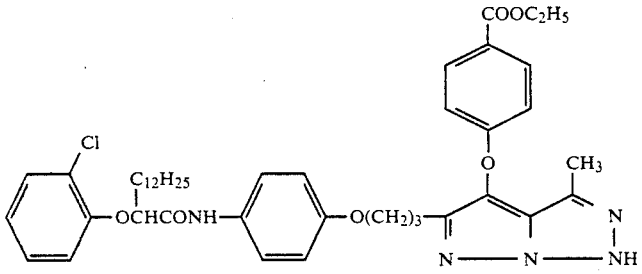
186
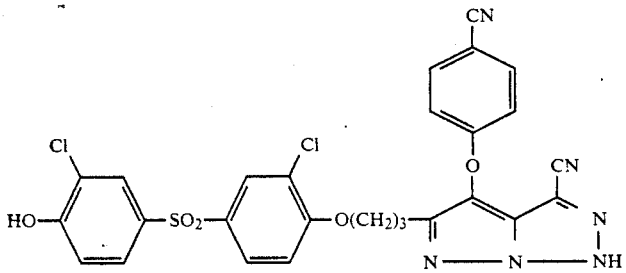
187
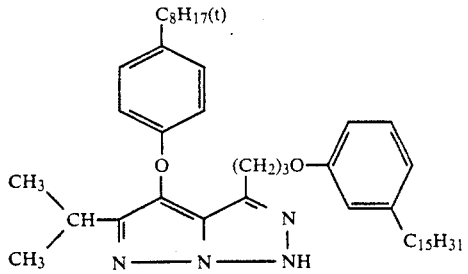

-continued
188
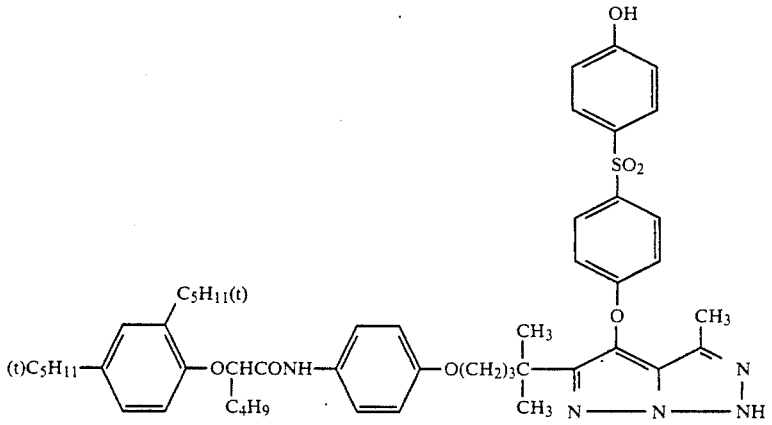
189
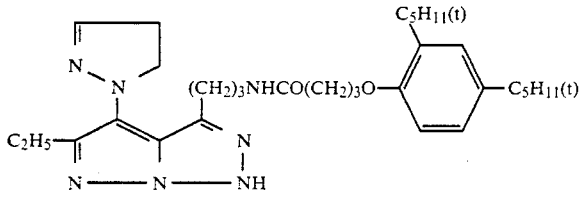
190
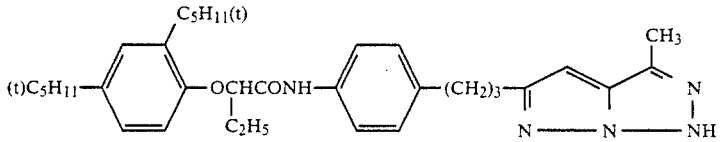
191
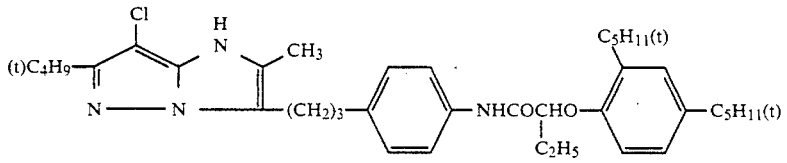
192
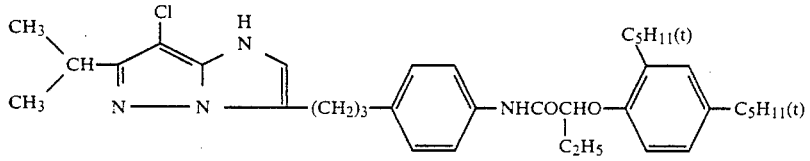
193
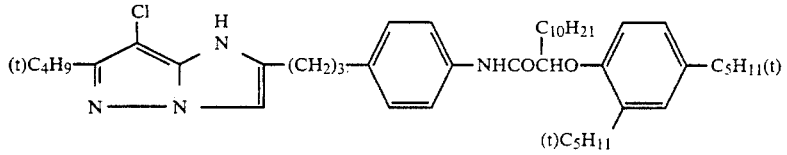
194
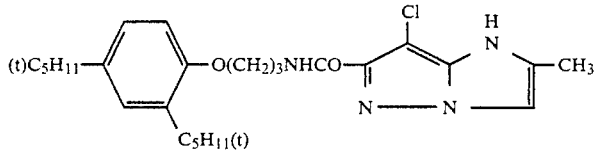
195
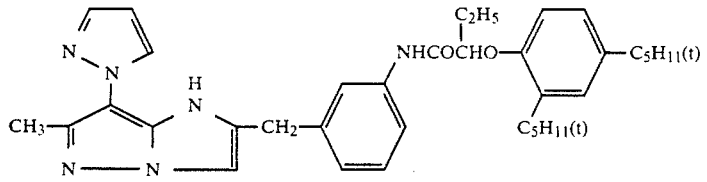

-continued
196
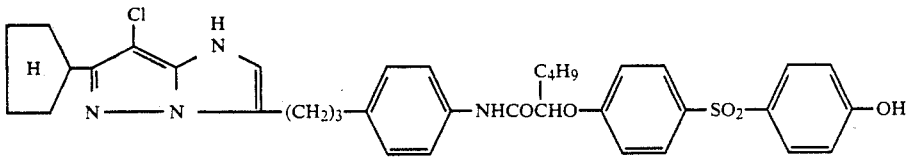
197
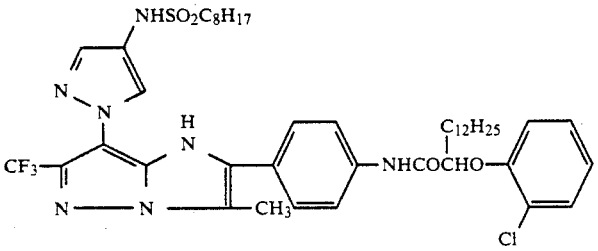
198
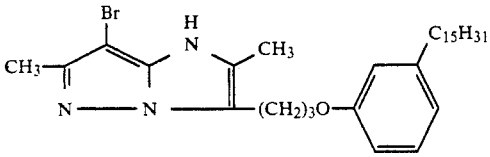
199
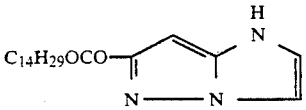
200
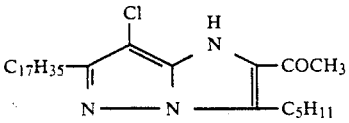
201
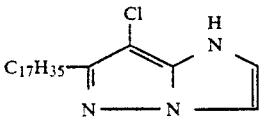
202
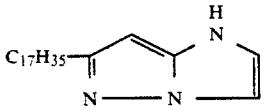
203
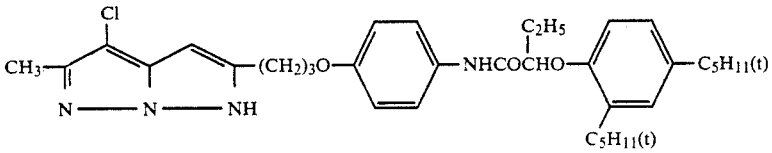
204
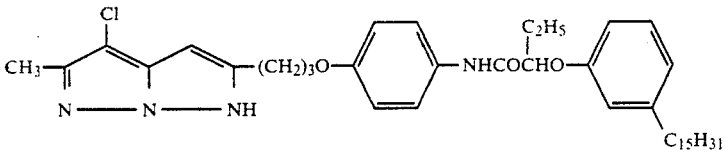

-continued
205
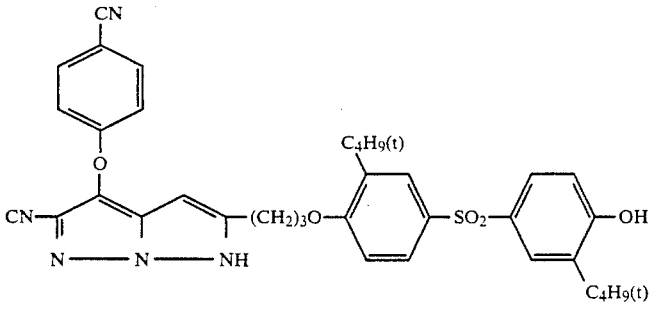
206
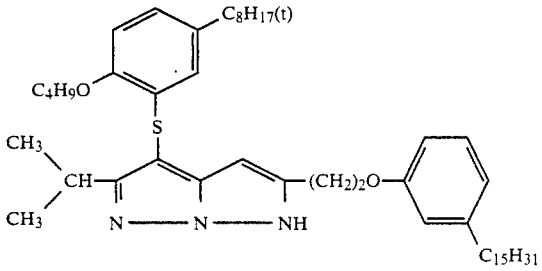
207
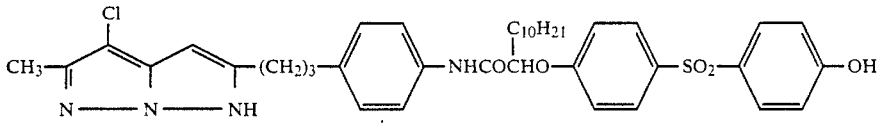
208
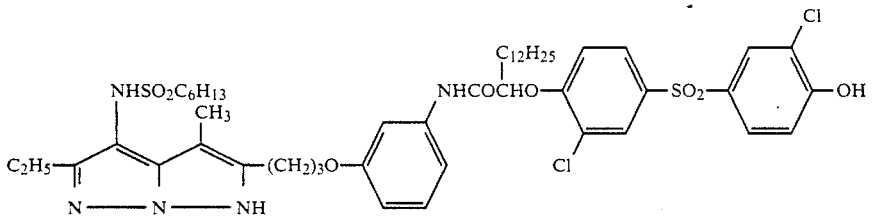
209
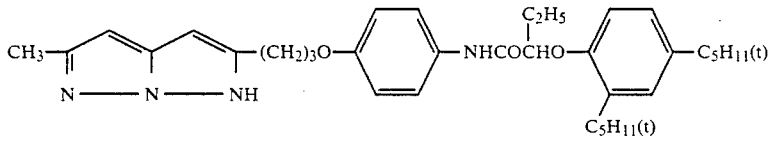
210
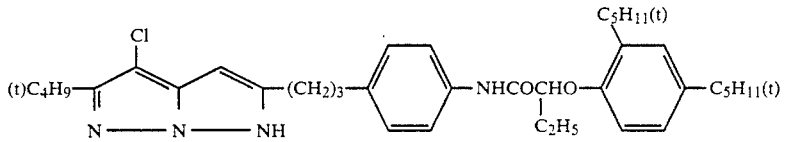
211
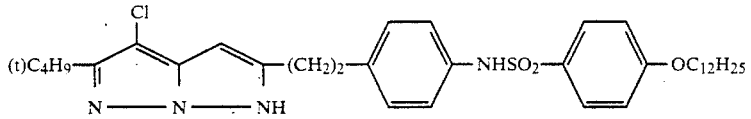
212
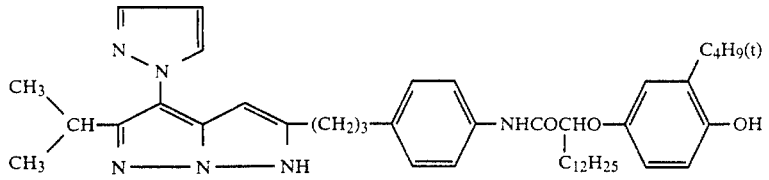

-continued
213
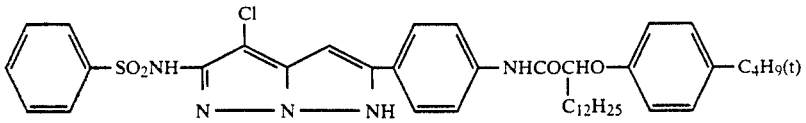
214
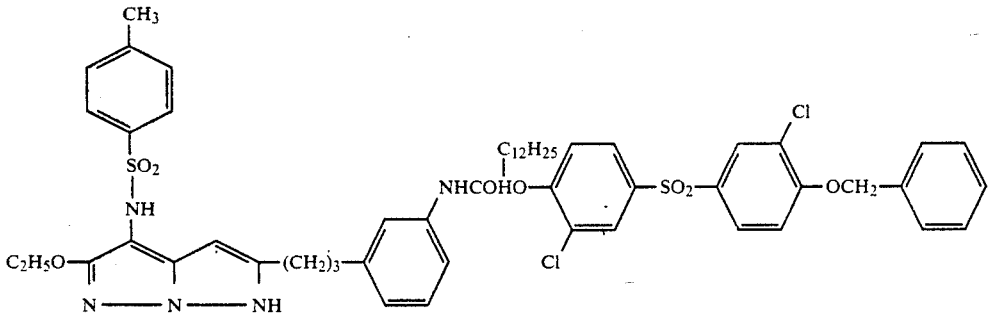
215
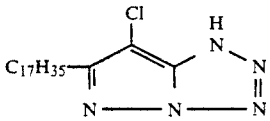
216
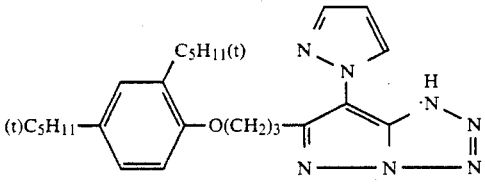
217
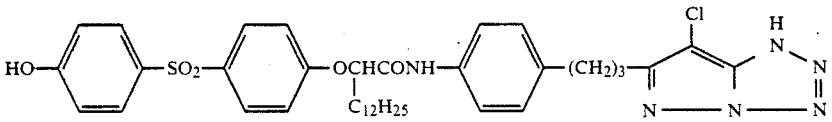
218
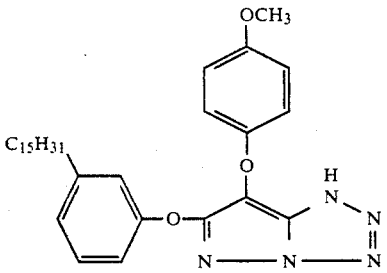
219
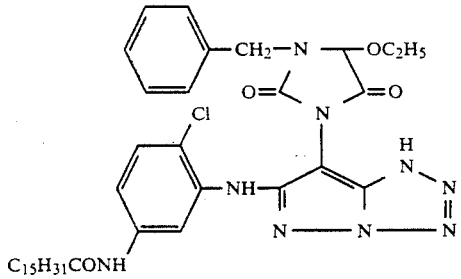
220
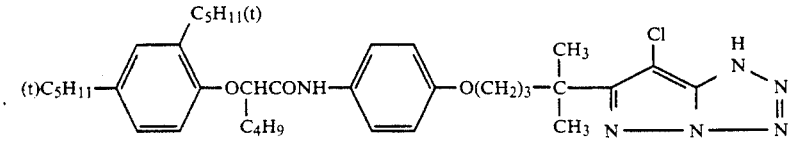

-continued

221

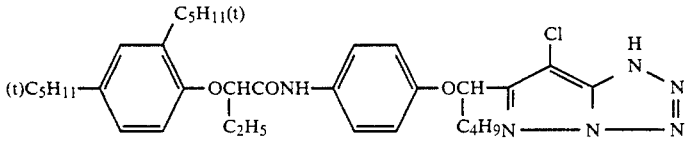

222

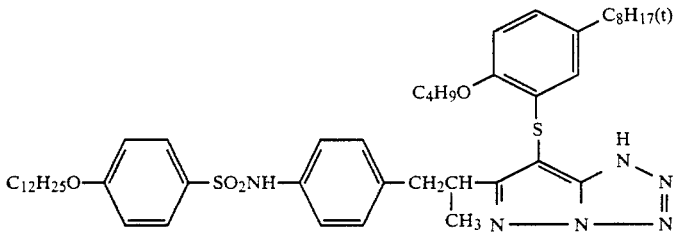

223

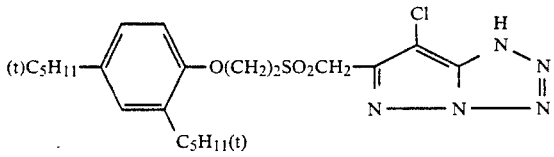

Syntheses of the above couplers can be carried out by making reference to Journal of the Chemical Society, Perkin I, 1977, pp 2047-2052, U.S. Pat. No. 3,725,067 and Japanese Unexamined Patent Publication Nos. 99437/1984, 42045/1983, 162548/1984, 171956/1984, 33552/1985, 43659/1985, 172982/1985 and 190779/1985, etc.

The couplers of this invention can be used usually in the range of $1\times10^{-3}$ mole to 1 mole, preferably $1\times10^{-2}$ to $8\times10^{-1}$ mole, per 1 mole of silver halide.

The couplers of this invention can be also used in combination with magenta couplers of other kinds.

The hydroquinone derivative used in this invention and described below in detail, which is the compound known as a stain preventive agent, have been conventionally known to have an effect as an anti-color-fading agent of a magenta dye formed from a magenta coupler for photography, as disclosed in Japanese Unexamined Patent Publication Nos. 24141/1983 and 180557/1984.

However, as a result of various studies, the present inventors found that high fastness to light can not be achieved in respect of only the magenta dye formed from the magenta coupler represented by the above General Formula (I), so long as the above hydroquinone derivative is used in an amount in which it is usually used conventionally as the anti-color-fading agent, and, as a result of further studies, they discovered that a greatest effect can be obtained only when the above hydroquinone derivative is used in a particular amount, by using together an anti-color-fading agent having an oxidation potential Eox being 0.95 (V)≦Eox≦1.50 (V).

The anti-color-fading agent, used in this invention, having an oxidation potential Eox being 0.95 (V)≦Eox≦1.50 (V) (hereinafter called "anti-color-fading agent according to this invention) will be described below in detail.

The oxidation potential Eox of the anti-color-fading agent according to this invention can be readily measured by a person skilled in the art. Methods for the measurement are disclosed, for example, in papers by A. Stanienda, "Naturwissenschaften" Vol. 47, pages 353 and 512 (1960); P. Delahay, "New Instrumental Methods in Electrochemistry" (1954) published by Interscience Publishers; L. Meites, "Polarographic Techniques", 2nd Ed. (1965), published by Interscience Publishers; etc.

The above Eox value refers to the potential at which an electron of the compound is withdrawn at an anode in voltammetry, and primarily relates to the highest occupied electron energy level in the ground state of the compound.

The Eox in this invention is a value obtained from the half-wave potential of a polarograph under the conditions shown below. That is, the value was measured by using acetonitrile as a solvent for the anti-color-fading agent, and 0.1N sodium perchlorate as a supporting electrolyte, setting the density of the anti-color-fading agent to $10^{-3}$ to $10^{-4}$ mole/lit., using an Ag/AgCl electrode as a reference electrode, using a rotated platinum plate electrode for the measurement of Eox, and at 25° C.

So far as the anti-color-fading agent according to this invention has the oxidation potential being in the range mentioned above, the compounds of any structure can be used. In particular, however, preferable compounds may include those represented by General Formulas (A) to (H), (J) and (K) shown below, and more preferably the compounds represented by General Formulas (A), (B), (G) and (J). As a matter of course, even the compounds other than those represented by these General Formulas may be used as the anti-color-fading agent according to this invention if they have the oxidation potential in the range mentioned above.

General Formula (A)

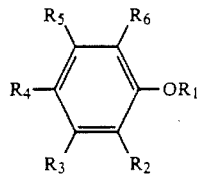

In the formula, $R^1$ represents a hydrogen atom, an alkyl group, an alkenyl group, an aryl group or a heterocyclic group; $R^2$, $R^3$, $R^5$ and $R^6$ each represent a hydrogen atom, a halogen atom, a hydroxyl group, an alkyl group, an alkenyl group, an ary group, an alkoxy group or an acylamino group; $R^4$ represents an alkyl group, a hydroxyl group, an aryl group or an alkoxy group, provided that when $R^1$ is a hydrogen atom, $R^4$ is other than a hydroxy group. $R^1$ and $R^2$ may be combined with each other to form a 5- or 6-membered ring, whereat $R^4$ represents a hydroxyl group or an alkoxy group. Also, $R^3$ and $R^4$ may be combined to form a hydrocarbon ring of 5 members, whereat $R^1$ represents an alkyl group, an aryl group or a heterocyclic group.

In the above General Formula (A), wherein $R^1$ represents a hydrogen atom, an alkyl group, an alkenyl group, an aryl group or a heterocyclic group, the alkyl group may include, for example, straight-chain or branched alkyl groups such as a methyl group, an ethyl group, a propyl group, n-octyl group, tert-octyl group and hexadecyl group. The alkenyl group represented by $R^1$ may include, for example, an ally group, a hexenyl group, an octenyl group, etc. Further, the aryl group represented by $R^1$ may include each of a phenyl group and a naphthyl group. Further, the heterocyclic group represented by $R^1$ may include, specifically, a tetrahydropyranyl group, a pyrimidyl group, etc. These groups may each have a substituent. For example, as the alkyl group having a substituent, it may include a benzyl group and an ethoxymethyl group; as the aryl group having a substituent, a methoxyphenyl group, a chlorophenyl group, a 4-hydroxy-3,5-dibutylphenyl group, etc.

In General Formula (A), wherein $R^2$, $R^3$, $R^5$ and $R^6$ each represent a hydrogen atom, a halogen atom, a hydroxyl group, an alkyl group, an alkenyl group, an ary group, an alkoxy group or an acylamino group, the alkyl group, the alkenyl group and the aryl group may include the alkyl group, the alkenyl group and the aryl group mentioned for the above $R^1$. Also, the above halogen atom may include, for example, fluorine, chlorine, bromine, etc. Further, the above alkoxy group may include specifically a methoxy group, an ethoxy group, etc. Further, the above acylamino group is represented by R'CONH—, wherein R' represents an alkyl group (for example, groups such as methyl, ethyl, n-propyl, n-butyl, n-octyl, tert-octyl and benzyl), an alkenyl group (for example, groups such as allyl, octinyl and oleyl), an aryl group (for example, groups such as phenyl, methoxyphenyl and naphthyl) or a heterocyclic group (for example, groups such as pyridyl and pyrimidyl).

In the above General Formula (A), wherein $R^4$ represents an alkyl group, a hydroxyl group, an aryl group or an alkoxy group, the alkyl group and the aryl group may include specifically those same as in the alkyl group and the aryl group represented by the above $R^1$. Also, the alkoxy group represented by $R^4$ may include those same as in the alkoxy group mentioned for the above $R^2$, $R^3$, $R^5$ and $R^6$.

The ring formed together with a benzene by ring closure of $R^1$ and $R^2$ may include, for example, chroman, coumaran and methylenedioxybenzene. Also, the ring formed together with a benzene ring by ring closure of $R^3$ and $R^4$ may include, for example, indane. These rings may have a substituent (for example, alkyl, alkoxy and aryl).

An atom in the ring formed by ring closure of $R^1$ and $R^2$ or ring closure of $R^3$ and $R^4$ may be a spiro atom to form a spiro compound, or $R^2$ and $R^4$ may be a linking group to form a bis-type compound.

Of the phenol type compounds and the phenylether type compounds represented by the above General Formula (A), preferable is a biindane compound having four RO— groups (wherein R represents an alkyl group, an alkenyl group, an aryl group or a heterocyclic group), particularly preferable is a compound represented by General Formula (A-1) shown below:

General Formula (A-1)

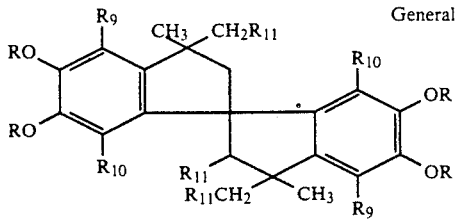

In the formula, R represents an alkyl group (for example, methyl, ethyl, propyl, n-octyl, tert-octyl, benzyl and hexadecyl), an alkenyl group (for example, allyl, octenyl and oleyl), an aryl group (for example, phenyl and naphthyl) or a heterocyclic group (for example, tetrahydropyranyl and pyrimidyl). $R^9$ and $R^{10}$ each represent a hydrogen atom, a halogen atom (for example, fluorine, chlorine and bromine), an alkyl group (for example, methyl, ethyl, n-butyl and benzyl), an allyl group (for example, allyl, hexenyl and octenyl) or an alkoxy group (for example, methoxy, ethoxy and benzyloxy); $R^{11}$ represents a hydrogen atom, an alkyl group (for example, methyl, ethyl, n-butyl and benzyl), an alkenyl group (for example, 2-propenyl, hexenyl and octenyl) or an aryl group (for example, phenyl, methoxyphenyl, chlorophenyl and naphthyl).

The compound represented by the above General Formula (A) may also include the compounds disclosed in U.S. Pat. Nos. 3,935,016, 3,982,944 and 4,254,216, Japanese Unexamined Patent Publication Nos. 21004/1980 and 145530/1979, British Patent Publication Nos. 2,077,455 and 2,062,888, U.S. Pat. Nos. 3,764,337, 3,432,300, 3,574,627 and 3,573,050, Japanese Unexamined Patent Publication Nos. 152225/1977, 20327/1978, 17729/1978 and 6321/1980, British Patent No. 1,347,556, British Patent Publication No. 2,066,975, Japanese Patent Publication Nos. 12337/1979 and 31625/1973, U.S. Pat. No. 3,700,455, etc.

General Formula (B)

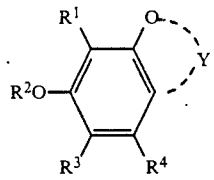

In the formula, $R^1$ and $R^4$ each represents a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group, or an alkoxycarbonyl group; $R^2$ represents a hydrogen atom, an alkyl group, an alkenyl group, an aryl group, an acyl group, a cycloalkyl group or a heterocyclic group; and $R_3$ represents a hydrogen atom, a halogen atom, an alkyl group, an alkenyl group, an aryl group, an aryloxy group, an acyl group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, an acyloxy group, a carbamoyl group, a sulfonamide group, a sulfamoyl group, etc.

Also, $R^2$ and $R^3$ may be combined each other to form a 5- or 6-membered ring. The ring formed together with a benzene ring by the ring closure of $R^2$ and $R^3$ may include, for example, a chroman ring and a methyleneoxybenzene ring.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by General Formula (B), compounds most useful for this invention are included in the compounds represented by General Formulas (B-1), (B-2), (B-3), (B-4) and (B-5).

General Formula (B-1)

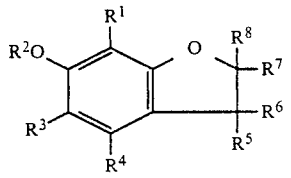

General Formula (B-2)

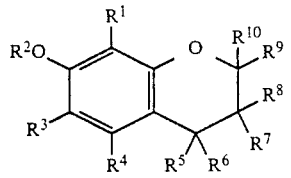

General Formula (B-3)

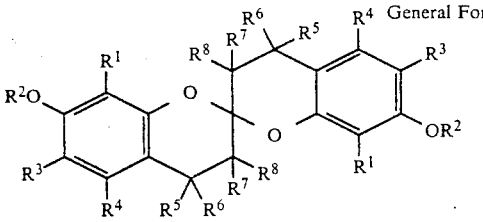

General Formula (B-4)

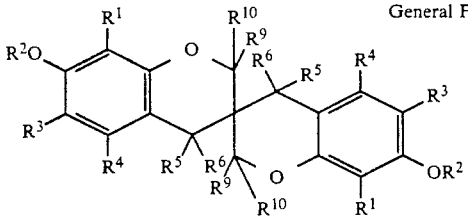

General Formula (B-5)

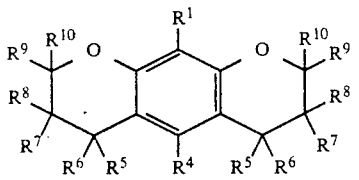

$R^1$, $R^2$, $R^3$ and $R^4$ in General Formulas (B-1), (B-2), (B-3), (B-4) and (B-5) have the same meaning as those in the above General Formula (B), and $R^5$, $R^6$, $R^7$, $R^8$, $R^9$ and $R^{10}$ each represents a hydrogen atom, a halogen atom, an alkyl group, an alkoxy group, a hydroxyl group, an alkenyl group, an alkenyloxy group, an aryl group, an aryloxy group or a heterocyclic group.

Also, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

In the above General Formulas (B-1), (B-2), (B-3), (B-4) and (B-5), particularly useful compounds are those in which $R^1$ and $R^4$ are each a hydrogen atom, an alkyl group, an alkoxy group, a hydroxyl group or a cycloalkyl group, and $R^5$, $R^6$, $R^7$, $R^8$, $R^9$ and $R^{10}$ are each a hydrogen atom, an alkyl group or a cycloalkyl group.

The compounds represented by General Formula (B) include the compounds disclosed in Tetrahedron Letters, 1970, Vol. 126, pp 4743–4751; Japan Chemical Society, 1972, No. 10, pp 0987–1990; Chem. Lett., 1972, (4), pp 315–316 and Japanese Unexamined Patent Publication No. 139383/1980, and may be synthesized by the methods also disclosed in these publications.

General Formula (C)

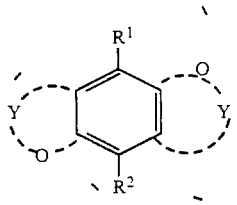

General Formula (D)

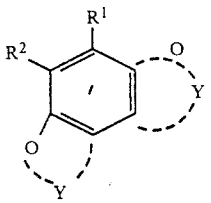

In the above formulas, $R^1$ and $R^2$ each represent a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

The groups mentioned above each may be substituted with other substituent which may include, for example, a halogen atom, an alkyl group, an alkenyl group, an alkoxy group, an aryloxy group, a hydroxyl group, an alkoxycarbonyl group, an aryloxycarbonyl group, an acylamino group, a carbamoyl group, a sulfonamide group, a sulfamoyl group, etc.

Y represents a group of atoms necessary for formation of a dichroman or dicoumaran ring together with a benzene ring.

Chroman or coumaran ring may be substituted with a halogen atom, an alkyl group, a cycloalkyl group, an alkoxy group, an alkenyl group, alkenyloxy group, a hydroxyl group, an aryl group, an aryloxy group or a heterocyclic group, or further may form a spiro ring.

Of the compounds represented by General Formulas (C) and (D), compounds most useful for this invention are included in the compounds represented by General Formulas (C-1), (C-2), (D-1) and (D-2), respectively.

General Formula (C-1)

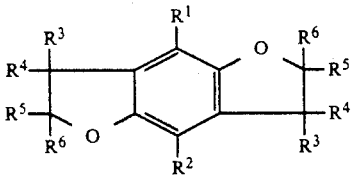

General Formula (C-2)

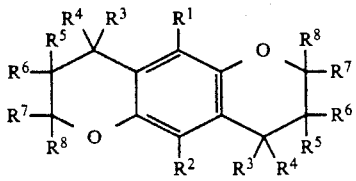

General Formula (D-1)

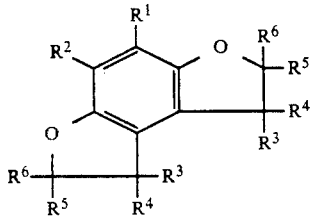

General Formula (D-2)

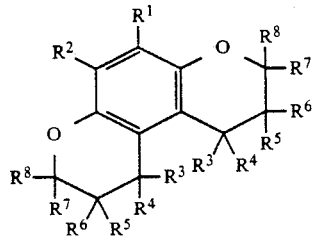

and (D-2) have the same meaning as those in General Formulas (C) and (D), and $R^3$, $R^4$, $R^5$, $R^6$ $R^7$ and $R^8$ each represent a hydrogen atom, a halogen atom, an alkyl group, an alkoxy group, a hydroxyl group, an alkenyl group, an alkenyloxy group, an aryl group, an aryloxy group or a heterocyclic ring. Also, $R^3$ and $R^4$, $R^4$ and $R^5$, $R^5$ and $R^6$, $R^6$ and $R^7$ and $R^7$ and $R^8$ each may be cyclized each other to form a carbon ring, and such a carbon ring may be further substituted with alkyl group.

In the above General Formulas (C-1), (C-2), (D-1) and (D-2), particularly useful compounds are those in which $R^1$ and $R^2$ are each a hydrogen atom, an alkyl group, an alkoxy group, a hydroxyl group or a cycloalkyl group, and $R^3$, $R^4$, $R^5$, $R^6$, $R^7$ and $R^8$ are each a hydrogen atom, an alkyl group or a cycloalkyl group.

The compounds represented by General Formulas (C) and (D) include the compounds disclosed in Japan Chemical Society, Part C, 1968. (14), p 1937–18; Organic Synthetic Chemical Association, 1970, 28(1), pp 60–65; Tetrahedron Letters, 1973. (29), pp 2707–2710, and may be synthesized by the methods also disclosed in these publications.

General Formula (E)

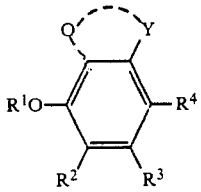

In the formula, $R^1$ represents a hydrogen atom, an alkyl group, an alkenyl group, an aryl group, an acyl group, a cycloalkyl group or a heterocyclic group; and $R_3$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group.

$R^2$ and $R^4$ each represents a hydrogen atom, a halogen atom, an alkyl group, an alkenyl group, an aryl group, an acyl group, an acylamino group, a sulfonamide group, a cycloalkyl group or an alkoxycarbonyl group.

The above-mentioned groups each may be substituted with other substituent which may include, for example, an alkyl group, an alkenyl group, an alkoxyl group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$ may be combined each other to form a 5- or 6-membered ring.

In that occasion, $R^3$ and $R^4$ each represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by General Formula (E), compounds most useful for this invention are included in the compounds represented by General Formulas (E-1), (E-2), (E-3), (E-4) and (E-5).

General Formula (E-1)

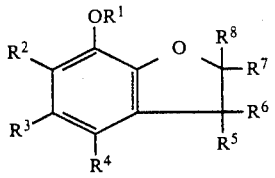

General Formula (E-2)

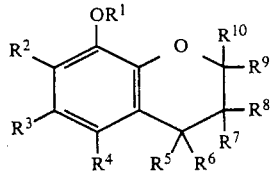

General Formula (E-3)

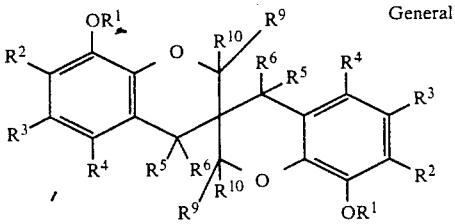

-continued

General Formula (E-4)

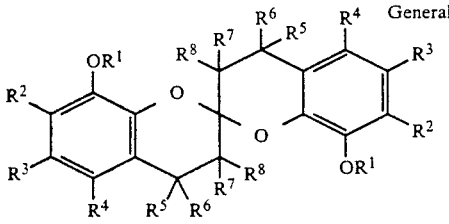

Formula (E-5)

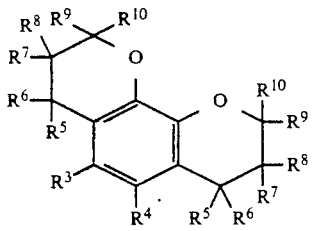

$R^1$, $R^2$, $R^3$ and $R^4$ in Formulas (E-1) to (E-5) have the same meaning as those in the above Formula (E), and $R^5$, $R^6$, $R^7$, $R^8$, $R^9$ and $R^{10}$ each represents a hydrogen atom, a halogen atom, an alkyl group, an alkoxy group, a hydroxyl group, an alkenyl group, an alkenyloxy group, an aryl group, an aryloxy group or a heterocyclic group.

Further, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

In the above Formulas (E-1) to (E-5), particularly useful compounds are those in which $R^1$, $R^2$, $R^3$ and $R^4$ are each a hydrogen atom, an alkyl group or a cycloalkyl group; and in the above Formula (E-5), $R^3$ and $R^4$ are each a hydrogen atom, an alkyl group, an alkoxy group, a hydroxyl group or a cycloalkyl group; and in the above Formulas (E-1) to (E-5), $R^5$, $R^6$, $R^7$, $R^8$, $R^9$ and $R^{10}$ are each a hydrogen atom, an alkyl group or a cycloalkyl group.

The compounds represented by Formula (E) include the compounds disclosed in Tetrahedron Letters, 1965. (8), pp 457–460; Japan Chemical Society, Part C, 1966. (22), pp 2013–2016; Zh. Org. Khim, 1970, (6), pp 1230–1237, and may be synthesized by the methods also disclosed in these publications.

General Formula (F)

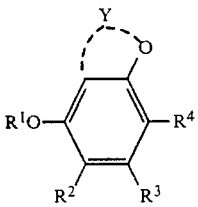

In the formula, $R^1$ represents a hydrogen atom, an alkyl group, an alkenyl group, an acyl group, a cycloalkyl group or a heterocyclic group; $R^2$ represents a hydrogen atom, a halogen atom, an alkyl group, an alkenyl group, an aryl group, aryloxy group, an acyl group, an acylamino group, an acyloxy group, a sulfonamide group, a cycloalkyl group or an alkoxycarbonyl group.

$R^3$ represents a hydrogen atom, a halogen atom, an alkyl group, an alkenyl group, an aryl group, an acyl group, an acylamino group, a sulfonamide group, a cycloalkyl group or an alkoxycarbonyl group.

$R^4$ represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$ may be combined each other to form a 5- or 6-membered ring. In this occasion, $R^3$ and $R^4$ each represents a hydrogen atom, a halogen atom, an alkyl group, an alkenyl group, an alkoxy group, an alkenyloxy group, a hydroxyl group, an aryl group, an aryloxy group, an acyl group, an acylamino group, an acyloxy group, a sulfonamide group or an alkoxycarbonyl group.

Y represents a group of atoms necessary for formation of a chroman or coumaran ring.

The chroman or coumaran ring may be substituted with a halogen atom, an alkyl group, a cycloalkyl group, an alkoxy group, an alkenyl group, an alkenyloxy group, a hydroxyl group, an aryl group, an aryloxy group or a heterocyclic group, or may further form a spiro ring.

Of the compounds represented by General Formula (F), compounds most useful for this invention are included in the compounds represented by General Formulas (F-1), (F-2), (F-3), (F-4) and (F-5).

General Formula (F-1)

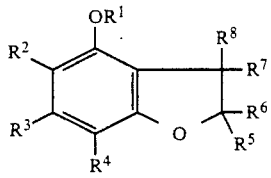

General Formula (F-2)

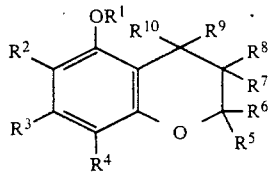

General Formula (F-3)

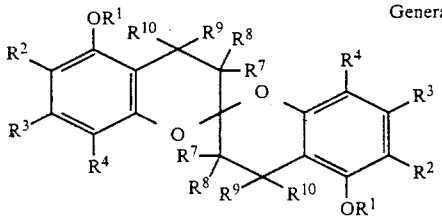

General Formula (F-4)

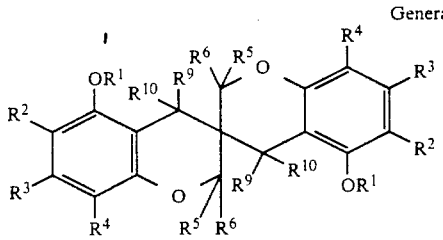

-continued

General Formula (F-5)

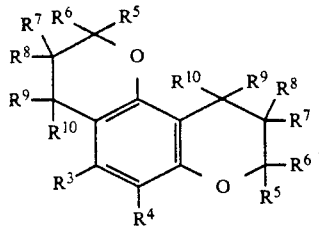

$R^1$, $R^2$, $R^3$ and $R^4$ in General Formulas (F-1) to (F-5) have the same meaning as those in the above General Formula (F), and $R^5$, $R^6$, $R^7$, $R^8$, $R^9$ and $R^{10}$ each represent a hydrogen atom, a halogen atom, an alkyl group, an alkoxy group, a hydroxyl group, an alkenyl group, an alkenyloxy group, an aryl group, an aryloxy group or a heterocyclic group.

Further, $R^5$ and $R^6$, $R^6$ and $R^7$, $R^7$ and $R^8$, $R^8$ and $R^9$, and $R^9$ and $R^{10}$ each may be cyclized each other to form a carbon ring, and such a carbon ring may be further substituted with an alkyl group.

Also, in General Formulas (F-3), (F-4) and (F-5), $R^1$ to $R^{10}$ in two of them each may be the same or different.

In the above General Formulas (F-1), (F-2), (F-3), (F-4) and (F-5), particularly useful compounds are those in which $R^1$, $R^2$ and $R^3$ are each a hydrogen atom, an alkyl group or a cycloalkyl group; $R^4$ is a hydrogen atom, an alkyl group, an alkoxy group, a hydroxyl group or a cycloalkyl group; and further, $R^5$, $R^6$, $R^7$, $R^8$, $R^9$ and $R^{10}$ are each a hydrogen atom, an alkyl group or a cycloalkyl group.

The compounds represented by General Formula (F) include the compounds disclosed in Tetrahedron Letters, 1970, Vol. 26, pp 4743–4751; Japan Chemical Society, 1972, No. 10, pp 1987–1990; Synthesis, 1975, Vol. 6, pp 392–393; and Bul. Soc. Chim. Belg, 1975, Vol. 84(7), pp 747–759, and may be synthesized by the methods disclosed in these publications.

General Formula (G)

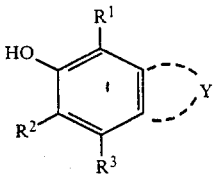

In the formula, $R^1$ and $R^3$ each represent a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group.

$R^2$ represents a hydrogen atom, a halogen atom, an alkyl group, an alkenyl group, a hydroxyl group, an aryl group, an acyl group, an acylamino group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^2$ and $R^3$ may be combined each other to form a 5- or 6-membered hydrocarbon ring. This 5- or 6-membered hydrocarbon ring may be substituted with a halogen atom, an alkyl group, a cycloalkyl group, an alkoxy group, an alkenyl group, a hydroxyl group, an aryl group, an aryloxy group or a heterocyclic group.

Y represents a group of atoms necessary for formation of an indane ring. The indane ring may be substituted with a halogen atom, an alkyl group, an alkenyl group, an alkoxy group, a cycloalkyl group, a hydroxyl group, an aryl group, an aryloxy group or a heterocyclic group, or may further form a spiro ring.

Of the compounds represented by General Formula (G), compounds most useful for this invention are included in the compounds represented by General Formulas (G-1) to (G-3).

General Formula (G-1)

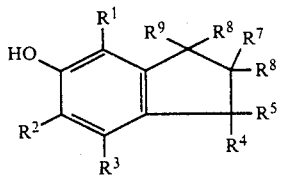

General Formula (G-2)

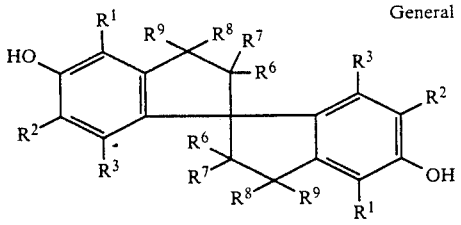

General Formula (G-3)

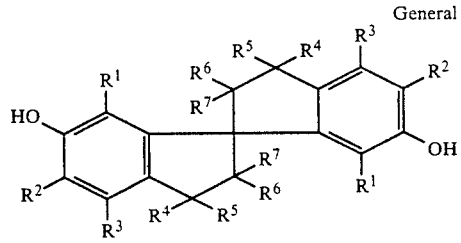

$R^1$, $R^2$ and $R^3$ in General Formulas (G-1) to (G-3) have the same meaning as those in the above General Formula (G), and $R^4$, $R^5$, $R^6$, $R^7$, $R^8$ and $R^9$ each represent a hydrogen atom, an alkyl group, an alkoxy group, an alkenyl gorup, a hydroxyl group, an aryl group, an aryloxy group or a heterocyclic group. $R^4$ and $R^5$, $R^5$ and $R^6$, $R^6$ and $R^7$, $R^7$ and $R^8$, and $R^8$ and $R^9$ each may be combined each other to form a hydrocarbon ring, and such a hydrocarbon ring may be further substituted with an alkyl group.

In the above General Formulas (G-1) to (G-3), particularly useful compounds are those in which $R^1$ and $R^3$ are each a hydrogen atom, an alkyl group, an alkoxy group, a hydroxyl group or a cycloalkyl group; $R^2$ is a hydrogen atom, an alkyl group, a hydroxyl group or a cycloalkyl group; and $R^4$, $R^5$, $R^6$, $R^7$, $R^8$ and $R^9$ are each a hydrogen atom, an alkyl group or a cycloalkyl group.

General Formula (H)

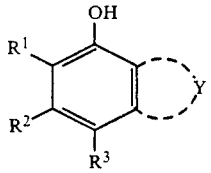

In the formula, $R^1$ and $R^2$ each represent a hydrogen atom, a halogen atom, an alkyl group, an alkenyl group, an aryl group, an acyl group, an acylamino group, an acyloxy group, a sulfonamide group, a cycloalkyl group or an alkoxycarbonyl group.

$R^3$ represents a hydrogen atom, a halogen atom, an alkyl group, an alkenyl group, an alkoxy group, a hydroxyl group, an aryl group, an aryloxy group, an acyl group, an acylamino group, an acyloxy group, a sulfonamide group, a cycloalkyl group or an alkoxycarbonyl group.

The above-mentioned groups each may be substituted with other substituent which may include, for example, an alkyl group, an alkenyl group, an alkoxy group, an aryl group, an aryloxy group, a hydroxyl group, an alkoxycarbonyl group, an aryloxycarbonyl group, an acylamino group, a carbamoyl group, a sulfonamide group, a sulfamoyl group, etc.

Also, $R^1$ and $R^2$, and $R^2$ and $R^3$ each may be combined each other to form a 5- or 6-membered hydrocarbon ring, and the hydrocarbon ring may be substituted with a halogen atom, an alkyl group, a cycloalkyl group, an alkoxyl group, an alkenyl group, a hydroxyl group, an aryl group, an aryloxy group or a heterocyclic group.

Y represents a group of atoms necessary for formation of an indane ring. The indane ring may be substituted with a group capable of substituting the above hydrocarbon ring, or may further form a spiro ring.

Of the compounds represented by General Formula (H), compounds most useful for this invention are included in the compounds represented by General Formulas (H-1) to (H-3).

General Formula (H-1)

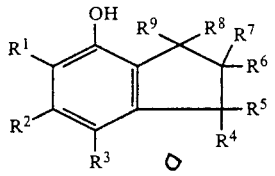

General Formula (H-2)

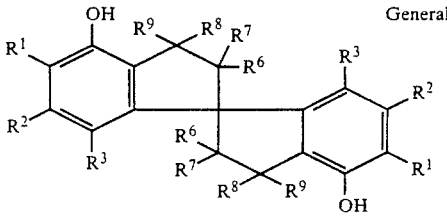

-continued

General Formula (H-3)

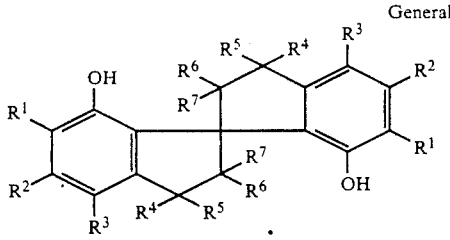

$R^1$, $R^2$ and $R^3$ in General Formulas (H-1) to (H-3) have the same meaning as those in the above General Formula (H), and $R^4$, $R^5$, $R^6$, $R^7$, $R^8$ and $R^9$ each represents a hydrogen atom, a halogen atom, an alkyl group, an alkoxy group, a hydroxyl group, an alkenyl group, an aryl group, an aryloxy group or a heterocyclic group. $R^4$ and $R^5$, $R^5$ and $R^6$, $R^6$ and $R^7$, $R^7$ and $R^8$, and $R^8$ and $R^9$ each may be ring-closed each other to form a hydrocarbon ring, and such a hydrocarbon ring may be further substituted with an alkyl group.

In the above General Formulas (H-1) to (H-3), particularly useful compounds are those in which $R^1$ and $R^2$ are each a hydrogen atom, an alkyl group or a cycloalkyl group; $R^3$ is a hydrogen atom, an alkyl group, an alkoxy group, a hydroxyl group or a cycloalkyl group; and $R^4$, $R^5$, $R^6$, $R^7$, $R^8$ and $R^9$ are each a hydrogen atom, an alkyl group or a cycloalkyl group.

Synthesis method of the above compounds represented by General Formula (H) is known, and they may be synthesized in accordance with U.S. Pat. No. 3,057,929; Chem. Bar., 1972, 95(5), pp 1673-1674; Chemistry Letters, 1980, pp 739-742.

General Formula (J)

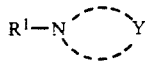

In the formula, $R^1$ represents an aliphatic group, a cycloalkyl group or an aryl group; and Y represents a group of nonmetal atoms necessary for forming a heterocyclic ring of 5 to 7 members together with a nitrogen atom; provided that, when two or more hetero atoms are present in the nonmetal atom containing a nitrogen atom for forming the heterocyclic ring, at least two hetero atoms are hetero atoms which are not contiguous to each other.

The aliphatic group represented by $R^1$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, ethenyl group, a propenyl group, etc.

The cycloalkyl group represented by $R^1$ may include a 5- to 7-membered cycloalkyl group which may have a substituent, which may include, for example, a cyclopentyl group, a cyclohexyl group, etc.

The aryl group represented by $R^1$ may include a phenyl group and a naphthyl group, which respectively may have a substituent.

The substituents for the aliphatic group, the cycloalkyl group and the aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic group, an alkylthio group, an arylthio group, etc., and these substituents may further have a substituent.

In the above General Formula (J), Y, which represents a group of nonmetal atoms necessary for forming a heterocyclic ring of 5 to 7 members together with a nitrogen atom, at least two of the nonmetal atoms containing a nitrogen atom for forming the heterocyclic ring must be hetero atoms, and this at least two hetero atoms must not be contiguous to each other. If, in the heterocyclic ring of the compound represented by General Formula (J), all of the hetero atoms are contiguous to each other, the performance as a magenta dye image stabilizing agent will not be attained, undesirably.

The above heterocyclic ring of 5 to 7 members of the compound represented by General Formula (J) may have a substituent, and the substituent may include an alkyl group, an aryl group, an acyl group, a carbamoyl group, an alkoxycarbonyl group, a sulfonyl group, a sulfamoyl group, etc., which may further have a substituent. Also, the heterocyclic ring of 5 to 7 members may be saturated, and a saturated heterocyclic ring is preferred. Further, a benzene ring, etc. may be condensed, or a spiro ring may be formed.

Of the compounds represented by General Formula (J), particularly preferable are piperazine type compounds and homopiperazine type compounds, and more preferably, they are the compounds represented by General Formula (J-1) or (J-2) shown below:

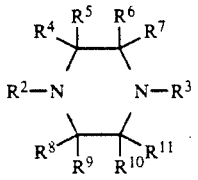

General Formula (J-1)

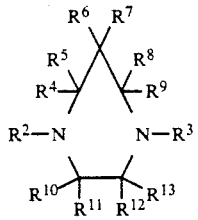

General Formula (J-2)

In the formulas, $R^2$ and $R^3$ each represent a hydrogen atom, an alkyl group or an aryl group, provided that $R^2$ and $R^3$ are not hydrogen atoms at the same time. $R^4$ to $R^{13}$ each represent a hydrogen atom, an alkyl group or an aryl group.

In the above General Formulas (J-1) and (J-2) wherein $R^2$ and $R^3$ each represent a hydrogen atom, an alkyl group or an aryl group, the alkyl group represented by $R^2$ or $R^3$ may include, for example, a methyl group, an ethyl group, a butyl group, an octyl group, a dodecyl group, a tetradecyl group, a hexadecyl group, an octadecyl group, etc. The aryl group represented by $R^2$ or $R^3$ may included a phenyl group, etc. The alkyl group and the aryl group represented by $R^2$ or $R^3$ may have a substituent, and the substituent may include a halogen atom, an alkyl group, an aryl group, an alkoxy group, an aryloxy group, a heterocyclic group, etc.

The sum of the number of the carbon atoms of $R^2$ and $R^3$ (including their substituents) is preferably 6 to 40.

In the above General Formulas (J-1) and (J-2), wherein $R^4$ to $R^{13}$ each represent a hydrogen atom, an alkyl group or an aryl group, the alkyl group represented by $R^4$ to $R^{13}$ may include, for example, a methyl group, an ethyl group, etc. The aryl group represented by $R^4$ to $R^{13}$ may include a phenyl group, etc.

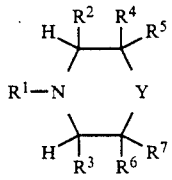

General Formula (K)

In the formula, $R^1$ represents an aliphatic group, a cycloalkyl group or an aryl group, and Y represents a simple bond arm or a divalent hydrocarbon group necessary for forming a heterocyclic ring of 5 to 7 members together with a nitrogen atom. $R^2$, $R^3$, $R^4$, $R^5$, $R^6$ and $R^7$ each represent a hydrogen atom, an aliphatic group, a cycloalkyl group or an aryl group. However, $R^2$ and $R^4$, and $R^3$ and $R^6$ each may be bonded to each other to form a simple bond arm to form an unsaturated heterocyclic ring of 5 to 7 members together with a nitrogen atom and Y. Also, when Y is a simple bond arm, $R^5$ and $R^7$ may be bonded to each other to form the simple bond arm to form an unsaturated heterocyclic ring of 5 to 7 members together with Y. When Y is not the simple bond arm, $R^5$ and Y, and $R^7$ and Y or Y itself may form unsaturated bonds to form an unsaturated heterocyclic ring of 6 or 7 members together with a nitrogen atom and Y.

The aliphatic group represented by $R^1$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, an ethenyl group, a propenyl group, etc.

The cycloalkyl group represented by $R^1$ may include a cycloalkyl group of 5 to 7 members which may have a substituent, for example, a cyclopentyl group, a cyclohexyl group, etc.

The aryl group represented by $R^1$ may include a phenyl group and a naphthyl group, each of which may have a substituent.

The substituents for the aliphatic group, the cycloalkyl group and the aryl group represented by $R^1$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic ring, an alkylthio group, an arylthio group, etc., and these substituents may further have a substituent.

In the above General Formula (K), wherein Y represents a simple bond arm or a divalent hydrocarbon group necessary for forming a heterocyclic ring of 5 to 7 members together with a nitrogen atom, and when Y is the simple bond arm, $R^5$ and $R^7$ may further be bonded to each other to form a simple bond arm to form an unsaturated heterocyclic ring of 5 members; when Y is the divalent hydrocarbon group, namely a methylene group, $R^5$ and Y, or $R^7$ and Y may form an unsaturated bond to form an unsaturated heterocyclic ring of 6 members, and when it is an ethylene group, $R^5$ and Y, $R^7$ and Y, or Y itself may form an unsaturated bond to form an unsaturated heterocyclic ring of 7 members. Further, the divalent hydrocarbon represented by Y may have a substituent, and such a substituent may include an alkyl group, a carbamoyl group, an alkyloxycarbonyl group, an acylamino group, a sulfonamide group, a sulfamoyl group, an aryl group, a heterocyclic group, etc.

In the above General Formula (K), wherein $R^2$, $R^3$, $R^4$, $R^5$, $R^6$ and $R^7$ each represent a hydrogen atom, an aliphatic group, a cycloalkyl group or an aryl group, the aliphatic group represented by $R^2$ to $R^7$ may include a saturated alkyl group which may have a substituent and an unsaturated alkyl group which may have a substituent. The saturated alkyl group may include, for example, a methyl group, an ethyl group, a butyl group, an octyl group, a dodecyl group, a tetradecyl group, a hexadecyl group, etc., and the unsaturated alkyl group may include, for example, an ethenyl group, a propenyl group, etc.

The cycloalkyl group represented by $R^2$ to $R^7$ may include a cycloalkyl group of 5 to 7 members which may have a substituent, for example, a cyclopentyl group, a cyclohexyl group, etc.

The aryl group represented by $R^2$ to $R^7$ may include a phenyl group and a naphthyl group, each of which may have a substituent.

The substituents for the aliphatic group, the cycloalkyl group and the aryl group represented by $R^2$ to $R^7$ may include an alkyl group, an aryl group, an alkoxy group, a carbonyl group, a carbamoyl group, an acylamino group, a sulfamoyl group, a sulfonamide group, a carbonyloxy group, an alkylsulfonyl group, an arylsulfonyl group, a hydroxyl group, a heterocyclic group, an alkylthio group, etc.

The compound represented by the above General Formula (K) is more preferable when it has a saturated heterocyclic ring of 5 to 7 members than when it has an unsaturated one.

As the anti-color-fading agent according to this invention, there can be used any compounds so far as they have the oxidation potential in the range mentioned above, but preferably used are water insoluble compounds in order for the effect of the invention to be sufficiently exhibited. The oxidation potential may be $0.95\ (V) \leqq Eox \leqq 1.50\ (V)$, but preferably $1.00\ (V) \leqq Eox \leqq 1.45\ (V)$, particularly preferably $1.00\ (V) \leqq Eox \leqq 1.40\ (V)$.

Specific compounds of the anti-color-fading agent according to this invention are shown below, but this invention is by no means limited to these compounds.

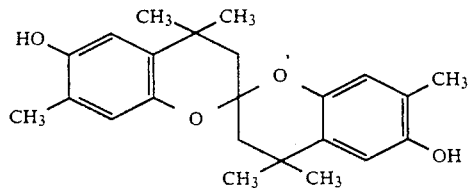
(AO-1)

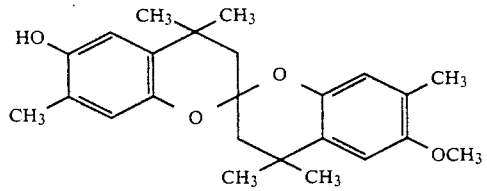
(AO-2)

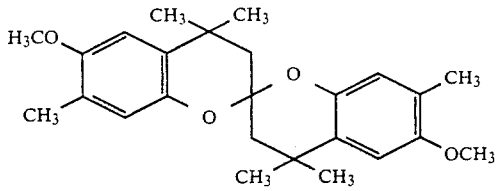
(AO-3)

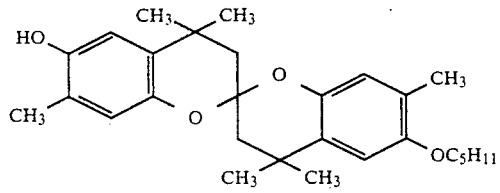
(AO-4)

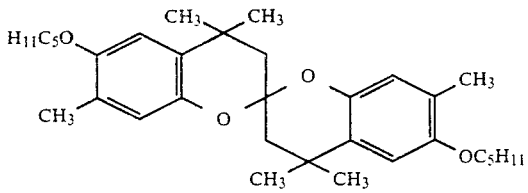
(AO-5)

-continued
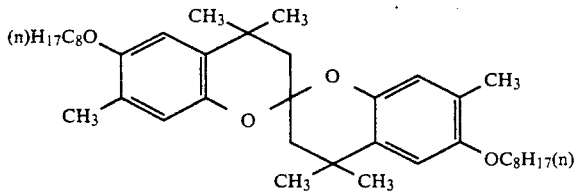
(AO-6)
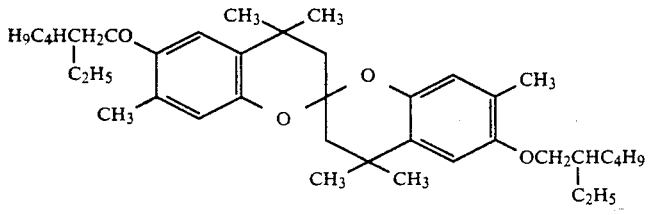
(AO-7)
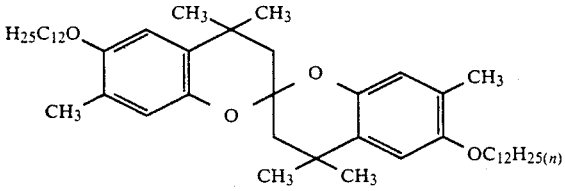
(AO-8)
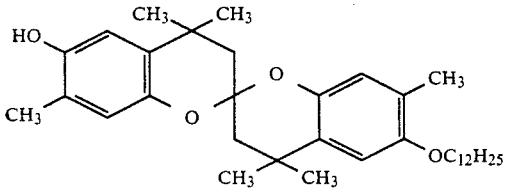
(AO-9)
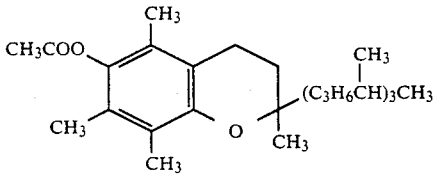
(AO-10)
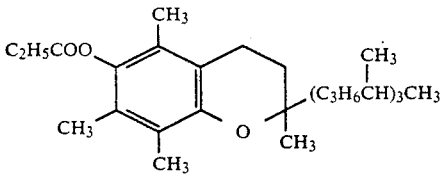
(AO-11)
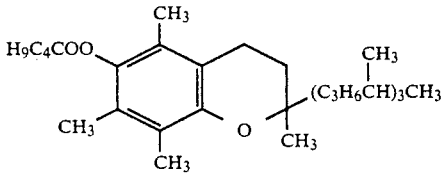
(AO-12)
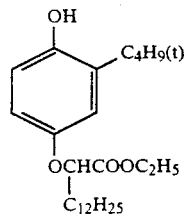
(AO-13)

-continued
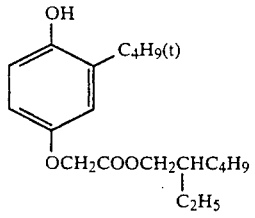
(AO-14)
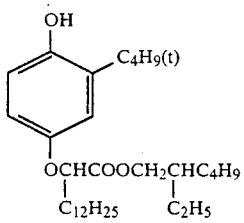
(AO-15)
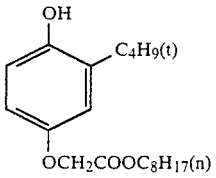
(AO-16)
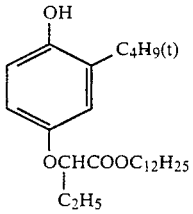
(AO-17)
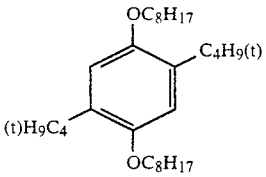
(AO-18)
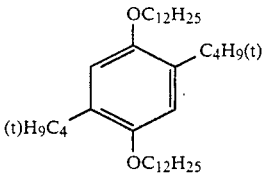
(AO-19)
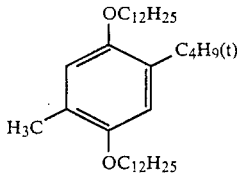
(AO-20)
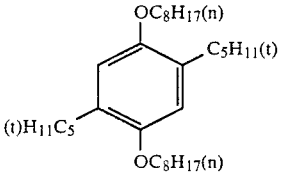
(AO-21)

-continued (AO-22)

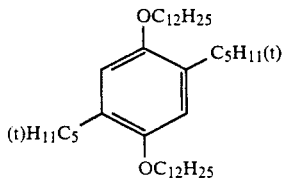

(AO-23)

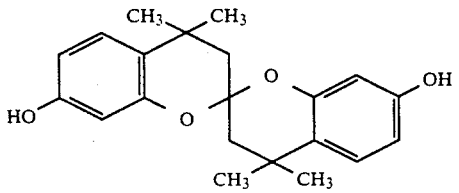

(AO-24)

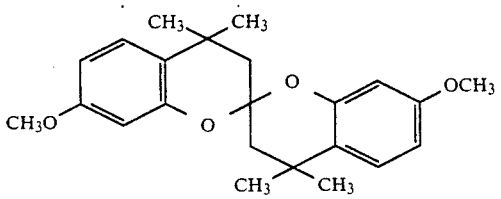

(AO-25)

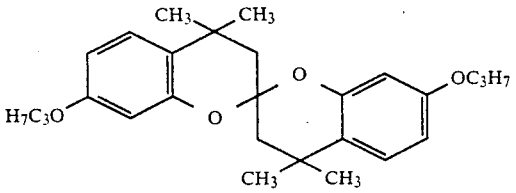

(AO-26)

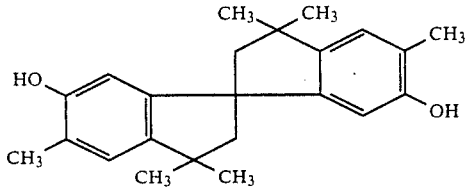

(AO-27)

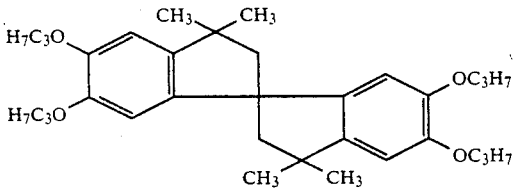

(AO-28)

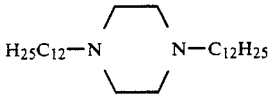

(AO-29)

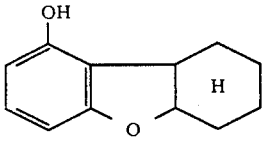

The anti-color-fading agent according to this invention is added to the silver halide emulsion layer containing the magenta coupler represented by the above General Formula (I). The anti-color-fading agent according to this invention may be added in any amount depending on the intended effect and the kind of the compound, but it can be used preferably in an amount of 0.05 mole to 3 moles, more preferably 0.1 mole to 2 moles, per 1 mole of the magenta coupler of the invention, represented by the above General Formula (I).

The hydroquinone derivative used in this invention will be described below.

In this invention, preferably usable hydroquinone derivative may include the compounds represented by General Formulas (XII) and (XIII) or precursors thereof.

General Formula (XII)

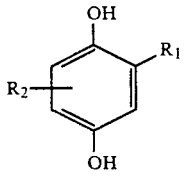

In the formula, $R^1$ and $R^2$ each represent an alkyl group (for example, a butyl group, a pentyl group, an octyl group, etc.), an aryl group (for example, a phenyl group, etc.), an alkenyl group (for example, a propenyl group, a butenyl group, etc.), a cycloalkyl group (for example, a cyclohexyl group, etc.) or a heterocyclic group (for example, cumarone, etc.). Each of these groups may also include those having a substituent, which may include an alkyl group, an aryl group, etc.

General Formula (XIII)

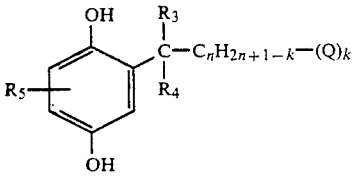

In the formula, $R^3$ and $R^4$ each represent an alkyl group having 1 to 5 carbon atoms (for example, a methyl group, a propyl group, a pentyl group, etc.); $R^5$ represents an alkyl group (for example, a methyl group, a pentyl group, a dodecyl group, etc.), an aryl group (for example, a phenyl group, etc.), an alkenyl group (for example, a propenyl group, a butenyl group, etc.), a cycloalkyl group (for example, a cyclohexyl group, etc.), a heterocyclic group (for example, cumarone, etc.), or a group of:

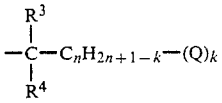

wherein n represents an integer of 1 to 20; k is 1 or 2; and Q represents a group of $-COXR^6$ [wherein X represents an oxygen atom or a group of:

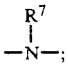

$R^6$ represents a hydrogen atom, an alkyl group (for example, a methyl group, a hexyl group, a dodecyl group, etc.), an alkenyl group (for example, a propenyl group, etc.), a cycloalkyl group (for example, a cyclohexyl group, etc.) or an aryl group (for example, a phenyl group, etc.); $R^7$ represents a hydrogen atom, an alkyl group (for example, a methyl group, etc.) or an aryl group (for example, a phenyl group, etc.); and each of these group may include one having a substituent.], a group of —OY (wherein Y represents $-R^6$ or $-COR^6$), a group of:

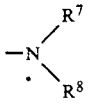

(wherein $R^8$ represents a hydrogen atom, an alkyl group, an aryl group, or $-COR^6$), a group of $-P(O)(OR^6)([O]lR^9)$ (wherein $R^9$ has the same meaning as defined for $R^6$ and l is 0 or 1), or a cyano group.

Of the hydroquinone derivatives included in the compound represented by General Formula (XII), more preferable are those included in the compound represented by General Formula (XII') shown below or precursors thereof.

General Formula (XII')

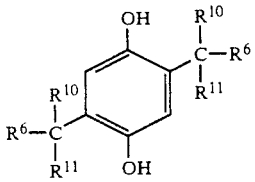

In the formula, $R^{10}$ and $R^{11}$ each represent a hydrogen atom or an alkyl group having 1 to 5 carbon atoms, $R^6$ has the same meaning as defined for $R^6$ in General Formula (XIII), provided, however, that $R^{10}$ and $R^{11}$ are not a hydrogen atom at the same time.

Also, of the hydroquinone derivatives included in the compound represented by General Formula (XIII), more preferable are those included in the compound represented by General Formula (XIII') shown below or precursors thereof.

General Formula (XIII')

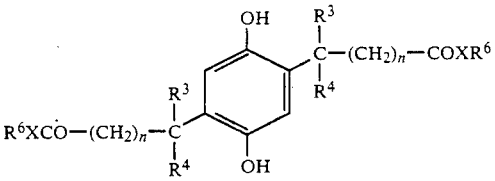

In the formula, $R^3$, $R^4$, $R^6$ and n have the same meaning as defined for $R^3$, $R^4$, $R^6$ and n in General Formula (XIII).

Specific examples of the hydroquinone derivatives according to this invention are shown below, but this invention is by no means limited by these.

(HQ-1)

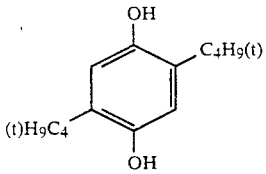

-continued
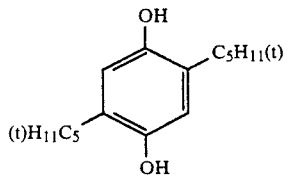
(HQ-2)
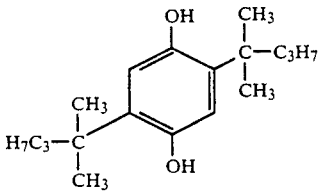
(HQ-3)
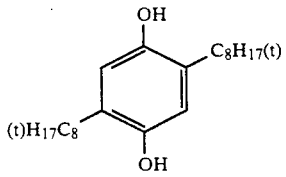
(HQ-4)
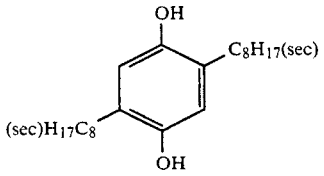
(HQ-5)
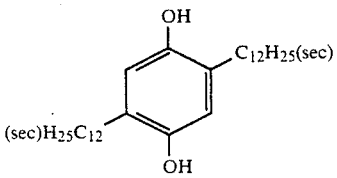
(HQ-6)
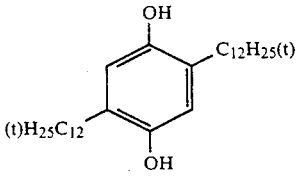
(HQ-7)
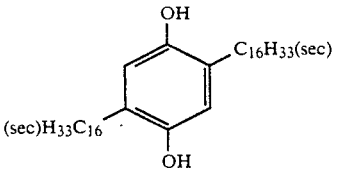
(HQ-8)
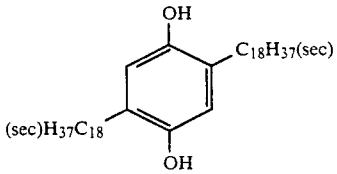
(HQ-9)
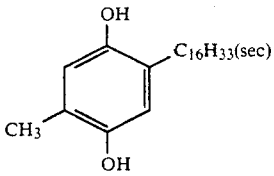
(HQ-10)

-continued
(HQ-11)
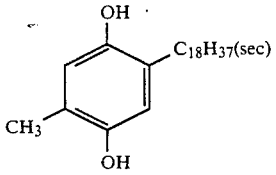
(HQ-12)
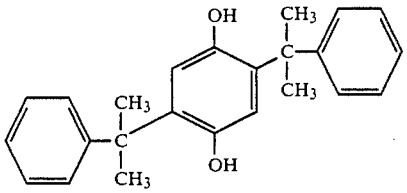
(HQ-13)
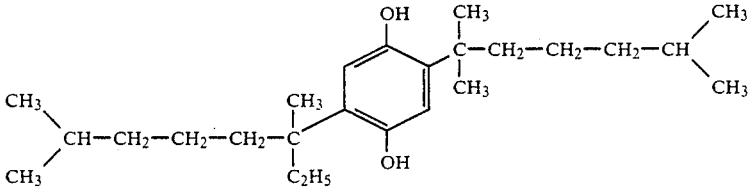
(HQ-14)
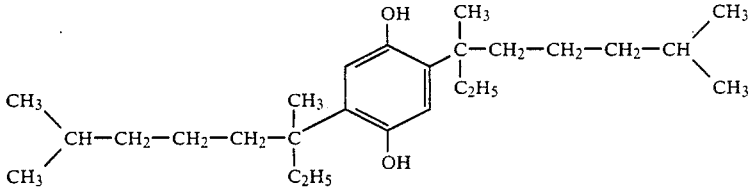
(HQ-15)
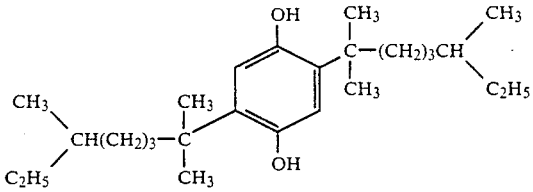
(HQ-16)
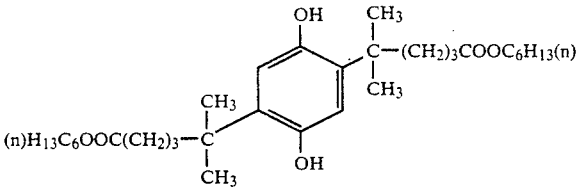
(HQ-17)
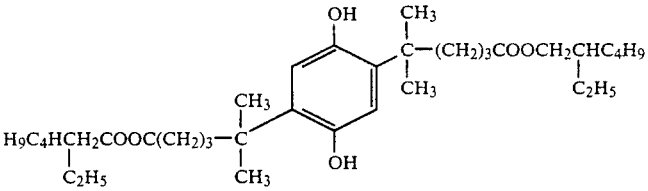
(HQ-18)
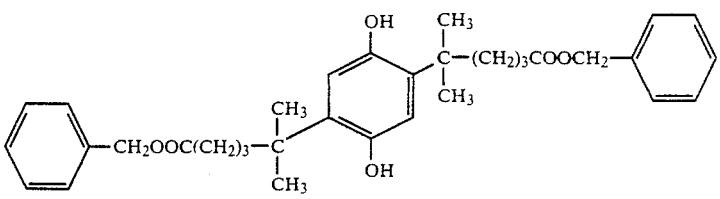

-continued
(HQ-19)
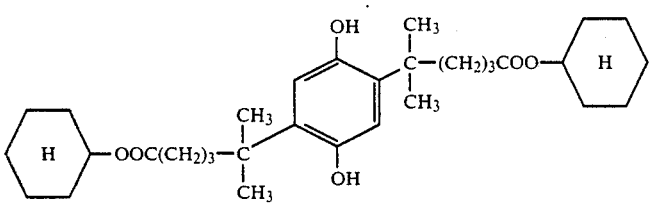
(HQ-20)
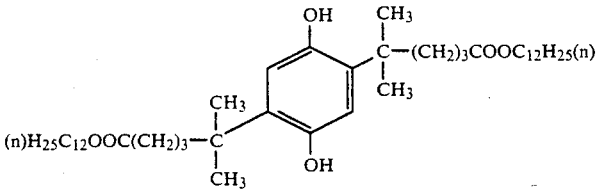
(HQ-21)
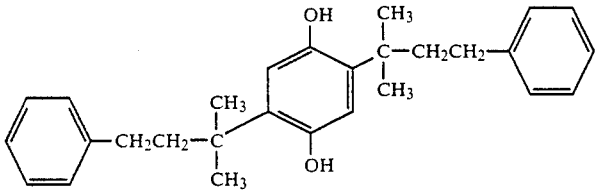
(HQ-22)
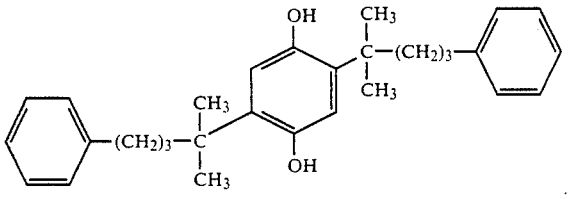
(HQ-23)
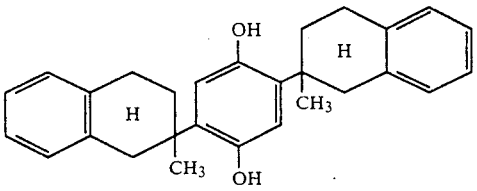
(HQ-24)
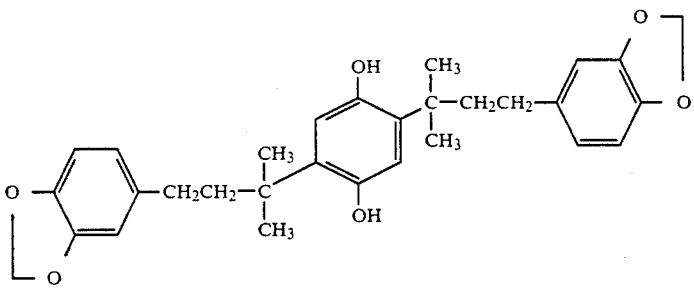
(HQ-25)
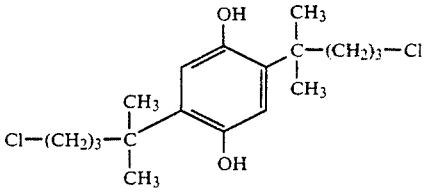

-continued

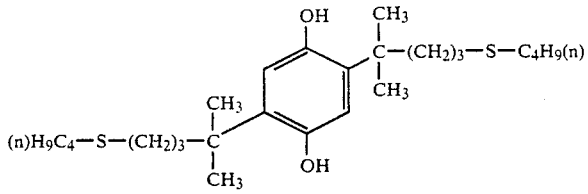

(HQ-26)

The hydroquinone derivative according to this invention may be used in any amount if added in the range of $1\times10^{-3}$ mole to 0.1 mole per 1 mole of the magenta coupler of this invention, represented by the above General Formula (I), but preferably in amount ranging between $5\times10^{-3}$ mole and 0.08 mole, particularly preferably $5\times10^{-3}$ mole and 0.05 mole. The hydroquinone derivative according to this invention may be added to the silver halide emulsion layer containing the magenta coupler represented by the above General Formula (I), and may be further added to a layer or layers adjacent thereto, without any inconvenience.

Conventionally, the above hydroquinone derivatives are disclosed as anti-staining agents, in Research Disclosure Vol. 176 (1978), No. 17643, Paragraph VII-I, Japanese Unexamined Patent Publication Nos. 24141/1983, 180557/1984 and 189342/1984, etc.

As the method of adding the magenta coupler, anti-color-fading agent and hydroquinone derivative according to this invention to a light sensitive silver halide photographic material, there can be used a variety of methods such as a solid dispersion method, a latex dispersion method and and an oil-in-water emulsification dispersion method, in the same manner as in the method generally carried out for adding hydrophobic compounds. This can be suitably selected depending on the chemical structure of the hydrophobic compounds such as couplers. As the oil-in-water emulsification dispersion method, a conventionally known method for dispersing hydrophobic additives such as couplers can be applied. Usually, the method may be carried out by dissolving the couplers in a high boiling organic solvent having a boiling point of 150° C. or more optionally together with a low boiling and/or water soluble organic solvent, and carrying out emulsification dispersion in a hydrophilic binder such as an aqueous gelatin solution by use of a surface active agent and by use of a dispersing means such as a stirrer, a homogenizer, a colloid mill, a flow jet mixer, an ultrasonic device, followed by adding the dispersion to an intended hydrophilic colloid layer. There may be inserted a step of removing the dispersing solution or, at the same time of the dispersion, the low boiling organic solvent.

The high boiling solvent to be used may include organic solvents having a boiling point of 150° C. or more such as phenol derivatives, phthalates, phosphates, citrates, benzoates, alkyl amides, aliphatic acid esters and trimesic acid esters which do not react with an oxidized product of a developing agent.

In this invention, the high boiling organic solvent which can be preferably used in dispersing the compounds such as the anti-color-fading agent and hydroquinone derivative according to this invention is a compound having a dielectric constant of 6.0 or less, including, for example, esters such as phthalates and phosphates, organic amides, ketones, hydrocarbon compounds, etc. having the dielectric constant of 6.0 or less. Preferred are high boiling organic solvents having a dielectric constant of not more than 6.0 and not less than 1.9, and having a vapor pressure of 0.5 mmHg or less at 100° C. More preferred are phthalates or phosphates among the above high boiling organic solvents. The high boiling organic solvent may also be a mixture of two or more kinds.

The dielectric constant mentioned in this invention refers to the dielectric constant at 30° C.

The phthalates that can be advantageously used in this invention may include the compound represented by General Formula (a) shown below:

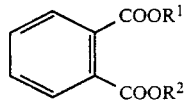

General Formula (a)

In the formula, $R^1$ and $R^2$ each represent an alkyl group, an alkenyl group or an aryl group, provided, however, that the sum of carbon atom numbers of the groups represented by $R^1$ and $R^2$ is 8 to 32. More preferably, the sum of the carbon atom numbers is 16 to 24.

In this invention, the alkyl group represented by $R^1$ and $R^2$ in the above General Formula (a) may be straight chain or branched one, including, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, etc. The ary group represented by $R^1$ and $R^2$ may include, for example, a phenyl group, a naphthyl group, etc.; the alkenyl group may include, for example, a hexenyl group, a heptenyl group, an octadecenyl group. These alkyl group, alkenyl group and aryl group may have a single or plural number of substituent(s), and the substituent for the alkyl group and the alkenyl group may include, for example, a halogen atom, an alkoxy group, an aryl group, an aryloxy group, an alkenyl group, an alkoxycarbonyl group, etc., and the substituent for the aryl group may include, for example, a halogen atom, an alkyl group, an alkoxy group, a an aryl group, an aryloxy group, an alkenyl group, an alkoxycarbonyl group, etc.

The phosphates that can be advantageously used in this invention may include those represented by General Formula (b) shown below:

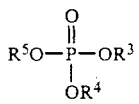

General Formula (b)

In the formula, $R^3$, $R^4$ and $R^5$ each represent an alkyl group, an alkenyl group or an aryl group, provided, however, that the sum of the carbon atom numbers of the groups represented by $R^3$, $R^4$ and $R^5$ is 24 to 54.

The alkyl group represented by $R^3$, $R^4$ and $R^5$ in General Formula (b) may include, for example, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, etc.; the aryl group may include, for example, a phenyl group, a naphthyl group, etc.; and the alkenyl group may include, for example, a hexenyl group, a heptenyl group, an octadecenyl group, etc.

These alkyl group, alkenyl group and aryl group may have a single or plural number of substituent(s). Preferably, $R^3$, $R^4$ and $R^5$ each reresent an alkyl group, including, for example, a 2-ethylhexyl group, a n-octyl group, a 3,5,5-trimethylhexyl group, a n-nonyl group, a n-decyl group, a sec-decyl group, a sec-dodecyl group, a t-octyl group, etc.

Typical examples of the organic solvents used in this invention are shown below, but this invention is by no means limited to these.

Exemplary organic solvents:

S-1

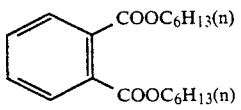

S-2

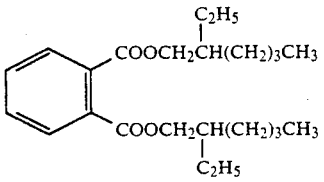

S-3

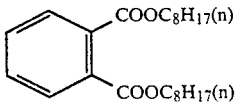

S-4

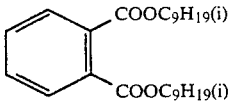

S-5

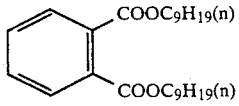

S-6

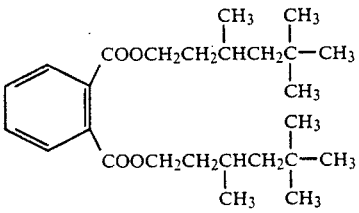

S-7

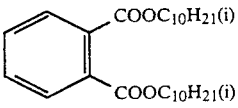

-continued

S-8

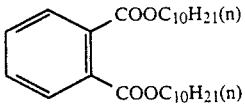

S-9

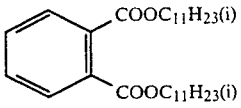

S-10

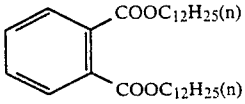

S-11

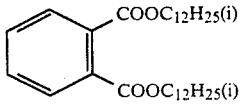

S-12

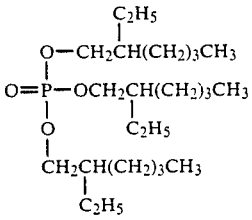

S-13

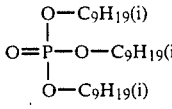

S-14

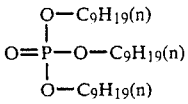

S-15

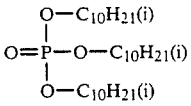

S-16

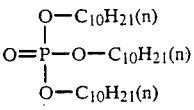

S-17

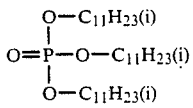

S-18

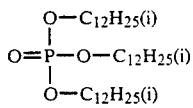

S-19

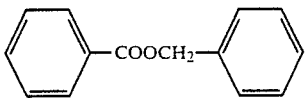

S-20

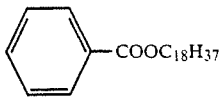

-continued

S-21

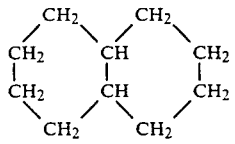

S-22

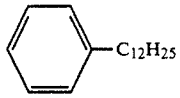

These organic solvents may be used generally in the proportion of 10 to 150% by weight based on the magneta coupler of this invention, and, preferably, 20 to 100% by weight based on the coupler.

As a dispersion auxiliary, used when dissolving the hydrophobic compounds such as couplers in a solvent comprising the organic solvent alone or the combination thereof with a low boiling solvent to effect dispersion in water by use of a mechanical or ultrasonic means, there can be used anionic surface active agents, nonionic surface active agents, and cationic surface active agents.

The light-sensitive silver halide photographic material of this invention includes, for example, color negative and positive films and color photographic papers, and the effect of this invention can be effectively exhibited when the color photographic papers for direct appreciation are used.

The light-sensitive silver halide photographic material including the color photographic papers may be those for either monocolor or multicolor. In the case of the multicolor light-sensitive silver halide photographic material, wherein the color reproduction is carried out by the subtractive color process, the photographic material usually has the construction comprising silver halide emulsion layers respectively containing magenta, yellow and cyan couplers as couplers for photography, and non-sensitive layers, laminated on a support with an appropriate number and order of layers. The number and order of the layers may be suitably changed depending on what performances are important and what purpose the materials are used for.

In the case where the light-sensitive silver halide photographic material is the multicolor light-sensitive silver halide photographic material, specific layer constitution is particularly preferably such that, from the support side, a yellow dye image forming layer, an intermediate layer, a magenta dye image forming layer, an intermediate layer, a cyan dye image forming layer, an intermediate layer and a protective layer are successively arranged on the support.

In the silver halide emulsion used in the light-sensitive silver halide photographic material of this invention, there can be used any of silver bromide, silver iodobromide, silver iodochloride, silver chlorobromide, silver chloride, etc. which are used in ordinary silver halide emulsions.

Silver halide grains used in the silver halide emulsions may be obtained by any of an acidic method, a neutral method and an ammoniacal method. The grains may be allowed to grow at one time, or grow after seed grains have been formed. The manner to prepare the seed grains and the manner to grow them may be same or different.

The silver halide emulsion may be obtained by simultaneously mixing halide ions and silver ions, or by preparing an aqueous solution in which either one of them is present and then mixing in it the other of them. Alternatively, taking into account the critical growth rate of silver halide crystals, it may be formed by successively simultaneously adding halide ions and silver ions while controlling pH and pAg in a mixing vessel. Halogen formulation in a grain may be varied after growth by employing a conversion method.

During the preparation of the silver halide emulsion of this invention, a silver halide solvent can be optionally used for controlling the grain size, grain shape, grain size distribution and grain growth rate, of the silver halide grains.

In the course of formation and/or growth of the silver halide grains used in the silver halide emulsion of this invention, metal ions may be added to the grains by use of at least one of a cadmium salt, a zinc salt, a lead salt, a thallium salt, an iridium salt or a complex salt thereof, a rhodium salt or a complex salt thereof, and an iron salt or a complex salt thereof to incorporate any of these metal elements into the inside of the grains and/or the surface of the grains, and also a reduction sensitizing nuclei can be imparted to the inside of the grains and/or the surface of the grains by placing the grains in a suitable reductive atmosphere.

The silver halide emulsion may be either one from which unnecessary soluble salts have been removed after completion of the growth of silver halide grains, or one from which they remain unremoved. When the salts are removed, they can be removed according to the method disclosed in Research Disclosure No. 17643.

The silver halide grains used in the silver halide emulsion of this invention may comprise uniform layers in the inside and the surface, or comprise different layers.

The silver halide grains used in the silver halide emulsion of this invention may be grains such that a latent image is formed chiefly on the surface, or grains such that a latent image is formed chiefly in the inside of a grain.

The silver halide grains used in the silver halide emulsion of this invention may be any of those having a regular crystal form, or those having an irregular crystal form such as a sphere and a plate. In these grains, there can be used those having any ratio of {100} face to {111} face. Also, they may have a composite form of these crystal forms, or comprise a mix of grains having various crystal forms.

The silver halide emulsion may be used by mixing tow or more kinds of silver halide emulsions which have been separately formed.

The silver halide emulsion can be chemically sensitized according to conventional methods. Namely, a sulfur sensitization method using a compound containing sulfur capable of reacting with silver ions, and active gelatin, a selenium sensitization method using a selenium compound, a reduction sensitization method using a reducing substance, and a noble metal sensitization method using noble metal compounds such as gold and so forth can be used alone or in combination.

The silver halide emulsion of this invention can be optically sensitized to a desired wavelength region by using a dye known as a sensitizing dye in the field of photography. The sensitizing dye may be used alone, or may be used in combination of two or more of the dye. Together with the sensitizing dye, a dye having itself no action of spectral sensitization, or a supersensitizing agent which is a compound substantially absorbing no visible light and capable of strengthening the sensitizing action of the sensitizing dye, may be contained in the emulsion.

To the silver halide emulsion of this invention, a compound known as an antifoggant or a stabilizer in the field of photography can be added during chemical ripening, and/or after completion of chemical ripening, and/or before coating of a silver halide emulsion after completion of chemical ripening, for the purpose of preventing a light-sensitive material from being fogged during production of light-sensitive materials, during preservation or during photographic processing, or for the purpose of keeping stable the photographic performances.

As a binder (or a protective colloid) for the silver halide emulsion of this invention, it is advantageous to use gelatin, but it is also possible to use hydrophilic colloids such as gelatin derivatives, a graft polymer of gelatin with other macromolecules, proteins, sugar derivatives, cellulose derivatives and synthetic hydrophilic high molecular substances such as homopolymer or copolymer.

Photographic emulsion layers and other hydrophilic colloid layers of the light-sensitive material in which the silver halide emulsion of this invention is used can be hardened by using one or more kinds of hardening agents that can crosslink binder (or protective colloid) molecules to enhance the film strength. The hardening agents can be added in such an amount that a light-sensitive material can be hardened to the extent that no hardening agent is required to be added in a processing solution. It, however, is also possible to add the hardening agent in the processing solution.

A plasticizer can be added to the silver halide emulsion layers and/or other hydrophilic colloid layers of the light-sensitive material, in which the silver halide emulsions of this invention are used, for the purpose of enhancing flexibility.

For the purpose of improving dimensional stability and the like, a dispersion (latex) of a water insoluble or hardly soluble synthetic polymer can be contained in the photographic emulsion layers and other hydrophilic colloid layers in which the silver halide emulsions of this invention are used.

In a color development processing, a dye-forming coupler capable of forming a dye through a coupling reaction with an oxidized product of an aromatic primary amine developing agent (for example, p-phenylenediamine derivatives, aminophenol derivatives, etc.) is used in the emulsion layers of the light-sensitive material of this invention. In a usual case, the dye forming coupler is selected in the manner that there can be formed a dye capable of absorbing light-sensitive spectral light in an emulsion layer with respect to the respective emulsion layers, and thus a yellow dye-forming coupler is used in a blue-sensitive emulsion layer; a magenta dye-forming coupler, in a green-sensitive emulsion layer; and a cyan dye-forming coupler, in a red-sensitive emulsion layer. However, the light-sensitive silver halide color photographic material may be prepared by using the couplers in the manner different from the above combination, depending on the purpose.

The cyan dye-forming coupler used in this invention may typically include four equivalent type or two equivalent type phenol or naphthol cyan dye-forming couplers, and Specific examples are disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, and 3,839,044; British Patent Nos. 478,991, 945,542, 1,084,480, 1,377,237, 1,388,024 and 1,543,040; Japanese Unexamined Patent Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979 and 32071/1980; etc.

Cyan couplers used in this invention may preferably further include those represented by General Formula (C-1) and (C-2) shown below:

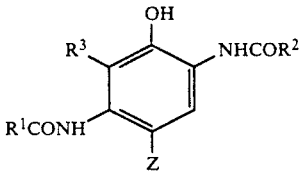

General Formula (C-1)

In the formula, $R^1$ represents an alkyl group or an aryl group. $R^2$ represents an alkyl group, a cycloalkyl group, an aryl group or a heterocyclic group. $R^3$ represents a hydrogen atom, a halogen atom, an alkyl group or an alkoxy group. $R^3$ may be linked with $R^1$ to form a ring. Z represents a hydrogen atom or a group eliminable through the reaction with an oxidized product of an aromatic primary amine type color developing agent.

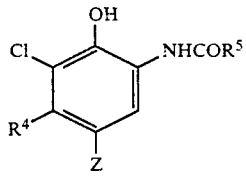

General Formula (C-2)

In the formula, $R^4$ represents a straight chain or branched alkyl group having 1 to 4 carbon atoms, and $R^5$ represents a ballast group. Z has the same meaning as defined for Z in General Formula (C-1). Particularly preferably $R^4$ represents a straight chain or branched alkyl group having 2 to 4 carbon atoms.

In this invention, the alkyl group represented by $R^1$ in General Formula (C-1) is straight chain or branched one, including, for example, a methyl group, an ethyl group, an iso-propyl group, a butyl group, a pentyl group, an octyl group, a nonyl group, a tridecyl group, etc., and the aryl group include, for example, a phenyl group, a naphthyl group, etc. These groups represented by $R^1$ may include those having a single or plural number of substituent(s), and the substituent(s) introduced, for example, in the phenyl group may typically include halogen atoms (for example, atoms of fluorine, chlorine, bromine, etc.), alkyl groups (for example, a methyl group, an ethyl group, a propyl group, a butyl group, a dodecyl group, etc.), hydroxyl groups, cyano groups, nitro groups, alkoxy groups (for example, a methoxy group and an ethoxy group), alkylsulfonamide groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), aminosulfonamide groups (for example, N,N-dimethylaminosulfonamide group, etc.), acylamino groups, carbamoyl groups, sulfonyl groups, sulfinyl groups, sulfoxy group, sulfo groups, aryloxy groups, alkoxy groups, carboxyl groups, alkylcarbonyl groups, arylcarbonyl groups, etc.

Two or more of these substituents may be introduced in the phenyl group.

The halogen atom represented by $R^3$ may include, for example, a fluorine atom, a chlorine atom, a bromine atom, etc.; the alkyl group may include, for example, a methyl group, an ethyl group, a propyl group, a butyl group, a dodecyl group, etc.; and the alkoxy group may include, for example, a methoxy group, an ethoxy group, a propyloxy group, a butoxy group, etc. $R^3$ may be linked with $R^1$ to form a ring.

In this invention, the alkyl group represented by $R^2$ in General Formula (C-1) includes, for example, a methyl group, an ethyl group, a butyl group, a hexyl group, tridecyl group, a pentadecyl group, a heptadecyl group, a so called polyfluoroalkyl group which is a group substituted with a fluorine atom, etc.

The aryl group represented by $R^2$ includes, for example, a phenyl group and naphthyl group and preferably includes a phenyl group. The heterocyclic group represented by $R^2$ includes, for example, a pyridyl group, a furan group, etc. The cycloalkyl group represented by $R^2$ includes, for example, a cyclopropyl group, a cyclohexyl group, etc. These groups represented by $R^2$ may include those having a single or plural number of substituent(s), and the substituent(s) introduced, for example, in the phenyl group may typically include halogen atoms (for example, atoms of fluorine, chlorine, bromine, etc.), alkyl groups (for example, a methyl group, an ethyl group, a propyl group, a butyl group, a dodecyl group, etc.), hydroxyl groups, cyano groups, nitro groups, alkoxy groups (for example, a methoxy group and an ethoxy group), alkylsulfonamide groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), aminosulfonamide groups (for example, N,N-dimethylaminosulfonamide group, etc.), acylamino groups, carbamoyl groups, sulfonyl groups, sulfinyl groups, sulfoxy group, sulfo groups, aryloxy groups, alkoxy groups, carboxyl groups, alkylcarbonyl groups, arylcarbonyl groups, etc. Two or more of these substituents may be introduced in the phenyl group.

The group represented by $R^9$ may preferably include a polyfluoroalkyl group, a phenyl group, or a phenyl group having as a substituent one or more of a halogen atom, an alkyl group, an alkoxy group, an alkylsulfonamide group, an arylsulfonamide group, an alkylsulfamoyl group, an arylsulfamoyl group, an alkylsulfonyl group, an arylsulfonyl group, an alkylcarbonyl group, an arylcarbonyl group and a cyano group.

The cyan couplers represented by the above General Formula (C-1) and preferably used in this invention, may further preferably include those represented by General Formula (C-3) shown below.

General Formula (C-3)

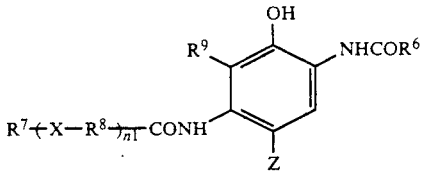

In General Formula (C-3), $R^6$ represents a phenyl group. This phenyl group may include one having a single or plural number of substituent(s), and the substituent(s) introduced therein may typically include halogen atoms (for example, atoms of fluorine, chlorine, bromine, etc.), alkyl groups (for example, a methyl group, an ethyl group, a propyl group, a butyl group, a dodecyl group, etc.), hydroxyl groups, cyano groups, nitro groups, alkoxy groups (for example, a methoxy group and an ethoxy group), alkylsulfonamide groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), etc. Two or more of these substituents may be introduced in the phenyl group.

The group represented by $R^6$ may preferably include a phenyl group, or a phenyl group having as a substituent one or more of a halogen atom (preferably fluorine, chlorine or bromine), an alkylsulfonamide group (preferably an o-methylsulfonamide group, a p-octylsulfonamide group or an o-dodecylsulfonamide group), an arylsulfonamide group (preferably a phenylsulfonamide group), an alkylsulfamoyl group (preferably a butylsulfamoyl group), an arylsulfamoyl group (preferably a phenylsulfamoyl group), an alkyl group (preferably a methyl group or trifluoromethyl group) and an alkoxy group (preferably a methoxy group or an ethoxy group).

$R^7$ is an alkyl group or an aryl group. The alkyl group or the aryl group may include those having a single or plural number of substituent(s), and the substituent(s) therefor may typically include halogen atoms (for example, fluorine, chlorine, bromine, etc.), hydroxyl groups, carboxyl groups, alkyl groups (for example, a methyl group, an ethyl group, a propyl group, a butyl group, a dodecyl group, a benzyl group, etc.), cyano groups, nitro groups, alkoxy groups (for example, a methoxy group and an ethoxy group), aryloxy group, alkylsulfonamide groups (for example, a methylsulfonamide group, an octylsulfonamide group, etc.), arylsufonamide groups (for example, a phenylsulfonamide group, a naphthylsulfonamide group, etc.), alkylsulfamoyl groups (for example, butylsulfamoyl group, etc.), arylsufamoyl groups (for example, a phenylsulfamoly group, etc.), alkyloxycarbonyl groups (for example, a methyloxycarbonyl group, etc.), aryloxycarbonyl groups (for example, a phenyloxycarbonyl group, etc.), aminosulfonamide groups (for example, dimethylaminosulfonamide group, etc.), alkylsulfonyl groups, arylsulfonyl groups, alkylcarbonyl groups, arylcarbonyl groups, aminocarbonylamide groups, carbamoyl groups, sulfinyl groups, etc. Two or more of these substituents may be introduced.

The group represented by $R^7$ may preferably include an alkyl group when $n^1=0$, or an aryl group when $n^1=1$ or more. The group represented by $R^7$ may further preferably include an alkyl group having 1 to 22 carbon atoms when $n^1=0$ (preferably a methyl group, an ethyl group, a propyl group, a butyl group, an octyl group or a dodecyl group), or, when $n^1=1$ or more, an unsubstituted phenyl group or a phenyl group having as a substituent one or more of an alkyl group (preferably a t-butyl group, a t-amyl group or an octyl group), an alkylsulfonamide group (preferably a butylsulfonamide group, an octylsulfonamide group or a dodecylsulfonamide group), an arylsulfonamide group (preferably a phenylsulfonamide group), an aminosulfonamide group (preferably a dimethylaminosulfonamide group) and an alkyloxycarbonyl group (preferably a methyloxycarbonyl group or a butyloxycarbonyl group).

$R^8$ represents an alkylene group, preferably a straight chain or branched alkylene group having 1 to 20 carbon atoms, more preferably 1 to 12 carbon atoms.

$R^9$ represents a hydrogen atom or a halogen atom (fluorine, chlorine, bromine or iodine). Preferably, it is a hydrogen atom.

$n^1$ is 0 or a positive integer, preferably 0 or 1.

X represents a divalent group of a group of —O—, —CO—, —COO—, —OCO—, —$SO_2NR'$—, —NR'-'$SO_2NR'''$—, —S—, —SO— or —$SO_2$— (herein, R', R'' and R''' each represent an alkyl group and include those having a substituent). Preferably, X is a group of —O—, —S—, —SO— or —$SO_2$.

Z has the same meaning as defined for Z in General Formula (C-1).

In this invention, the straight chain or branched alkyl group having 1 to 4 carbon atoms, represented by the above General Formula (C-2) is, for example, an ethyl group, a propyl group, a butyl group, an iso-propyl group, an iso-butyl group, a sec-butyl group or a tert-butyl group, and may include those having a substituent. The substituent may include an acylamino group (for example, an acetylamino group), an alkoxy group (for example a methoxy group), etc.

Preferably, $R^4$ is an alkyl group having 2 to 4 carbon atoms.

The ballast group represented by $R^5$ is an organic group having the size and shape that can give to a coupler molecule the bulk sufficient for making it substantially impossible for the coupler to be diffused to other layer from a layer to which the coupler is applied.

Typical ballast group may include an alkyl group having 8 to 32 carbon atoms in total, or an aryl group.

These alkyl group or aryl group may include those having a substituent. The substituent for the aryl group may include, for example, an alkyl group, an aryl group, an alkoxy group, an aryloxy group, a carboxyl group, an acyl group, an ester group, a hydroxyl group, a cyano group, a nitro group, a carbamoyl group, a carbonamide group, an alkylthio group, an arylthio group, a sulfonyl group, a sulfonamide group, a sulfamoyl group and a halogen atom. Also, the substituent for the alkyl group may include the substituents set forth for the above aryl group, except an alkyl group.

Particularly preferable ballast group may include the compound represented by General Formula (C-4) shown below.

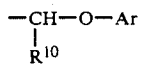

General Formula (C-4)

$R^{10}$ represents a hydrogen atom or an alkyl group having 1 to 12 carbon atoms, Ar represents an aryl group such as a phenyl group, and the aryl group may include one having a substituent. The substituent may include an alkyl group, a hydroxyl group, an alkylsulfonamide group, etc., and most preferable one includes a branched alkyl group such as t-butyl group.

In General Formulas (C-1) and (C-2), the groups eliminable through the reaction with an oxidized product of an aromatic primary amine type color developing agent, each represented by Z, may include those known to a person skilled in the art, and also those which may advantageously act as modifying the reactivity of a coupler, or being eliminated from a coupler to achieve functions such as development restraint, bleach restraint and color correction in the coated layers containing the coupler or other layers in a light-sensitive silver halide color photographic material. Typically, they may include, for example, a halogen atom typified by chlorine and fluorine, an alkoxy group, an aryloxy group, an arylthio group, a carbamoyloxy group, an acyloxy group, a sulfonyloxy group, a sulfonamide group, or a heteroylthio group, a hetroyloxy group, etc. Z is particularly preferably a hydrogen atom or a chlorine atom.

More specifically, they are disclosed in Japanese Unexamined Patent Publications Nos. 10135/1975, 120334/1975, 130441/1975, 48237/1979, 146828/1976, 14736/1979, 37425/1972, 123341/1975 and 95346/1983; Japanese Patent Publications No. 36894/1973; U.S. Pat. Nos. 3,476,563, 3,737,316 and 3,227,551.

Typical examples of the cyan couplers represented by General Formula (C-1) are shown below, but by no means limited to these.

C-1

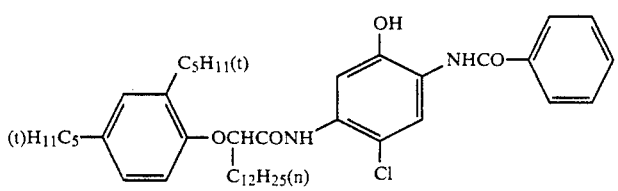

-continued
C-2
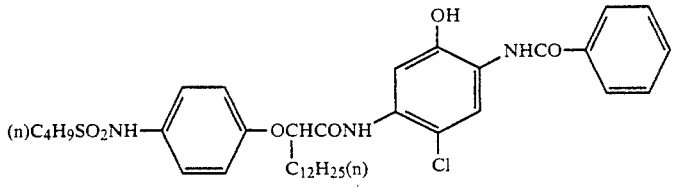
C-3
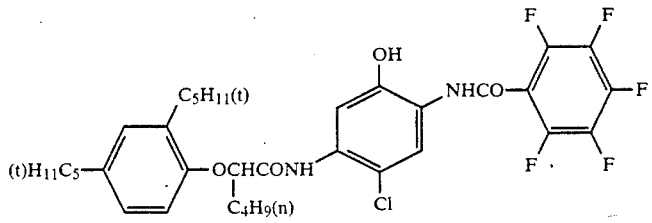
C-4
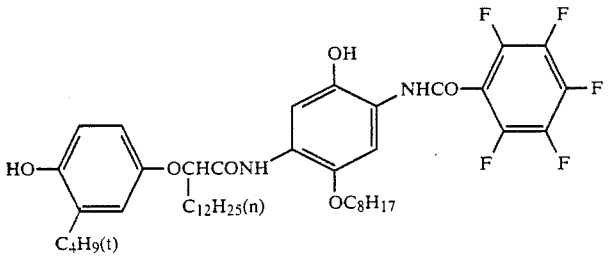
C-5
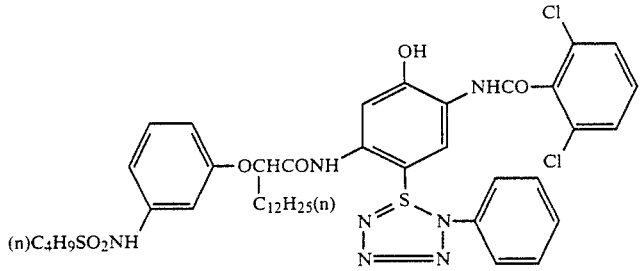
C-6
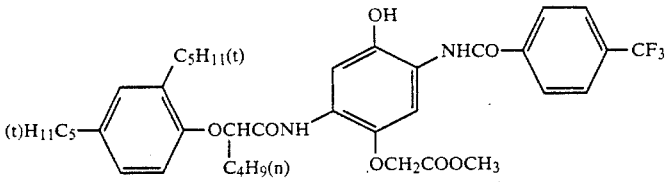
C-7
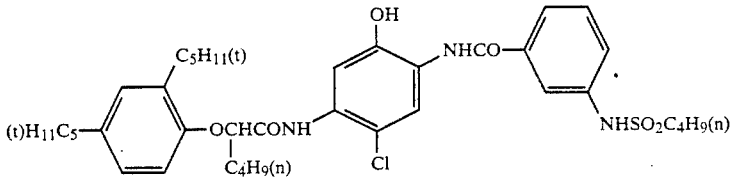
C-8
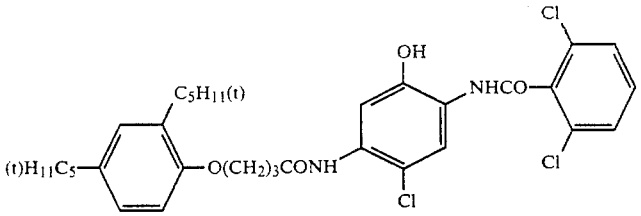

-continued
C-9
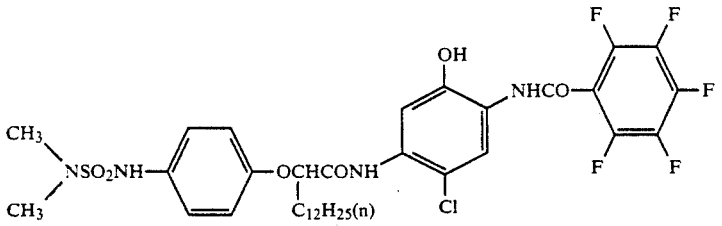
C-10
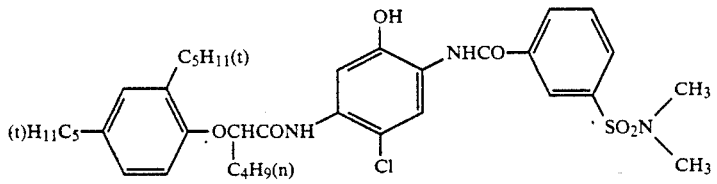
C-11
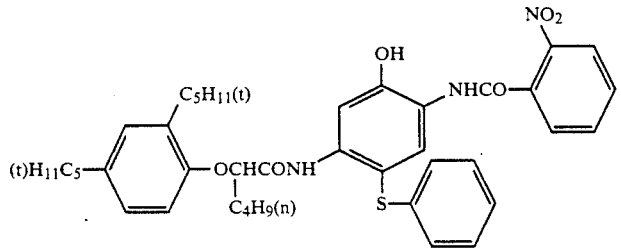
C-12
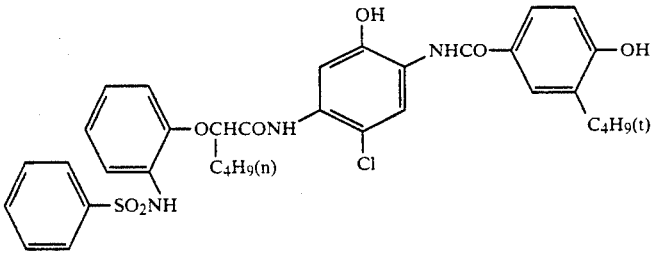
C-13
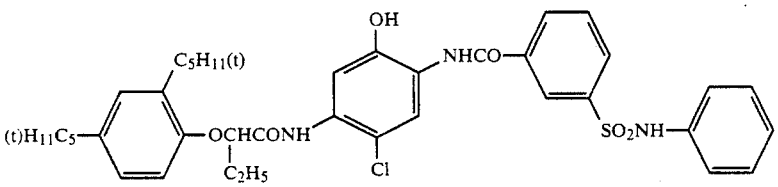
C-14
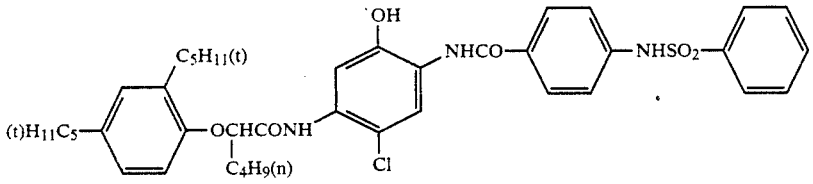
C-15
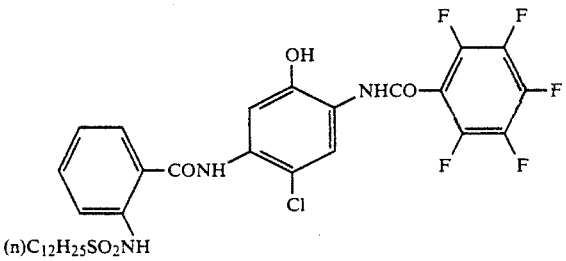

-continued
C-16
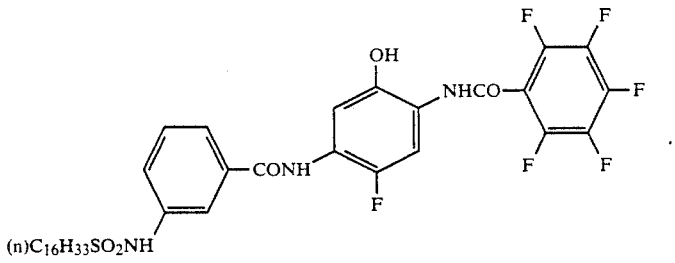
C-17
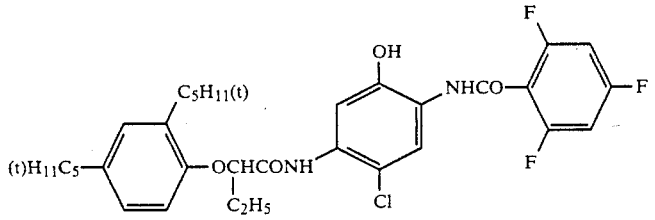
C-18
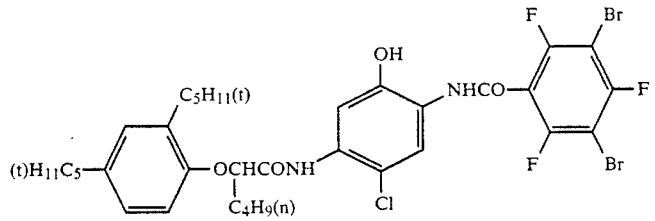
C-19
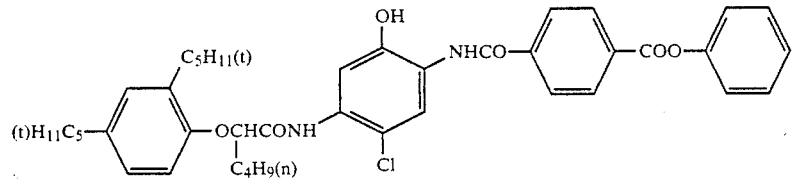
C-20
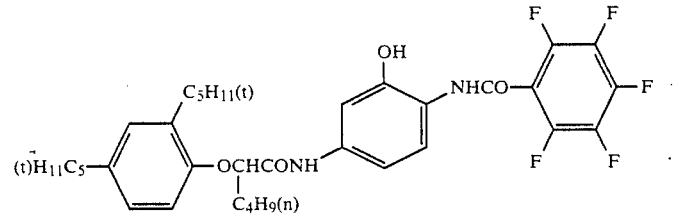
C-21
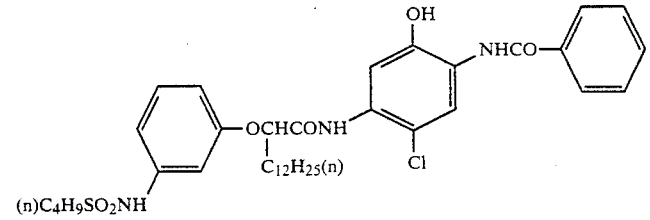
C-22
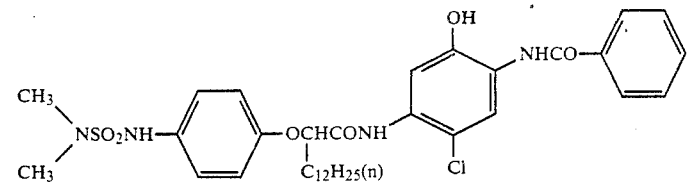

-continued
C-23
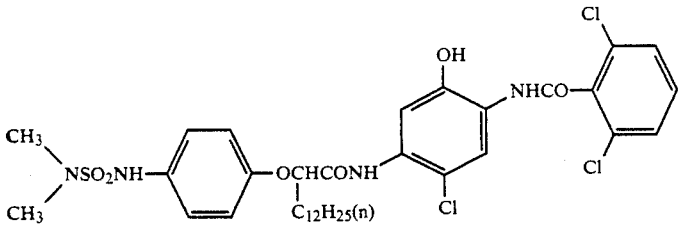
C-24
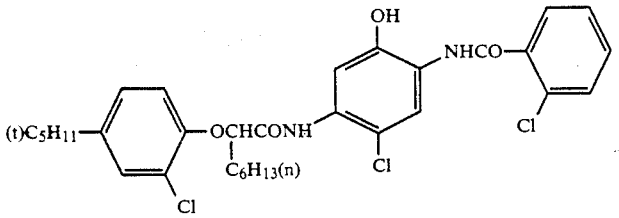
C-25
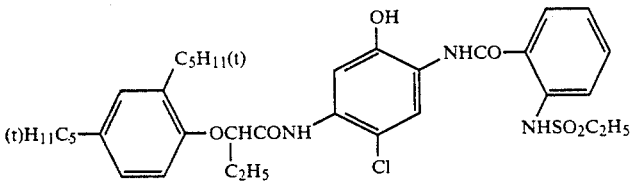
C-26
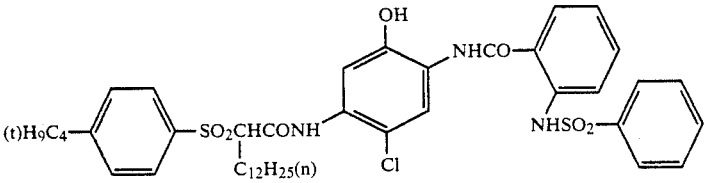
C-27
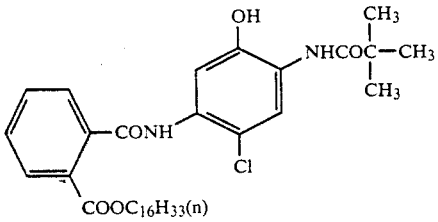
C-28
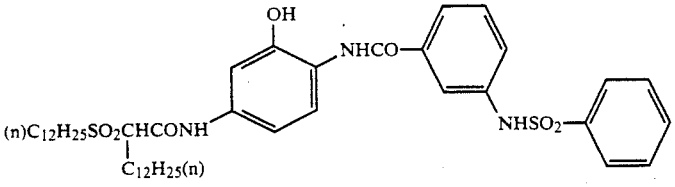
C-29
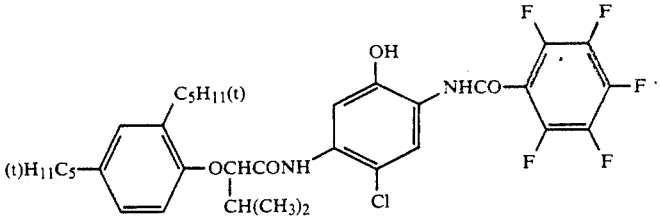

-continued
C-30
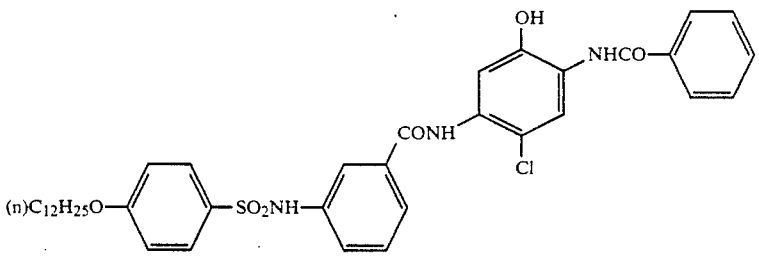
C-31
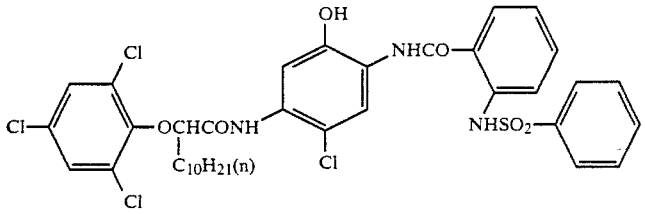
C-32
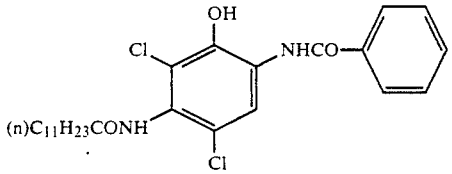
Typical examples of the cyan couplers represented by General Formula (C-2) are shown below, but by no means limited to these.
General Formula (C-2)
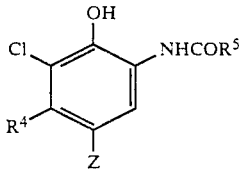
| Coupler No. | $R^4$ | Z | $R^5$ |
|---|---|---|---|
| C-33 | $-C_2H_5$ | $-Cl$ | 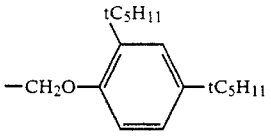 |
| C-34 | $-C_2H_5$ | 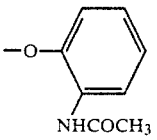 | 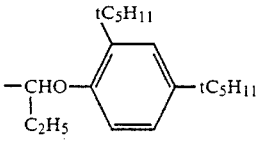 |
| C-35 | 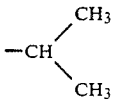 | $-Cl$ | 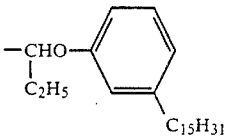 |

-continued
General Formula (C-2)
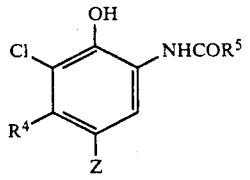
| Coupler No. | $R^4$ | Z | $R^5$ |
|---|---|---|---|
| C-36 | $-C_2H_5$ | $-Cl$ | 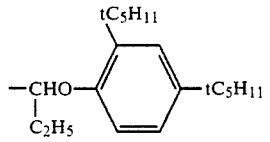 |
| C-37 | $-C_2H_5$ | $-Cl$ | 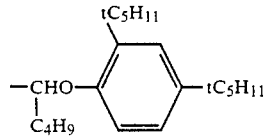 |
| C-38 | $-C_4H_9$ | $-F$ | 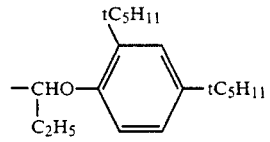 |
| C-39 | $-C_2H_5$ | $-F$ | 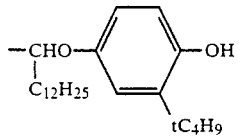 |
| C-40 | $-C_2H_5$ | $-Cl$ | 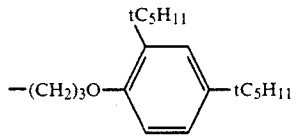 |
| C-41 | $-C_2H_5$ | $-F$ | 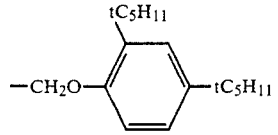 |
| C-42 | $-CH_3$ | $-Cl$ | 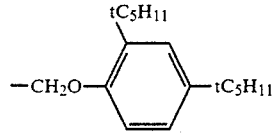 |
| C-43 | $-C_2H_5$ | $-Cl$ | 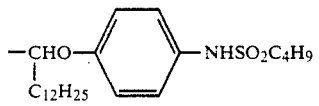 |
| C-44 | $-C_2H_5$ | $-Cl$ | 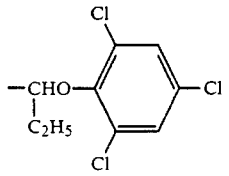 |
| C-45 | $-CH(CH_3)_2$ | $-Cl$ | $-C_{18}H_{37}$ |

-continued
General Formula (C-2)
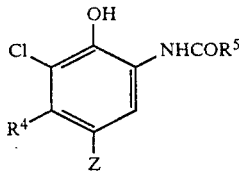
| Coupler No. | $R^4$ | Z | $R^5$ |
|---|---|---|---|
| C-46 | $-C_2H_5$ | $-F$ | 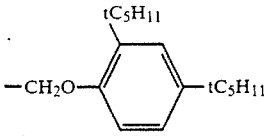 |
| C-47 | $-CH_3$ | $-Cl$ | 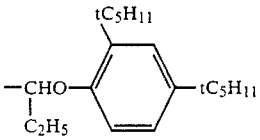 |
| C-48 | $-C_2H_5$ | $-Cl$ | 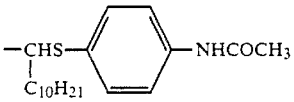 |
| C-49 | $-C_3H_7$ | $-Cl$ | 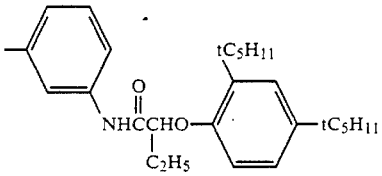 |
| C-50 | $-C_3H_7$ | $-Cl$ | 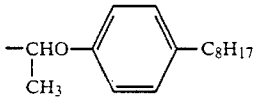 |
| C-51 | $-C_2H_4NHCCH_3$ ‖ O | $-Cl$ | 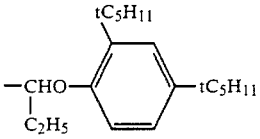 |
| C-52 | $-C_3H_6OCH_3$ | $-Cl$ | 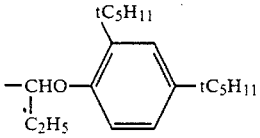 |
| C-53 | $-C_2H_5$ | $-Cl$ | 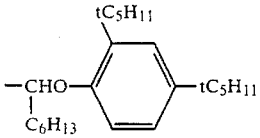 |
| C-54 | $-C_2H_5$ | $-Cl$ | 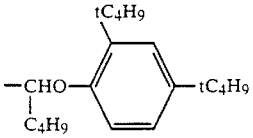 |

-continued
General Formula (C-2)
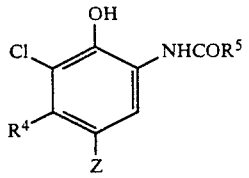
| Coupler No. | $R^4$ | Z | $R^5$ |
|---|---|---|---|
| C-55 | $-CH(CH_3)_2$ | $-Cl$ | 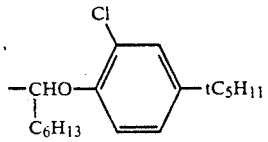 |
| C-56 | $-C_2H_5$ | $-Cl$ | 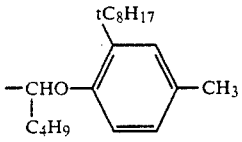 |
| C-57 | $-C_2H_5$ | $-Cl$ | 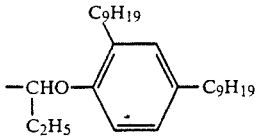 |
| C-58 | $-C_4H_9$ | $-OCH_2CH_2SO_2CH_3$ | 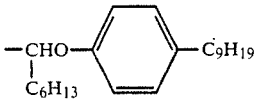 |
| C-59 | $-C_2H_5$ | $-Cl$ | 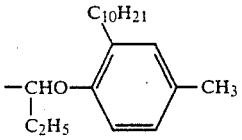 |
| C-60 | $-C_4H_9$ | 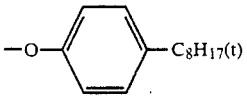 | 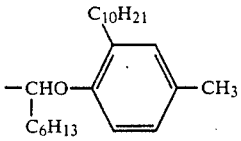 |
| C-61 | $-C_2H_5$ | $-Cl$ | 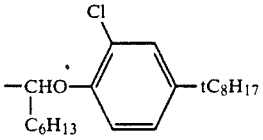 |
| C-62 | $-C_2H_5$ | $-OCH_2CH_2SCH(C_2H_5)COOH$ | 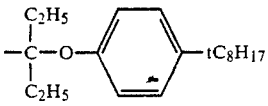 |
| C-63 | $-C_2H_5$ | $-Cl$ | 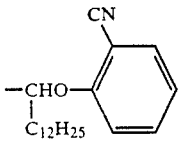 |

-continued

General Formula (C-2)

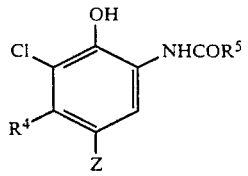

| Coupler No. | $R^4$ | Z | $R^5$ |
|---|---|---|---|
| C-64 | $-C_2H_5$ | $-Cl$ | 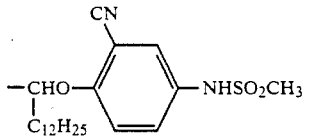 |

The yellow dye-forming couplers used in this invention may preferably include the compounds represented by General Formula (Y) shown below.

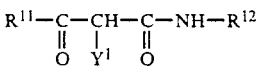

General Formula (Y)

In the formula, $R^{11}$ represents an alkyl group (for example, a methyl group, an ethyl group, a propyl group, a butyl group, etc.) or an aryl group (for example, a phenyl group, a p-methoxyphenyl group, etc.); $R^{12}$ represents an aryl group; and $Y^1$ represents a hydrogen atom or a group eliminable through the course of the color development reaction.

Further, particularly preferably dye-forming yellow couplers according to this invention may include the compounds represented by General Formula (Y') shown below.

General Formula (Y')

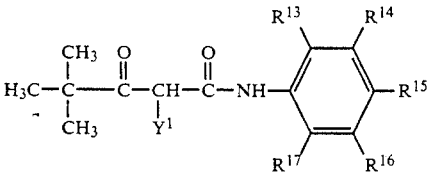

In the formula, $R^{13}$ represents a halogen atom, an alkoxy group or an aryloxy group; $R^{14}$, $R^{15}$, $R^{16}$ and $R^{17}$ each represents a hydrogen atom, a halogen atom, an alkyl group, an alkenyl group, an alkoxy group, an aryl group, an aryloxy group, a carbonyl group, a sulfonyl group, a carboxyl group, an alkoxycarbonyl group, a carbamyl group, a sulfone group, a sulfamyl group, a sulfonamide group, an acylamide group, an ureido group or an amino group; and $Y^1$ has the same meaning as defined before.

$R^{13}$ is preferably a halogen atom, and $R^{17}$ is preferably a hydrogen atom.

These compounds are disclosed in U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072 and 3,894,875; German Unexamined Patent Publication Nos. 1,547,868, 2,057,941, 2,162,899, 2,163,812, 2,213,461, 2,219,917, 2,261,361 and 2,263,875; Japanese Patent Publication No. 13576/1974; Japanese Unexamined Patent Publications Nos. 29432/1973, 66834/1973, 10736/1974, 122335/1974, 28834/1975 and 132926/1975; etc.

Specific examples of the yellow couplers preferably used in this invention are shown below, but this invention is by no means limited to these.

Y-1

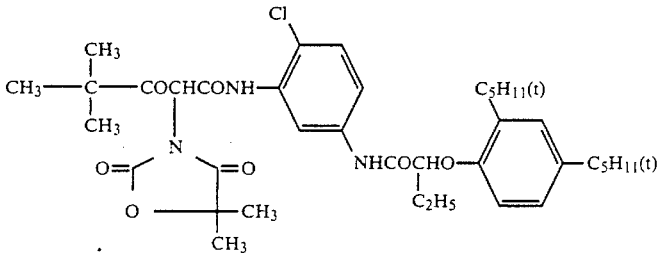

-continued
Y-2
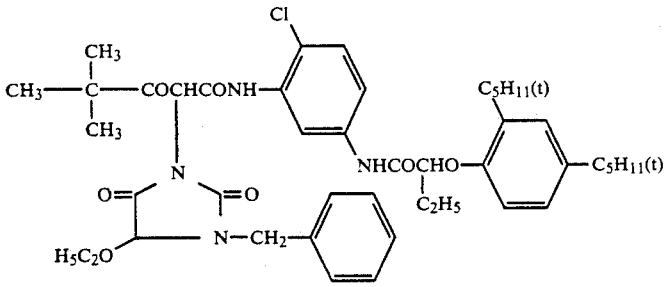
Y-3
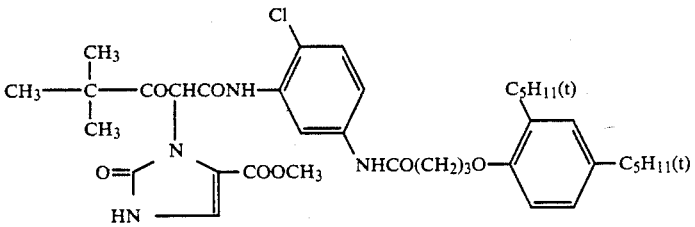
Y-4
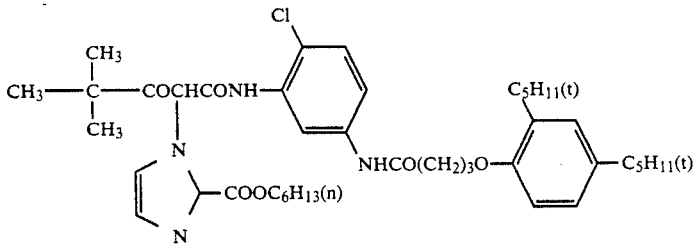
Y-5
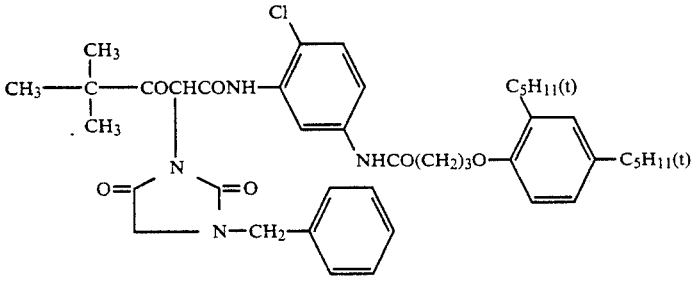
Y-6
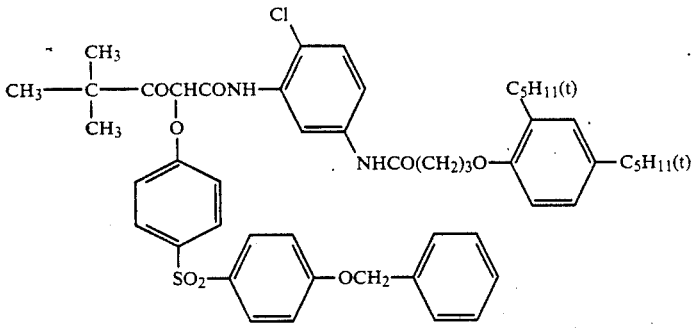
Y-7
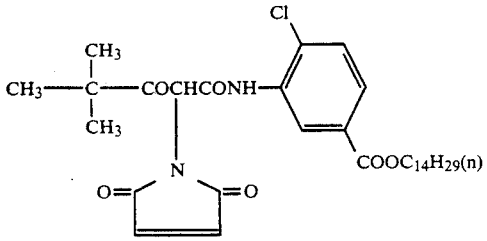

-continued

Y-8

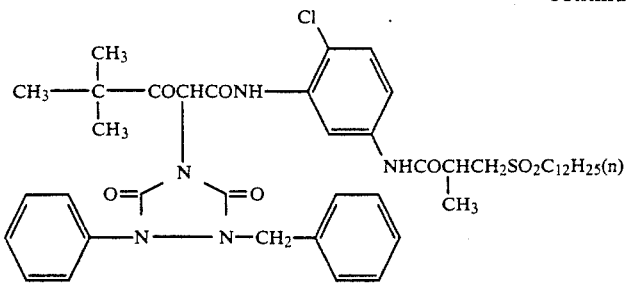

Y-9

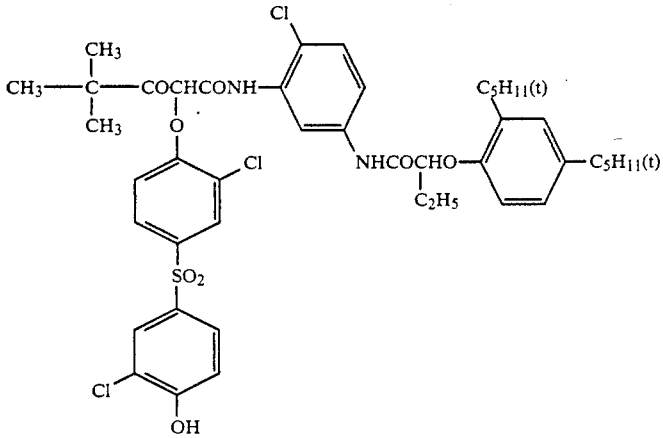

Y-10

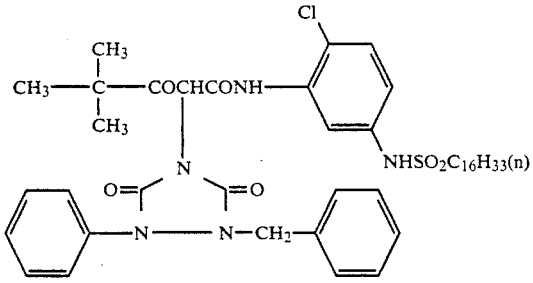

Hydrophilic colloid layer such as protective layers and intermediate layers of the light-sensitive material of this invention may contain an ultraviolet absorbent in order to prevent the fog due to the discharge caused by static charge by friction or the like of light-sensitive materials and prevent the deterioration due to ultraviolet light.

The light-sensitive silver halide material using the silver halide emulsion of this invention can be provided with auxiliary layer such as a filter layer, an anti-halation layer and an ant-irradiation layer. These layers and/or the emulsion layers may contain a dye that may be flowed out of the light-sensitive material, or bleached, during the development processing.

To the silver halide emulsion layers and/or other hydrophilic colloid layers of the light-sensitive material using the silver halide emulsion of this invention, a matte agent can be added for the purposes of decreasing the gloss of the light-sensitive material, improving the writing performance, and preventing mutual sticking of light-sensitive materials.

A lubricant can be added to the light-sensitive material using the silver halide emulsion of this invention, in order to decrease sliding friction.

An antistatic agent aiming at preventing static charge can be added to the light-sensitive material using the silver halide emulsion of this invention. The antistatic agent may be used in an antistatic layer provided on the side of a support at which no emulsion layer is laminated, or may be used in an emulsion layer and/or a protective colloid layer other than the emulsion layers provided on the side of a support on which emulsion layers are laminated.

In the photographic emulsion layers and/or other hydrophilic colloid layers of the light-sensitive material using the silver halide emulsion of this invention, a variety of surface active agents can be used for the purpose of improving coating performance, preventing static charge, improving slidability, emulsification dispersion, preventing adhesion, and improving photographic performances (such as development acceleration, hardening and sensitization).

The support used in the light-sensitive material using the silver halide emulsion of this invention can be applied on flexible reflective supports made of baryta paper, paper laminated with α-olefin polymers or synthetic paper; films comprising semisynthetic or synthetic high molecular compounds such as cellulose acetate, cellulose nitrate, polystyrene, polyvinyl chloride, polyethylene terephthalate, polycarbonate and polyamide; rigid bodies such as glass, metals and ceramics; etc.

The light-sensitive material of this invention may be applied, as occasion calls, after having been subjected to corona discharging, ultraviolet irradiation, flame treatment and so forth, directly on the surface of the support or through interposition of one or more subbing layers for improving adhesion, antistatic performance, dimensional stability, abrasion resistance, hardness, anti-halation performance, friction characteristics and/or other characteristics of the surface of the support.

In the coating of the light-sensitive material, using the silver halide emulsion of this invention, a thickening agent may be used in order to improve the coating performance. Particularly useful coating method may include extrusion coating and curtain coating by which two or more layers can be simultaneously coated.

The light-sensitive material of this invention can be exposed by use of electromagnetic wave having the spectral region to which the emulsion layers constituting the light-sensitive material of this invention have the sensitivity. As a light source, there can be used any known light sources including natural light (sunlight), a tungsten lamp, a fluorescent lamp, a mercury lamp, a xenon arc lamp, a carbon arc lamp, a xenon flash lamp, a cathode ray tube flying spot, every kind of laser beams, light from a light-emitting diode, light emitted from a fluorescent substance energized by electron rays, X-rays, gamma-rays, alpha-rays, etc.

As for the exposure time, it is possible to make exposure, not to speak of exposure of 1 millisecond to 1 second usually used in cameras, of not more than 1 microsecond, for example, 100 microseconds to 1 microsecond by use of a cathode ray tube or a xenon arc lamp, and it is also possible to make exposure longer than 1 second. Such exposure may be carried out continuously or may be carried out intermittently.

The light-sensitive silver halide material of this invention can form images by carrying out color development known in the art.

The aromatic primary amine type color developing agent used for a color developing solution in this invention includes known ones widely used in the various color photographic processes. These developing agents include aminophenol type and p-phenylenediamine type derivatives. These compounds, which are more stable than in a free state, are used generally in the form of a salt, for example, in the form of a hydrochloride or a sulfate. Also, these compounds are used generally in concentration of about 0.1 to 30 g per 1 liter of a color developing solution, preferably in concentration of about 1 to 15 g per 1 liter of a color developing solution.

The aminophenol type developing agent may include, for example, o-aminophenol, p-aminophenol, 5-amino-2-oxytoluene, 2-amino-3-oxy-toluene, 2-oxy-3-amino-1,4-dimethyl-benzene, etc.

Most useful primary aromatic amine type color developing agent includes N,N'-dialkyl-p-phenylenediamine compound, wherein the alkyl group and the phenyl group may be substituted with any substituent. Of these, examples of particularly useful compounds may include N-N'-dimethyl-p-phenylenediamine hydrochloride, N-methyl-p-phenylenediamine hydrochloride, N,N'-dimethyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, 4-amino-N-(2-methoxyethyl)-N-ethyl-3-methylaniline-p-toluene sulfonate, etc.

In addition to the above primary aromatic amine type color developing agent, the color developing agent used in the processing according to this invention may also optionally contain various components usually added to a color developing agent, for example, alkali agents such as sodium hydroxide, sodium carbonate and potassium carbonate, alkali metal sulfites, alkali metal bisulfites, alkali metal thiocyanates, alkali metal halides, benzyl alcohol, water softeners, thickening agents, etc. This color developing solution may have usually the pH of 7 or more, most usually about 10 to 13.

In this invention, after color developing processing, processing by use of a processing solution having fixing ability is carried out. When the processing solution having fixing ability is a fixing solution, a bleaching is carried out beforehand. As a bleaching agent used in the bleacing step, there may be used a metal complex salt of an organic acid. The metal complex salt has an action to oxidize a metal silver formed by development to allow it to revert to silver halide, and, at the same time, color-develop a non-image portion of a coupler. It has the structure in which an ion of a metal such as iron, cobalt, cupper, etc. is coordinated with an organic acid such as an aminopolycarboxylic acid or oxalic acid, citric acid, etc. The organic acid most preferably used for the formation of the metal complex salt of such an organic acid may include polycarboxylic acid or aminopolycarboxylic acid. The polycarboxylic acid or aminopolycarboxylic acid may be in the form of an alkali metal salt, an ammonium salt or a water soluble amine salt.

Typical examples of these may include the following:

(1) Ethylenediaminetetraacetic acid
(2) Nitrilotriacetic acid
(3) Iminodiacetic acid
(4) Disodium ethylenediaminetetraacetate
(5) Tetra(trimethylammonium) ethylenediaminetetraacetate
(6) Tetrasodium ethylenediaminetetraacetate
(7) Sodium nitrilotriacetate A bleaching solution to be used may contain as the bleaching agent the above metal complex salt of the organic acid, and also contain various additives. Preferably, the additive to be contained may include, in particular, re-halogenating agents such as an alkali halide and an ammonium halide, for example, potassium bromide, sodium bromide, sodium chloride, ammonium bromide, etc., a metal salt and a chelating agent. Also, there may be optionally added those which are known to be usually added to a bleaching solution, including pH buffering agents such as borate, oxalate, acetate, carbonate and phosphate, alkylamines, polyethyleneoxides, etc.

Further, the fixing solution and bleach-fixing solution may contain a pH buffering agent including sulfites such as ammonium sulfite, potassium sulfite, ammonium bisulfite, potassium bisulfite, sodium bisulfite, ammonium metabisulfite, potassium metabisulfite and sodium metabisulfite, and boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide, etc., which may be added singularly or in combination of two or more.

When the processing of this invention is carried out while replenishing a bleach-fixing replenishing agent in a bleach-fixing solution (or bath), the bleach-fixing solution (or bath) may contain a thiosulfate, a thiocyanate or a sulfite, etc., or these salts may be contained in a bleach-fixing replenishing solution which is replenished to the processing bath.

In this invention, if desired, blowing of air or blowing of oxygen may be carried out in the bleach-fixing bath and in a storage tank for the bleach-fixing replenishing solution in order to enhance the activity in the bleach-fixing solution, or a suitable oxidizing agent including, for example, hydrogen peroxide, bromate, persulfate, etc. may be added.

According to the light-sensitive silver halide photographic material of this invention, it has excellent color reproducibility, has been remarkably improved in the fastness to light of a magenta dye image, and also can prevent the generation of color fog.

This invention will be described specifically by referring to the following Examples, by which, however, embodiments of this invention are not limited.

EXAMPLE 1

Various coupler dispersions were prepared with the formulation as shown in Table 1 and according to the method shown below, and the resulting dispersions were mixed into 500 g each of green-sensitive silver chlorobromide emulsion. The mixture were then applied to supports made of polyethylene-coated paper to obtain Samples 1 to 28.

(PREPARATION OF COUPLER DISPERSIONS)

Forty grams (40 g) of magenta coupler shown in Table 1, the anti-color-fading agent shown in Table 1 (50 mole % based on the coupler) and the hydroquinone derivative shown in Table 1 were dissolved in a mixed solvent comprising 40 ml of dioctylphthalate and 100 ml of ethyl acetate, and the solution obtained was added to 300 ml of a 5% aqueous gelatin solution containing sodium dodecylbenzenesulfonate, followed by dispersion by use of an ultrasonic homogenizer to give each of the coupler dispersion.

Samples thus obtained were subjected to wedge exposure according to a conventional method, followed by carrying out the following processing.

| Standard processing steps (Processing temperature and processing time): | | |
|---|---|---|
| [1] Color developing | 38° C. | 3 min. 30 sec. |
| [2] Bleach-fixing | 33° C. | 1 min. 30 sec. |
| [3] Washing with water | 25-30° C. | 3 min. |
| [4] Drying | 75-80° C. | about 2 min. |

Composition of processing solutions:

| | |
|---|---|
| (Color developing solution) | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphorous acid (TPPS) | 2.5 g |
| 3-Methyl-4-amino-N-ethyl-N-(ethyl β-methanesulfonamide)-aniline sulfate | 5.5 g |
| Brightening agent (a 4,4'-diamino-stylbenzsulfonic acid derivative) | 1.0 g |
| Potassium hydroxide | 2.0 g |
| Made up to one liter in total amount by adding water, and adjusted to pH 10.20. | |
| (Bleach-fixing solution) | |
| Ferric ammonium ethylenediamine-tetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |
| Adjusted to pH 7.1 by use of potassium carbonate or glacial acetic acid, and made up to one liter in total amount by adding water. | |

After the processing, the fastness to light of the magenta dye images obtained was tested according to the method shown below. Results obtained are shown in Table 1.

(FASTNESS-TO-LIGHT TEST)

The fastness to light was indicated in terms of the retension of the initial density $D_0=1$ when irradiated with sunlight for 30 days using an underglass weathering stand.

$$\text{Retension} = \frac{D}{D_0} \times 100\ (\%)$$

($D$ = density after color-fading)

Minimum reflection density of each of the samples thus processes was measured to evaluate the characteristics for "color fog".

TABLE 1

| Sample No. | Magenta coupler | Anti-color-fading agent Kind | Anti-color-fading agent Eox (v) | Hydroquinone derivative Kind | Hydroquinone derivative Amount* | Fastness to light (%) | Color fog (Dmin) | |
|---|---|---|---|---|---|---|---|---|
| 1 | Comparative example-1 | — | — | HQ-4 | 0.10 | 53 | 0.03 | Comparative example |
| 2 | Comparative example-1 | — | — | " | 0.50 | 55 | " | " |
| 3 | Comparative example-1 | AO-6 | 1.13 | " | " | 67 | " | " |
| 4 | 44 | — | — | " | 0.10 | 22 | " | " |
| 5 | " | — | — | " | 0.50 | 19 | " | " |
| 6 | " | AO-6 | 1.13 | — | — | 66 | 0.05 | " |
| 7 | " | " | " | HQ-4 | 0.01 | 68 | 0.03 | Present invention |
| 8 | " | " | " | " | 0.04 | 67 | " | " |
| 9 | " | " | " | " | 0.10 | 62 | " | " |
| 10 | " | " | " | " | 0.20 | 45 | " | Comparative example |
| 11 | " | " | " | " | 0.50 | 32 | 0.02 | " |
| 12 | " | AO-1 | 1.01 | " | 0.04 | 68 | 0.03 | Present invention |
| 13 | " | AO-4 | 1.03 | " | " | 66 | " | " |
| 14 | " | AO-13 | 1.09 | " | " | 67 | " | " |
| 15 | " | AO-10 | 1.39 | " | " | 68 | " | " |
| 16 | " | AO-23 | 1.27 | " | " | 69 | " | " |

TABLE 1-continued

| Sample No. | Magenta coupler | Anti-color-fading agent Kind | Eox (v) | Hydroquinone derivative Kind | Amount* | Fastness to light (%) | Color fog (Dmin) | |
|---|---|---|---|---|---|---|---|---|
| 17 | " | AO-28 | 1.34 | " | " | 69 | 0.02 | " |
| 18 | " | AO-29 | 1.10 | " | " | 64 | 0.03 | " |
| 19 | " | CACFA**-1 | 1.72 | " | " | 39 | " | Comparative example |
| 20 | " | CACFA**-2 | 0.82 | " | " | 37 | " | " |
| 21 | 59 | AO-6 | 1.13 | " | " | 68 | " | Present invention |
| 22 | 99 | " | " | " | " | 68 | " | " |
| 23 | 130 | " | " | " | " | 67 | " | " |
| 24 | 5 | " | " | " | " | 66 | " | " |
| 25 | 157 | " | " | " | " | 68 | " | " |
| 26 | 44 | " | " | HQ-3 | " | 67 | " | " |
| 27 | " | " | " | HQ-14 | " | 66 | " | " |
| 28 | " | " | " | HQ-16 | " | 68 | " | " |

*Amount of hydroquinone derivative is expressed by molor amount based on magenta coupler
**Comparative anti-color-fading agent Comparative anti-color-fading agent 1:

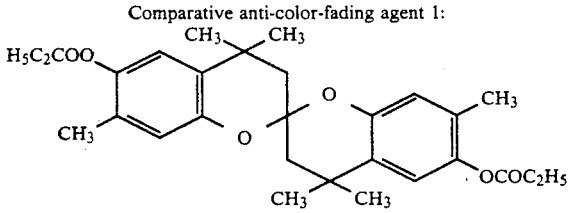

Comparative anti-color-fading agent 2:

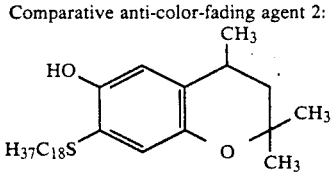

Comparative magenta coupler 1:

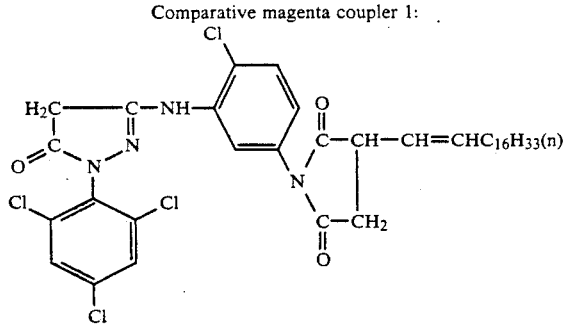

As will be seen from the results shown in Table 1, comparing Sample 1 with Sample 2, the hydroquinone derivative (HQ-4) has improved the fastness to light of the magenta dye with respect to comparative magenta coupler 1 as conventionally known, and, in Sample 3 to which the anti-color-fading agent (AO-6) was added, the fastness to light has been much better improved. However, in Samples 1 to 3 employing comparative magenta coupler 1, the magenta dyes obtained, which have a secondary absorption in the spectral absorption characteristics as mentioned above, show undesirable color reproducibility.

On the other hand, comparing Sample 4 with Sample 5, results are different from the case where the above comparative magenta coupler 1, i.e., 3-anilino-5-pyrazolone type magenta coupler was added, and there can not be seen any improvement at all in the fastness to light of the magenta dye obtained from exemplary magenta coupler 44 when the hydroquinone derivative was used in such an increased amount as described in Japanese Unexamined Patent Publication No. 125732/1984, and moreover the fastness to light has been deteriorated on the contrary.

Among Samples 6 to 11 employing the anti-color-fading agent according to this invention, Samples 7, 8 and 9 in which the hydroquinone derivatives are within the scope of this invention show highest values. Although high fastness to light is shown also in Sample 6, color fog is too high for the product to be practically usable.

It is also clear from Samples 12 to 20 wherein the oxidation potential of the anti-color-fading agent was varied, that high fastness to light can not be obtained even when the anti-color-fading agent whose oxidation potential Eox does not fall in the scope of 0.95 (V)≦Eox ≦1.50 (V) was combined.

In Samples 21 to 28, good fastness to light was achieved in the same manner as above, when the kinds of magenta couplers and hydroquinone derivatives were varied.

The spectral absorption characteristics of the magenta dyes obtained in Samples 4 to 28 showed low secondary absorption to give desirable color reproducibility.

Thus, as to the fastness to light of the magenta dye image obtained from the magenta coupler having particular structure, the effect obtainable from the combination with the anti-color-fading agent used in the particular range becomes remarkably cooperative only when the hydroquinone derivative is used in the range of an amount greatly smaller than that conventionally used, thereby achieving dramatical improvement in the fastness to light. This was found to be a fact that could not be expected from conventional techniques.

EXAMPLE 2

A support made of polyethylene-coated paper was provided with the following respective layers successively from the side of the support to produce a multicolor silver halide color photographic material.

First layer: Blue-sensitive silver halide emulsion layer

Coated were α-pivalyl-α-(1-benzyl-2,4-dioxoimidazolidin-3-yl)-2-chloro-5-[γ-(2,4-di-t-amylphenoxy)butylamide]-acetoanilide as a yellow coupler to have a coating weight of 3 mg/dm$^2$; a blue-sensitive silver chlorobromide emulsion, 8 mg/dm$^2$ calculated in terms of silver; S-6, 3 mg/dm$^2$; and gelatin, 16 mg/dm$^2$.

Second layer: Intermediate layer

Coated were hydroquinone derivative (HQ-4) to have a coating weight of 0.45 mg/dm$^2$; and gelatin, 4 mg/dm$^2$.

Third layer: Green-sensitive silver chlorobromide emulsion layer

Coated were comparative magenta coupler 2 to have a coating weight of 4 mg/dm$^2$; the above comparative anti-color-fading agent 1 in amount of 50 mole % based on the magenta coupler; the above exemplary hydroquinone derivative (HQ-3) in the amount shown in Table 2; a green-sensitive silver chlorobromide emulsion to have a coating weight of 4 mg/dm$^2$ calculated in terms of silver; S-13, 4 mg/dm$^2$; and gelatin, 16 mg/dm$^2$.

Fourth layer: Intermediate layer

Coated were ultraviolet absorbent (UV-1) to have a coating weight of 3 mg/dm$^2$; ultraviolet absorbent (UV-2), 3 mg/dm$^2$; S-2; 4 mg/dm$^2$; hydroquinone derivative (HQ-4), 0.45 mg/dm$^2$; and gelatin, 14 mg/dm$^2$.

Fifth layer: Red-sensitive silver chlorobromide emulsion layer

Coated were 2,4-dichloro-3-methyl-6-[α-(2,4-di-t-amylphenoxy)butylamide]-phenol as a cyan coupler to have a coating weight of 1 mg/dm$^2$; 2-(2,3,4,5,6-pentafluorophenyl)acylamino-4-chloro-5-[α-(2,4-di-t-amylphenoxy)pentylamide], 3 mg/dm$^2$; S-2, 2 mg/dm$^2$; a red-sensitive silver chlorobromide emulsion, 3 mg/dm$^2$ calculated in terms of silver; and gelatin, 14 mg/dm$^2$.

Sixth layer: Intermediate layer

Coated were ultraviolet absorbent (UV-1) to have a coating weight of 2 mg/dm$^2$; ultraviolet absorbent (UV-2), 2 mg/dm$^2$; S-2, 2 mg/dm$^2$; and gelatin 6 mg/dm$^2$.

Seventh layer: Protective layer

Coated was gelatin to have a coating weight of 9 mg/dm$^2$.

A sample thus obtained were designated as Sample 1.

Subsequently, Samples 2 to 7 were produced in the same manner as in Sample 1 except that the combination for the magenta coupler, the anti-color-fading agent, the hydroquinone derivative, the high-boiling solvent and the coated silver weight was made as shown in Table 2. However, the coating weight for the magenta coupler and the anti-color-fading agent each was made equimolar to Sample 1.

On these samples, optical wedge exposure was carried out using a sensitometer (KS-7 Type produced by Konishiroku Photo Industry Co., Ltd.), followed by the same processing as in Example 1.

(UV-1):

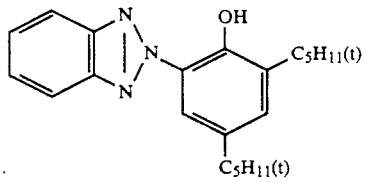

(UV-2):

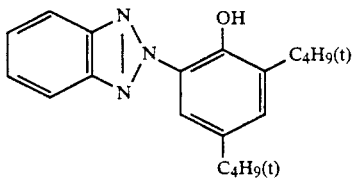

Comparative magenta coupler 2:

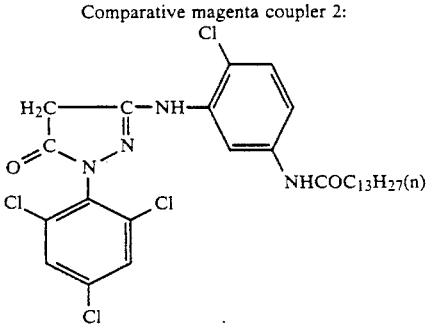

Comparative magenta coupler 3:

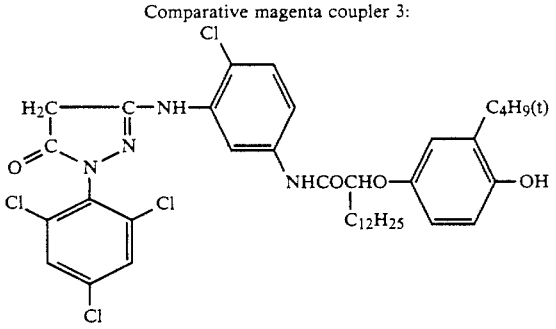

TABLE 2

| Sample No. | Formulation of third layer: Coated silver weight (mg/dm$^2$) | Magenta coupler | Anti-color-fading agent: Kind | Anti-color-fading agent: Eox (V) | Hydroquinone derivative: Kind | Hydroquinone derivative: Amount* | High boiling organic solvent | Fastness to light (%) | Color fog (Dmin) | |
|---|---|---|---|---|---|---|---|---|---|---|
| 1 | 4.0 | Comparative example-2 | ** CACFA-1 | 1.72 | HQ-3 | 0.20 | S-13 | 77 | 0.04 | X |
| 2 | " | Comparative example-3 | CACFA-2 | 0.82 | HQ-4 | 0.10 | DBP | 80 | " | " |
| 3 | 2.0 | 44 | AO-6 | 1.13 | " | 0.20 | S-2 | 53 | " | " |
| 4 | " | " | " | " | " | 0.03 | " | 79 | " | Y |
| 5 | " | 1 | " | " | " | " | " | 81 | " | " |
| 6 | " | 172 | " | " | " | " | S-6 | 80 | " | " |
| 7 | " | 54 | " | " | " | " | TCP | 77 | " | " |

In Table, DBP represents dibutyl phthalate, and TCP represents tricresyl phosphate.
*Amount of hydroquinone derivative is expressed by molar amount based on magenta coupler
**Comparative anti-color-fading agent
X: Comparative example
Y: Present invention Samples thus obtained were tested for the fastness to light and the color fog characteristics in the same manner as in Example 1. Results obtained are shown in Table 2.

It is seen from the results in Table 2 that the same results as in Example 1 are obtained also in the multicolor light-sensitive silver halide color photographic material. According to evaluation on the color reproducibility in actual print, Samples 3 to 7 employing magenta couplers according to this invention showed better reproducibility particularly in violet than Samples 1 and 2 employing comparative magenta couplers.

In other words, it is clear that good color reproducibility and high fastness to light have been achieved in Samples 4 to 7 which are in accordance with this invention.

What is claimed is:

1. A light-sensitive silver halide photographic material comprising a support and provided thereon at least one silver halide emulsion layer, wherein at least one layer of said silver halide emulsion layer contains (i) a magenta color forming coupler represented by general formula (I),

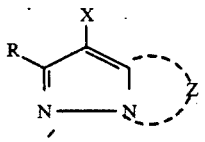

(I)

wherein Z represents a group of non-metallic atoms necessary to complete a nitrogen-containing heterocyclic ring which may have a substituent; X represents a hydrogen atom or a substituent capable of being split off upon reaction with an oxidation product of a color developing agent; and R represents a hydrogen atom or a substituent; (ii) at least one anti-color-fading agent having an oxidation potential (Eox) of 0.95 (V)$\leqq$Eox$\leqq$1.50 (V); and (iii) a hydroquinone derivative in an amount ranging from $1\times10^{-3}$ to $1\times10^{-1}$ mole per 1 mole of said magenta color forming coupler represented by formula (I).

2. The light-sensitive silver halide photographic material of claim 1, wherein said substituent for R in formula (I) is selected from the group consisting of a halogen atom, an alkyl group, a cycloalkyl group, an alkenyl group, an cycloalkyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic oxy group, a siloxy group, an acyloxy group, a carbamoyloxy group, an amino group, an acylamino group, a sulfonamide group, an imide group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

3. The light-sensitive silver halide photographic material of claim 1, wherein X in formula (I) is selected from the group consisting of a halogen atom and an organic group having a carbon atom, an oxygen atom, a sulfur atom, or a nitrogen atom through which said organic group is connected with the remainder of the compound.

4. The light-sensitive silver halide photographic material of claim 1, wherein X in formula (I) is selected from the group consisting of a halogen atom, an alkoxy group, an aryloxy group, a heterocyclic oxy group, an acyloxy group, a sulfonyloxy group, an alkoxycarbonyloxy group, an aryloxycarbonyloxy group, an alkyloxaryloxy group, an alkoxyoxalyloxy group, an alkylthio group, an arylthio group, a heterocyclicthio group, an alkyloxythiocarbonylthio group, a group represented by the formula

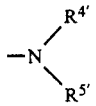

(wherein $R^{4'}$ and $R^{5'}$ independently represent a hydrogen atom, an alkyl group, an aryl group, a heterocyclic group, a sulfamoyl group, a carbamoyl group, an acyl group, a sulfonyl group, an aryloxycarbonyl group, and an alkoxycarbonyl group provided that $R^{4'}$ and $R^{5'}$ are not simultaneously hydrogen atoms and $R^{4'}$ and $R^{5'}$ may combine with each other to form a nitrogen-containing heterocyclic group), a carboxyl group, a hydroxymethyl group, a triphenylmethyl group and a group represented by the following formula:

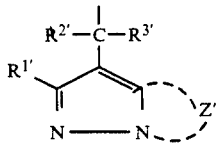

(wherein $R^1$ is defined to be the same as R, Z' is the same as defined for as Z, and $R^{2'}$ and $R^{3'}$ are independently selected from the group consisting of a hydrogen atom, an aryl group, an alkyl group and a heterocyclic group.)

5. The light-sensitive silver halide photographic material of claim 1, wherein said nitrogen-containing heterocyclic ring in formula (I) is selected from the group consisting of a pyrazole ring, an imidazole ring, a triazole ring and a tetrazole ring, provided that the above groups may have a substituent as defined as R in formula (I).

6. The light-sensitive silver halide photographic material of claim 1, wherein said anti-color-fading agent is incorporated into said silver halide emulsion layer by being dissolved by an organic solvent having a dielectric constant of not higher than 6.0.

7. The light-sensitive silver halide photographic material of claim 1, wherein said hydroquinine derivative is incorporated into said silver halide emulsion layer by being dissolved by an organic solvent having a dielectric constant of not higher than 6.0.

8. The light-sensitive silver halide photographic material of claim 6, wherein said hydroquinone derivative is incorporated into said silver halide emulsion layer by being dissolved by an organic solvent having a dielectric constant of not higher than 6.0.

9. The light-sensitive silver halide photographic material of claim 1, wherein said hydroquinone derivative is selected from the group consisting of a compound represented by general formula (XII) or a precursor thereof,

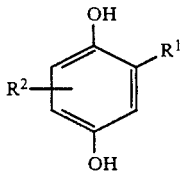

(XII)

wherein, $R^1$ and $R^2$ are independently selected from the group consisting of an alkyl group, an aryl group, an alkenyl group and a cycloalkyl group; and a compound of general formula (XIII) or a precursor thereof:

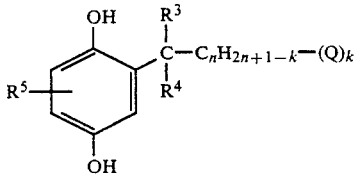

(XIII)

wherein, $R^3$ and $R^4$ are independently selected from an alkyl group having 1 to 5 carbon atoms, $R^5$ is selected from the group consisting of an alkyl group, an aryl group, an alkenyl group, a cycloalkyl group and a group represented by a formula

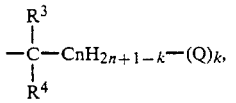

Q is selected from the group consisting of (a) —$COXR^6$ group wherein X is an oxygen atom or a

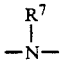

group wherein $R^7$ is selected from the group consisting of a hydrogen atom, an alkyl group or an aryl group, $R^6$ is selected from the group consisting of a hydrogen atom, an alkyl group, an alkenyl group, a cycloalkyl group and an aryl group, (b) a —OY group wherein Y is $R^6$ or a —$COR^6$ group, (c)

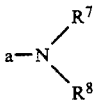

group wherein $R^8$ is a selected from the group consisting of a hydrogen atom, an alkyl group, an aryl group and a —$COR^6$ group, (d) a—P(O) ($OR^6$) ((O)l $R^9$) group wherein $R^9$ is defined to have the same meaning as $R^6$ and l is 0 or 1 and (e) a cyano group, n is an integer of 1 to 20 and k is an integer of 1 or 2.

10. The light-sensitive silver halide photographic material of claim 1, wherein said anti-color-fading agent has an oxidation potential (Eox) of 1.00 (V)≦Eox≦1.45 (V).

11. The light-sensitive silver halide photographic material of claim 10, wherein said anti-color-fading agent has an oxidation potential (Eox) of 1.00 (V)≦Eox≦1.40 (V).

12. The light-sensitive silver halide photographic material of claim 1, wherein said hydroquinone derivative is selected from the group consisting of a compound represented by general formula (XII') and a precursor thereof;

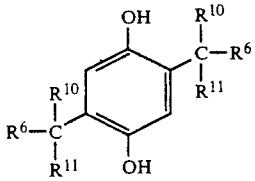

(XII')

wherein, $R^{10}$ and $R^{11}$ independently represent a hydrogen atom or an alkyl group having 1 to 5 carbon atoms and $R^6$ has the same meaning as defined in formula (XIII), provided that $R^{10}$ and $R^{11}$ are not simultaneously hydrogen atoms.

13. The light-sensitive silver halide photographic material of claim 1, wherein said hydroquinone derivative is selected from the group consisting of a compound represented by general formula (XIII') and a precursor thereof;

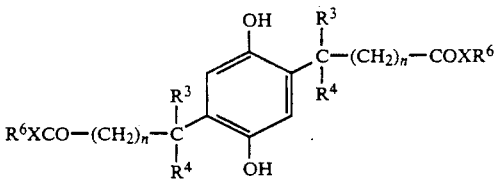

(XIII')

wherein $R^3$, $R^4$, $R^6$ and n have the same definition as in formula (XIII).

* * * * *

UNITED STATES PATENT AND TRADEMARK OFFICE

CERTIFICATE OF CORRECTION

PATENT NO. : 5,006,454

DATED : April 9, 1991

INVENTOR(S) : Masao Sasaki, et al.

It is certified that error appears in the above-identified patent and that said Letters Patent is hereby corrected as shown below:

Claim 2, column 141, line 40, before "cycloalkyl" change "an" to --a--.

Claim 4, column 142, line 14, before "and" delete ",".

Claim 4, column 142, line 15, after "group" insert --,--.

Claim 4, column 142, line 32, change "R1" to --$R^{1'}$--.

Claim 7, column 142, line 53, change "hydroquinine" to --hydroquinone--.

Claim 9, column 143, line 59, after "(c)" insert --a--.

Claim 9, column 144, line 4, change "a-$N\begin{smallmatrix}R^7\\R^8\end{smallmatrix}$" to -- -$N\begin{smallmatrix}R^7\\R^8\end{smallmatrix}$ --.

Claim 9, column 144, line 7, after "is" delete "a".

Signed and Sealed this

Eighteenth Day of May, 1993

*Attest:*

*Attesting Officer*

Michael K. Kirk

MICHAEL K. KIRK

*Acting Commissioner of Patents and Trademarks*